US007398631B2

(12) United States Patent
Learn

(10) Patent No.: US 7,398,631 B2
(45) Date of Patent: Jul. 15, 2008

(54) METHODS AND SYSTEMS FOR PACKAGING A PRODUCT

(75) Inventor: Angela E. Learn, Gilbertsville, PA (US)

(73) Assignee: Altivity Packaging, LLC, Carol Stream, IL (US)

( * ) Notice: Subject to any disclaimer, the term of this patent is extended or adjusted under 35 U.S.C. 154(b) by 88 days.

(21) Appl. No.: 11/286,778

(22) Filed: Nov. 23, 2005

(65) Prior Publication Data

US 2006/0281616 A1 Dec. 14, 2006

Related U.S. Application Data

(63) Continuation-in-part of application No. 11/151,012, filed on Jun. 13, 2005.

(51) Int. Cl.
*B65B 53/02* (2006.01)

(52) U.S. Cl. ..... 53/441; 53/442; 53/399

(58) Field of Classification Search ..... 53/441, 53/442, 399, 397, 411, 381.1, 580, 582, 589, 53/376.6, 377, 7, 497, 526–528; 206/497
See application file for complete search history.

(56) References Cited

U.S. PATENT DOCUMENTS 3,369,660 A 2/1968 Hartman
3,589,091 A 6/1971 Cloud
3,752,312 A 8/1973 Soltanoff
3,982,712 A 9/1976 Bassett
4,395,863 A * 8/1983 Chaussadas et al. ..... 53/442
4,586,312 A 5/1986 Limousin
4,756,415 A 7/1988 Call
4,871,345 A 10/1989 Wosaba, II et al.
4,947,605 A 8/1990 Ramsey
4,972,953 A 11/1990 Friedman et al.
5,201,463 A 4/1993 George
5,507,429 A * 4/1996 Arlin ..... 229/102
5,572,951 A 11/1996 Evans et al.
5,590,779 A 1/1997 Ramsey
5,771,662 A 6/1998 Struges et al.

(Continued)

OTHER PUBLICATIONS

International Search Report dated Aug. 31, 2006, Application No. PCT/US06/17021, 6 pages.
International Search Report dated Sep. 26, 2006, Application No. PCT/US06/16828, 3 pages.

*Primary Examiner*—Hemant M. Desai
(74) *Attorney, Agent, or Firm*—Womble Carlyle Sandridge & Rice, PLLC

(57) ABSTRACT

A method for applying a heat-shrink patch to a carton for forming a shape of the carton. The carton includes a top panel, a bottom panel, at least one side panel extending between the top panel and the bottom panel and a movable section that is movable between a first position and a second position. The method includes providing a heat-shrink patch in a pre-shrunk configuration. The heat-shrink patch is coupled in the pre-shrunk configuration to at least a portion of an interior surface of a blank of sheet material including at least a portion of the movable section. The carton is formed from the blank of sheet material. The movable section is moved from the first position to the second position to form the shape of the carton by heating the heat-shrink patch to shrink the heat-shrink patch to a shrunk configuration.

24 Claims, 36 Drawing Sheets

U.S. PATENT DOCUMENTS 5,992,630 A 11/1999 Brown et al.
6,020,823 A 2/2000 DeCicco
6,024,224 A 2/2000 Gnadt et al.
6,173,833 B1 1/2001 Strehlow
6,247,612 B1 6/2001 Kaufman
6,267,258 B1 7/2001 Wilkerson et al.
6,340,532 B1 * 1/2002 Huang et al. ..... 428/523
6,405,869 B1 6/2002 Whittemore et al.
6,435,561 B1 8/2002 Verenski
6,505,737 B1 1/2003 Sherman
6,554,448 B2 4/2003 Carpenter et al.
6,571,953 B2 6/2003 Sherline et al.
6,783,005 B2 8/2004 Giblin et al.
2002/0073661 A1 6/2002 Nolan

* cited by examiner

METHODS AND SYSTEMS FOR PACKAGING A PRODUCT

CROSS REFERENCE TO RELATED APPLICATIONS

This application is a continuation-in-part of U.S. patent application Ser. No. 11/151,012, filed Jun. 13, 2005, entitled "Methods and Systems for Packaging a Product," all of which is incorporated by reference herein in its entirety.

BACKGROUND OF THE INVENTION

This invention relates generally to packaging and, more particularly, to a packaging carton and a method for making a packaging assembly with the carton.

At least some known cartons used for packaging a product include markings, indicia, and/or a shape that communicates the product, a manufacturer of the product, and/or a seller of the product to consumers. For example, such cartons may include printed text that indicates a product's name and briefly describes the product, logos and trademarks that indicate a manufacturer and/or seller of the product, and/or designs that attract a consumer's attention. Other cartons, for example, may have a shape that corresponds to a product packaged within the carton and/or a shape that indicates a manufacture and/or seller of the product. Still further, and for example, some known cartons may include a shape that provides functionality, such as a shape that promotes the display of the carton, a shape that facilitates stacking and/or arrangement of a plurality of cartons, and/or a shape that facilitates carrying the carton. However, cartons having shapes that are more complex than conventional rectangular cartons may be difficult and costly to manufacture. Additionally, such cartons may be less likely to maintain their shape during transport and/or display thereof.

Some known cartons that package a product are also sealed to protect the product from tampering and to generally seal the joints of the carton for containing the product within the carton as well as protecting the product from contamination. For example, some known cartons include a band around a joint between portions of the carton, such as a lid and a base, to seal the carton. Other known cartons may include a bag or a liner that is sealed within the interior cavity of the carton for storing the product in a sealed environment. Moreover, there are at least some other known cartons, for example, that completely wrap the carton in shrink-wrap that is thereafter heated to shrink it tightly around the carton. However, when a carton is completely sealed with shrink-wrap portions of the carton may not be accessible without breaking the seal, thereby possibly making display and/or transport of the carton more difficult.

BRIEF SUMMARY OF THE INVENTION

In one aspect, the present invention provides a method for applying a heat-shrink patch to a carton for forming a shape of the carton. The carton includes a top panel, a bottom panel, at least one side panel extending between the top panel and the bottom panel and a movable section that is movable between a first position and a second position. The method includes providing a heat-shrink patch in a pre-shrunk configuration. The heat-shrink patch is coupled in the pre-shrunk configuration to at least a portion of an interior surface of a blank of sheet material including at least a portion of the movable section. The carton is formed from the blank of sheet material. The movable section is moved from the first position to the second position to form the shape of the carton by heating the heat-shrink patch to shrink the heat-shrink patch to a shrunk configuration.

In another aspect, the present invention provides a method for forming a packaging assembly including a carton having a shape. The carton includes a top panel, a bottom panel, at least one side panel extending between the top panel and the bottom panel and a movable section that is movable between a first position and a second position. The method includes providing a blank sheet of material having a first movable section coupled to a second movable section at a fold line. The first movable section and the second movable section define a void positioned on the fold line. An adhesive is applied in a registered pattern to an interior surface of the blank and substantially surrounds the void. The heat-shrink patch is coupled in a pre-shrunk configuration to each of the first movable section and the second movable section within the registered pattern to cover the void. The first movable section is moved towards the second movable section to at least partially close the void to form the shape of the carton by applying heat to the heat-shrink patch to shrink the heat-shrink patch to a shrunk configuration.

In another aspect, the present invention provides a system for applying a heat-shrink patch to a carton for forming a shape of the carton. The system includes a blank of sheet material comprising a top panel, a bottom panel, at least one side panel extending between the top panel and the bottom panel and a movable section that is movable between a first position and a second position. A coupling device is configured to couple the heat-shrink patch in the pre-shrunk configuration to an interior surface of a blank of sheet material. The system further includes a forming device configured to form the carton from the blank of sheet material. A heating device is configured to heat at least a portion of the heat-shrink patch to shrink the heat-shrink patch to a shrunk configuration to move the movable section from the first position to the second position to form the shape of the carton.

BRIEF DESCRIPTION OF THE DRAWINGS

Corresponding reference characters indicate corresponding parts throughout the several views of the drawings.

DETAILED DESCRIPTION OF THE INVENTION

Figure 1:
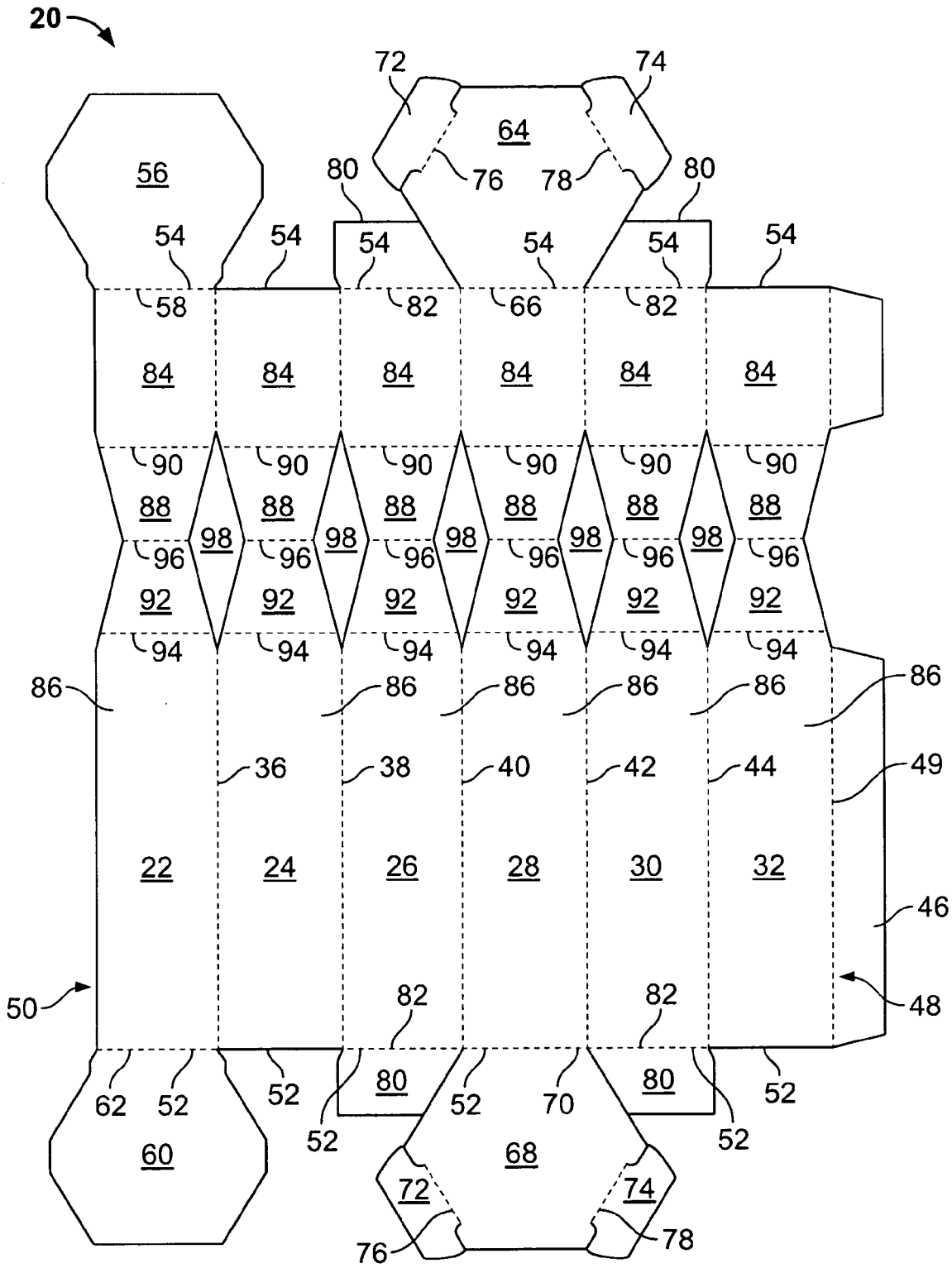
FIG. 1 is a top plan view of a blank of sheet material for forming a carton, according to one embodiment of this invention.

Generally, packaging assemblies are described herein that may be formed from a carton having a heat-shrunk layer (sometimes referred to as, for example, "shrink-wrap") coupled to a portion thereof or from a carton having a heat-shrink layer in the form of a heat-shrink patch overlapping a portion of the carton. The heat-shrink patch may be attached to the carton on the inside of the carton or on the outside of the carton. In the exemplary embodiment, the carton is made from a paperboard material. The carton, however, could be made from other materials, and therefore is not limited to a specific type of material. In some embodiments, a packaging assembly may include a movable section that is movable from a first position to a second position to form a shape of the packaging assembly. The movable section may be moved by, for example, wrapping a heat-shrinkable layer around at least a portion of the movable section such that the layer overlaps at least a portion of the movable section, and heating the heat-shrinkable layer to shrink the heat-shrinkable layer into contact with at least a portion of the movable section to move the movable section from the first position to the second position as the layer shrinks under the heat.

Alternatively, the movable section may be moved by attaching a heat-shrink patch to at least a portion of the movable section, and heating the heat-shrink patch such that shrinking of the patch causes the movable section to move from the first position to the second position. In one embodiment, a heat-shrink patch is coupled to an interior surface of the blank of sheet material. The heat-shrink patch is connected to at least a portion of the movable section. The movable section is moved by heating the heat-shrink patch to shrink the heat-shrinkable patch and urge the movable section from the first position towards the second position. The movable section may be any portion of the carton and may be movable in any suitable motion and/or direction, whether such portion, motion, and/or direction is described and/or illustrated herein.

In some embodiments, a carton and/or a heat-shrinkable/shrunk layer may include a marking thereon, such as, but not limited to, indicia that communicates the product, a manufacturer of the product, and/or a seller of the product. For example, printed text that indicates a product's name and briefly describes the product, logos and/or trademarks that indicate a manufacturer and/or seller of the product, and/or designs and/or ornamentation that attract attention. Moreover, in some embodiments a packaging assembly may include a handle for carrying the assembly.

The cartons, heat-shrinkable/shrunk layers, and packaging assemblies generally may each have any suitable size, shape, and/or configuration (e.g., number of sides), whether such sizes, shapes, and/or configurations are described and/or illustrated herein. For example, in one embodiment a packaging assembly includes a shape that corresponds to a product packaged within the carton and/or a shape that indicates a manufacture and/or seller of the product. Moreover, and for example, in one embodiment a packaging assembly includes a shape that provides functionality, such as a shape that promotes the display of the carton, a shape that facilitates stacking and/or arrangement of a plurality of cartons, and/or a shape that facilitates carrying the carton. Similarly, the cartons, heat-shrinkable/shrunk layers, and packaging assemblies generally may be formed from any suitable material, whether such materials are described herein. For example, in one embodiment a carton includes cardboard, corrugated board, and/or plastic. Additionally, in one embodiment, a heat-shrinkable/shrunk layer includes a sheet, a sleeve or a patch of shrinkable material that includes polyethylene, polypropylene, polyvinyl chloride, polyester, polyester glycol, nylon and/or oriented polystyrene. In an alternative embodiment, any suitable shrinkable material known to those skilled in the art and guided by the teachings herein provided is used to fabricate heat-shrink patch.

Figure 2:
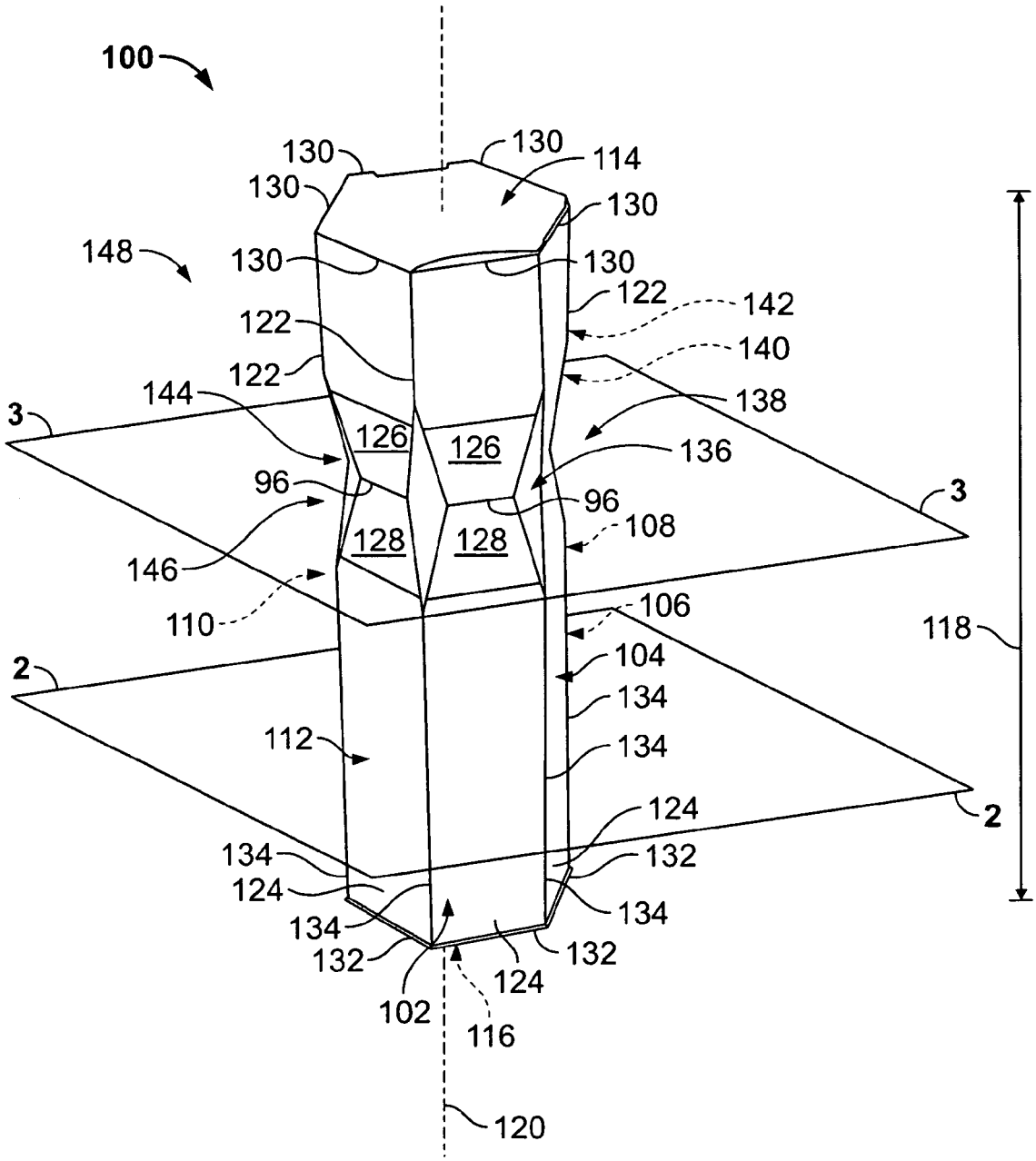
FIG. 2 is a perspective view of the carton formed from the blank shown in FIG. 1.
Figure 3:
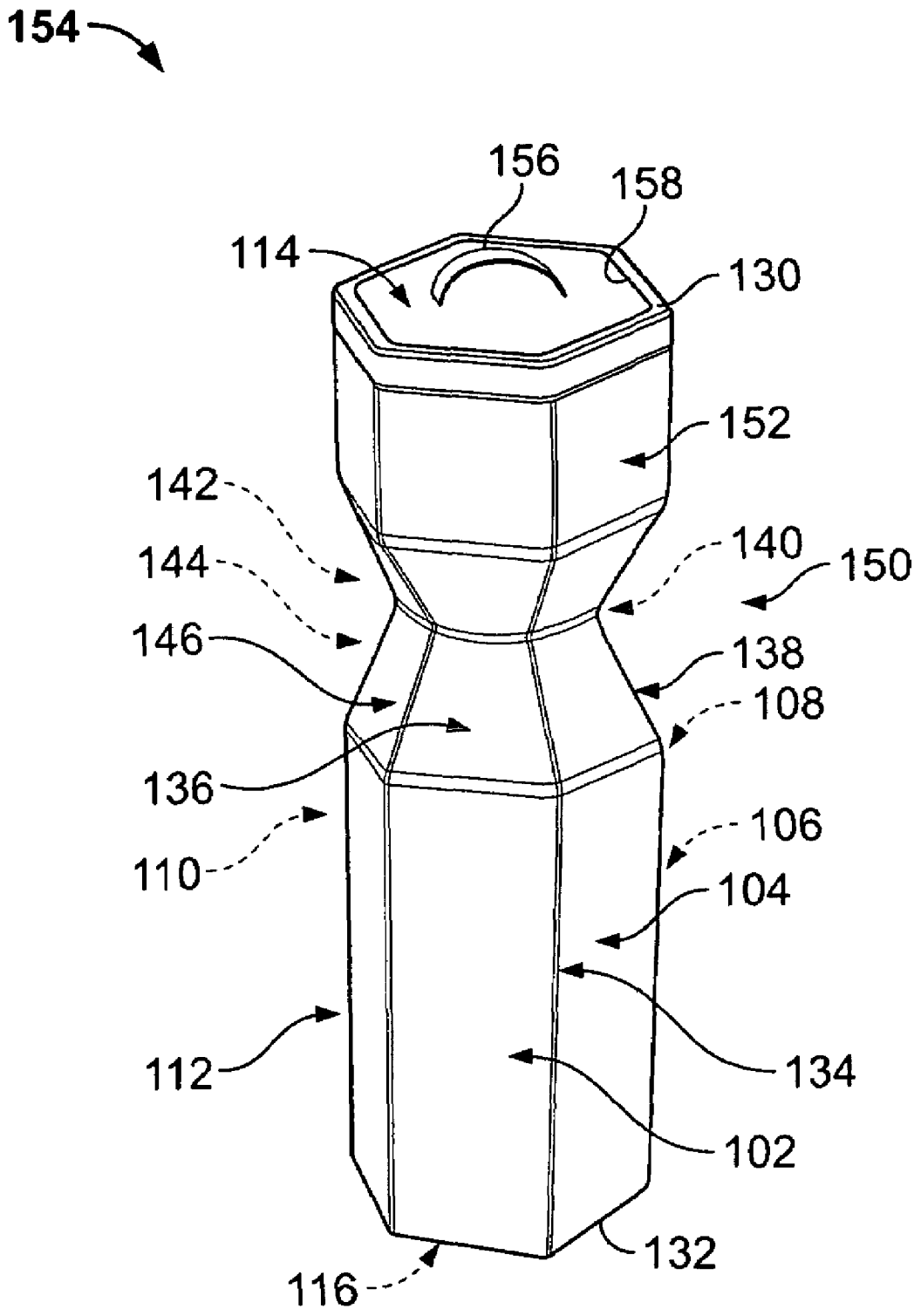
FIG. 3 is a perspective view of a packaging assembly including the carton shown in FIG. 2.

Referring now to the drawings, and more specifically to FIGS. 1-3, although as described above a packaging assembly may have any suitable size, shape, and/or configuration (e.g., number of sides), FIGS. 1-3 illustrate the formation of one embodiment of a packaging assembly. Specifically, FIG. 1 is a top plan view of one embodiment of a blank of sheet material (designated in its entirety by reference numeral 20). FIG. 2 is a perspective view of one embodiment of a carton (designated in its entirety by 100) formed from blank 20 shown in FIG. 1. FIG. 3 is a perspective view of one embodiment of a packaging assembly (designated in its entirety by 154) including carton 100 shown in FIG. 2.

Referring to FIG. 1, blank 20 includes a succession of six side panels 22, 24, 26, 28, 30, and 32 that are connected together by a plurality of preformed, generally parallel, fold lines 36, 38, 40, 42, and 44, respectively. Specifically, each side panel 22, 24, 26, 28, 30, and 32 extends from an adjacent side panel along respective fold lines 36, 38, 40, 42, and 44. A side panel flap 46 extends from an end portion (generally designated by 48) of side panel 32, or alternatively from an end portion (generally designated by 50) of side panel 22, along a fold line 49 for facilitating securing end portions 48 and 50 together to form carton 100 (shown in FIG. 2). Each side panel 22, 24, 26, 28, 30, and 32 extends a height measured between a bottom end 52 and a top end 54. Side panel 22 or, alternatively, side panel 24, 26, 28, 30 and/or 32, includes a top support panel 56 extending from top end 54 thereof along a fold line 58 and a bottom support panel 60 extending from bottom end 52 thereof along a fold line 62. Additionally, side panel 28 (or alternatively any other of side panels 22, 24, 26, 30, and/or 32) includes a top panel 64 extending from top end 54 thereof along a fold line 66 and a bottom panel 68 extending from bottom end 52 thereof along a fold line 70. Top panel 64 and bottom panel 68 each include two securement tabs 72 and 74 extending therefrom along respective fold lines 76 and 78 for facilitating securing top panel 64 and bottom panel 68 to side panels 22, 24, 26, 28, 30, and 32 to form a top 114 (shown in FIG. 2) and a bottom 116 (shown in FIG. 2) of carton 100. Moreover, top ends 54 and bottom ends 52 of each side panel 26 and 30 include a securement flap 80 extending therefrom along a fold line 82 for mating with securement tabs 72 and 74 to form carton 100. In alternative embodiments, top panel 64 and bottom panel 68 may include any suitable interconnection means in addition to, or alternatively to, the tab /flap arrangement described above. Accordingly, the top, bottom, and side panels 64, 68, 26, and 30, respectively, are not limited to interconnection using a tab/flap arrangement. For example, in one embodiment, adhesive is applied to portions of the top, bottom, and/or side panels 64, 68, 26, and 30, respectively.

The side panels 22, 24, 26, 28, 30, and 32 each include an upper panel portion 84 and a lower panel portion 86. Upper panel portions 84 each include an upper panel extension 88 extending therefrom along a fold line 90, and lower panel portions 86 each include a lower panel extension 92 extending therefrom along a fold line 94. Upper panel extensions 88 are each joined to a corresponding lower panel extension 92 along a central fold line 96. As can be seen in FIG. 1, an opening 98 is defined between adjacent pairs of joined upper and lower panel extensions 88 and 92 to accommodate changing a cross-sectional area of carton 100 as will be described below.

As shown in FIG. 2, a carton 100 can be formed from blank 20 (shown in FIG. 1) by folding blank 20 about fold lines 36, 38, 40, 42, 44, 49, 58, 62, 66, 70, 76, 78, and 82 (shown in FIG. 1). In one embodiment, an adhesive may be applied to portions of blank 20 to secure carton 100 together. Generally, side panels 22, 24, 26, 28, 30, and 32 (shown in FIG. 1) form six successive sides (generally designated by 102, 104, 106, 108, 110, and 112) of carton 100, top panel 64 (shown in FIG. 1) forms a top (generally designated by 114) of carton 100, and bottom panel 68 (shown in FIG. 1) forms a bottom (generally designated by 116) of carton 100. Carton 100 extends a height 118 measured between top 114 and bottom 116 of carton 100 along a central longitudinal axis 120 extending through carton 100. As can be seen in FIG. 2, in one embodiment, carton 100 includes a generally hexagonal cross-sectional shape, for example, a cross section taken along the plane 2-2 extending generally perpendicularly to central longitudinal axis 120. As can also be seen in FIG. 2, each side 102, 104, 106, 108, 110, and 112 extends between top 114 and bottom 116 of carton 100. More specifically, in one embodiment, each side 102, 104, 106, 108, 110, and 112 extends from top 114 to bottom 116. Any side 102, 104, 106, 108, 110, or 112 may be referred to herein as a first, a second, a third, a fourth, a fifth, and/or a sixth side.

Upper panel portions 84 and lower panel portions 86 (shown in FIG. 1) form upper portions 122 and lower portions 124, respectively, of each side 102, 104, 106, 108, 110, and 112. Upper panel extensions 88 and lower panel extensions 92 form upper extensions 126 and lower extensions 128, respectively, of each side 102, 104, 106, 108, 110, and 112. A corner 130 is defined at an intersection between top 114 and each side 102, 104, 106, 108, 110, and 112. Similarly, a corner 132 is defined at an intersection between bottom 116 and each side 102, 104, 106, 108, 110, and 112. Moreover, a corner 134 is defined at an intersection between each adjacent side of sides 102, 104, 106, 108, 110, and 112.

The upper and lower extensions 126 and 128 each form a movable section (generally designated by 136, 138, 140, 142, 144, and 146) of carton 100. As can be seen in FIG. 2, in one embodiment, each movable section 136, 138, 140, 142, 144, and 146 are located along central longitudinal axis 120 at a generally equal distance from top 114. More specifically, each central fold line 96 is located along central longitudinal axis 120 at a generally equal distance from top 114. Any movable section 136, 138, 140, 142, 144, or 146 may be referred to herein as a first, a second, a third, a fourth, a fifth, and/or a sixth movable section.

The movable sections 136, 138, 140, 142, 144, and 146 are each movable between a first position shown in FIG. 2 (and generally designated by 148) and a second position shown in FIG. 3 (and generally designated by 150). In one embodiment, movable sections 136, 138, 140, 142, 144, and 146 are movable from first position 148 to second position 150 by bending upper and lower extensions 126 and 128 along fold lines 90, fold lines 94, and central fold lines 96 to generally radially move central fold lines 96 with respect to central longitudinal axis 120 of carton 100. Accordingly, and as can be seen in FIGS. 2 and 3, movement between first and second positions 148 and 150, respectively, varies, or changes, a cross-sectional width of carton 100 defined between two opposite sides of sides 102, 104, 106, 108, 110, and 112 along the height of carton 100. In one embodiment, a cross-sectional width defined between two opposite sides of sides 102, 104, 106, 108, 110, and 112 and taken through movable sections 136, 138, 140, 142, 144, and 146 (e.g., a cross section taken along plane 3-3 in FIG. 2) is generally greater in first position 148 than in second position 150. More specifically, as can be seen in FIGS. 2 and 3, each central fold line 96 is spaced a greater radial distance from central longitudinal axis 120 in first position 148 than in second position 150. In one embodiment, at least one of movable sections 136, 138, 140, 142, 144, and 146 is biased in first position 148. Although movable sections 136, 138, 140, 142, 144, and/or 146 may be biased in first position 148 using any suitable mechanism, in one embodiment, a structure of carton 100 biases movable sections 136, 138, 140, 142, 144, and/or 146.

Once carton 100 has been formed, and either before, simultaneously with, or after a product is placed within carton 100, a heat-shrinkable layer (generally designated by 152) can be wrapped around at least a portion of carton 100 and heat-shrunk to form a packaging assembly, one embodiment of which is shown in FIG. 3 and generally designated by 154. Specifically, in the embodiment shown in FIG. 3 heat-shrinkable layer 152 is wrapped around sides 102, 104, 106, 108, 110, and 112, a portion of which extends beyond top 114 and another portion of which extends beyond bottom 116. Layer 152 is then heated to shrink heat-shrinkable layer 152 into contact with carton 100. Layer 152 shrinks to fit snuggly around carton 100. Although heat-shrinkable layer 152 can overlap any portion of carton 100, in the embodiment shown in FIG. 3 heat-shrunk layer 152 substantially overlaps sides 102, 104, 106, 108, 110, and 112 and corners 130, 132, and 134, and overlaps a portion of top 114 and at least a portion of bottom 116. Although other types of heat-shrinkable layers may be used, in one embodiment heat-shrinkable layer 152 is a sheet of material or a sleeve of material. Additionally, although other materials may be used for layer 152, in one embodiment layer 152 includes polyethylene, polypropylene, and/or polyvinyl chloride.

The heat-shrunk layer 152 may facilitate sealing carton 100 to protect a product contained within carton 100 from tampering and to generally seal the corners/joints of carton 100 for containing the product within carton 100 as well as protecting the product from contamination. Heat-shrunk layer 152 can be used, for example, to replace bags or liners sometimes used within a container for sealing a product. The tight fit of heat-shrunk layer 152 may also facilitate maintaining a shape of carton 100 for example, to facilitate displaying, stacking and/or arranging carton 100 or a plurality thereof of cartons, and/or maintaining a shape that facilitates other functionality such as carrying carton 100.

In one embodiment, top 114 (and/or one or more sides 102, 104, 106, 108, 110, and 112) includes a handle 156 extending outwardly therefrom for carrying the assembly. Heat-shrunk layer 152 includes an opening 158 therein adjacent handle 156 such that handle 156 extends through opening 158 allowing access to handle 156 when heat-shrunk layer 152 overlaps a portion of carton 100.

In one embodiment, carton 100 and/or layer 152 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

Heat-shrinkable layer 152 may also facilitate forming of the carton, and more specifically moving moveable sections 136, 138, 140, 142, 144, and 146 from first position 148 to second position 150 to form packaging assembly 154. As described above, cartons having shapes that are more complex than conventional rectangular cartons may be difficult and therefore costly to manufacture.

However, in one embodiment heat-shrinkable layer 152 is wrapped around carton 100 such that heat-shrinkable layer 152 overlaps at least a portion of one or more of movable sections 136, 138, 140, 142, 144, and 146. As layer 152 is heated and shrinks into contact with movable sections 136, 138, 140, 142, 144, and 146, layer 152 moves movable sections 136, 138, 140, 142, 144, and 146 from first position 148 (shown in FIG. 2) to second position 150 to form a shape of packaging assembly 154. Heat-shrunk layer 152 then holds movable sections 136, 138, 140, 142, 144, and 146 in second position 150 as long as layer 152 remains substantially wrapped around carton 100. In one embodiment wherein movable sections 136, 138, 140, 142, 144, and 146 are biased to first position 148, layer 152 moves the movable sections to, and holds the movable section in, second position 150 against the bias. By moving and holding movable sections 136, 138, 140, 142, 144, and 146 into second position 150, layer 152 facilitates forming a shape of packaging assembly 154, and more specifically carton 100, that may be otherwise difficult and costly to form.

Figure 4:
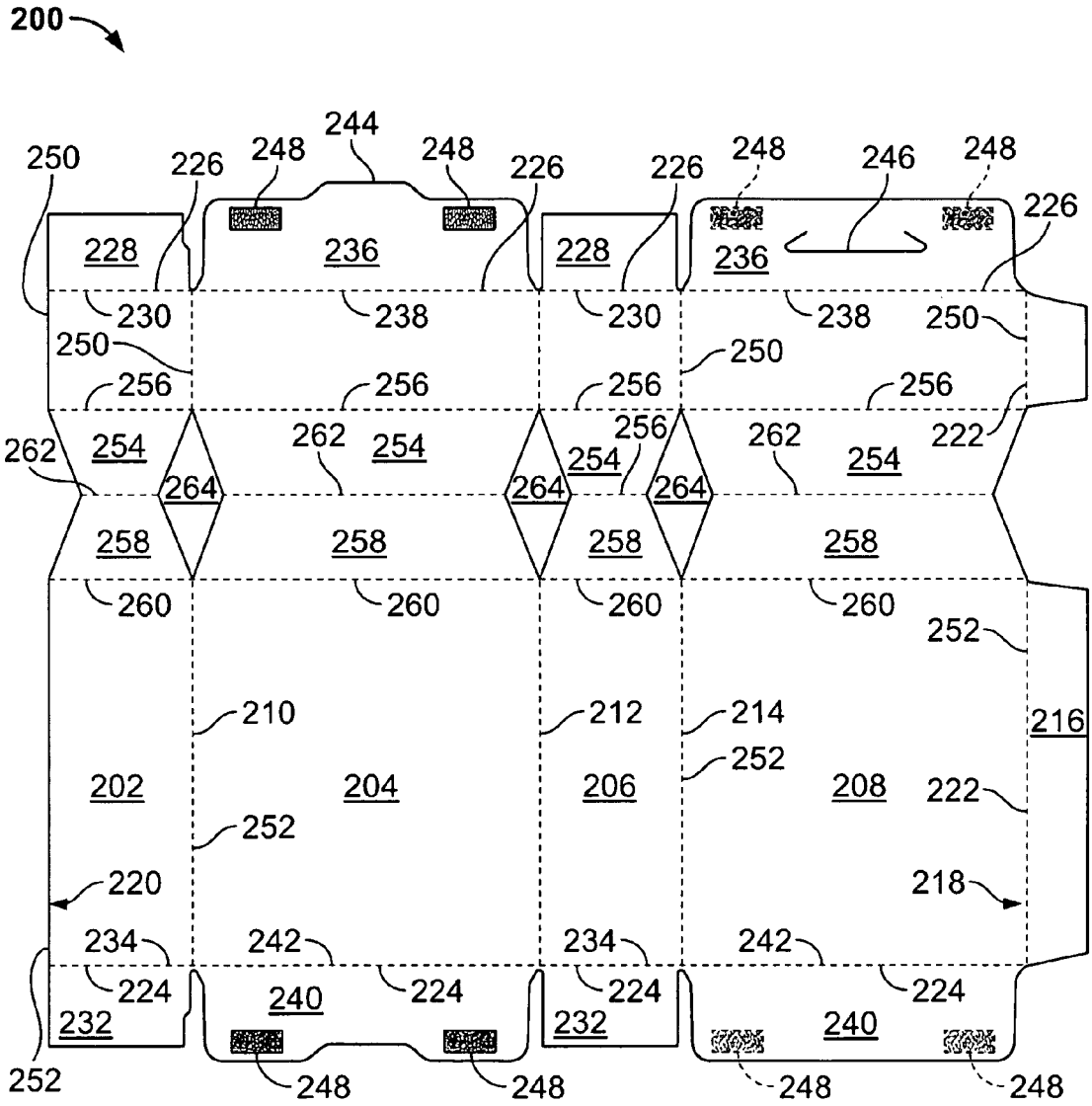
FIG. 4 is a top plan view of a blank of sheet material for forming a carton, according to one embodiment of this invention.
Figure 5:
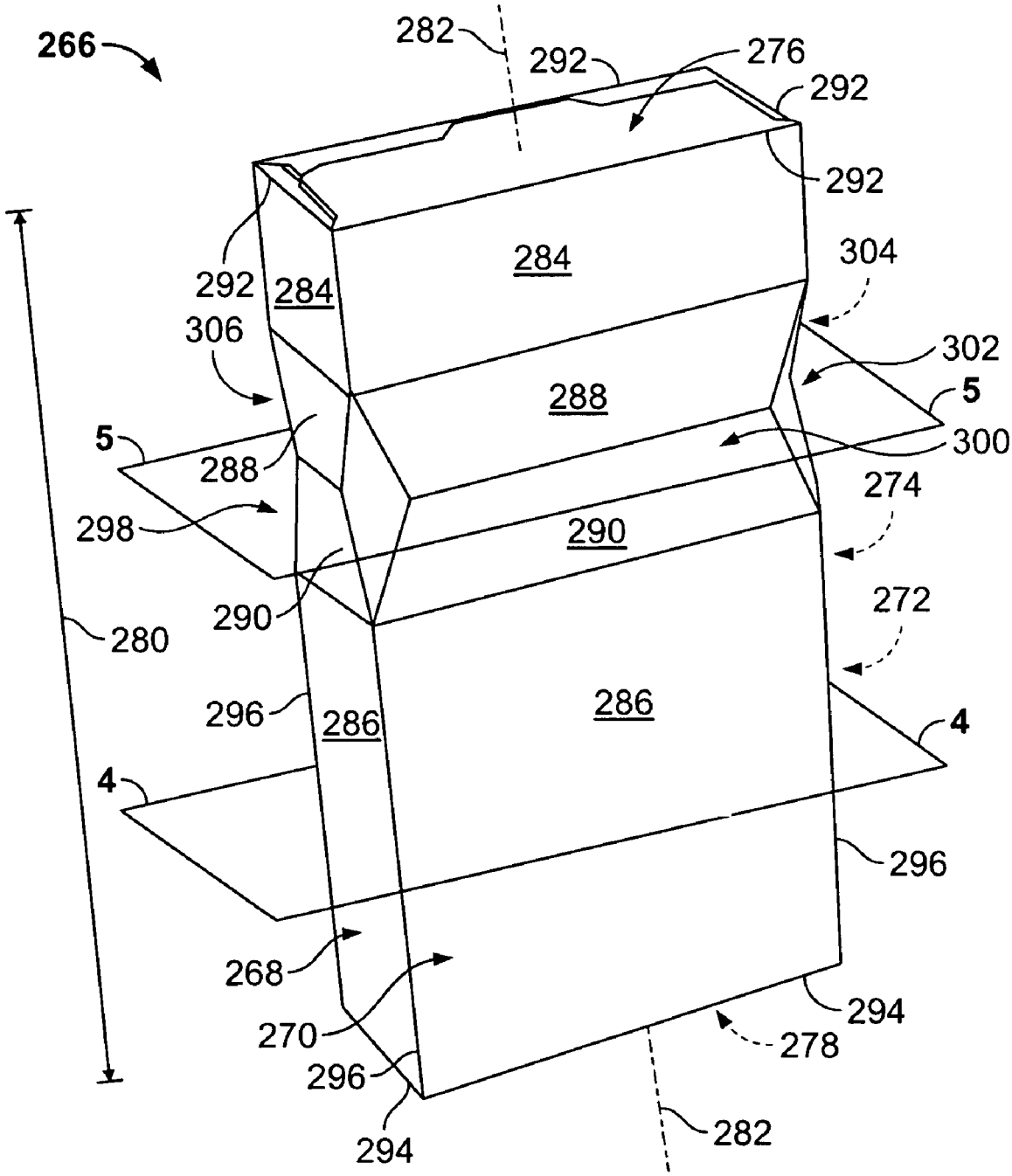
FIG. 5 is a perspective view of the carton formed from the blank shown in FIG. 4.
Figure 6:
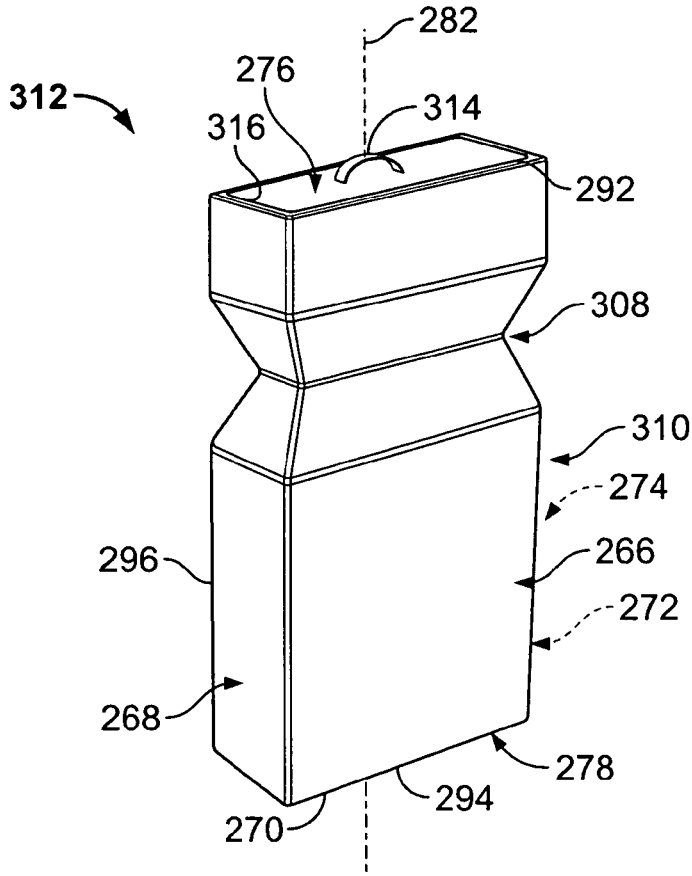
FIG. 6 is a perspective view of a packaging assembly including the carton shown in FIG. 5.
Figure 7:
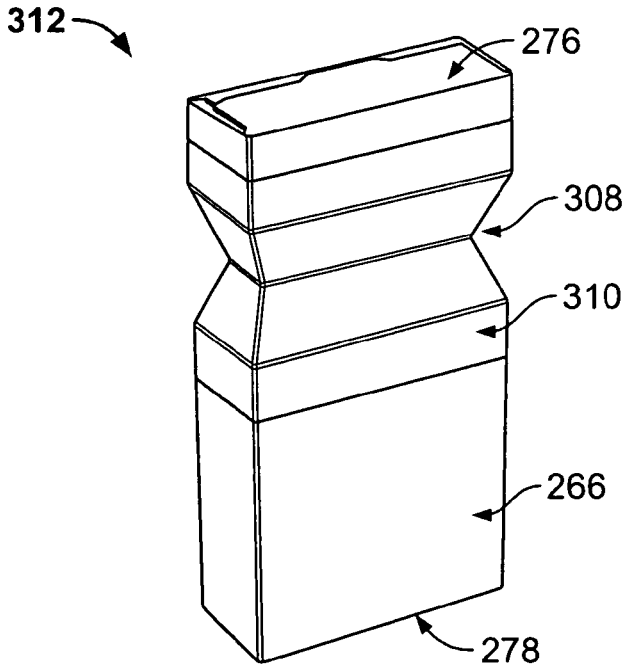
FIG. 7 is a perspective view of an alternative embodiment of the packaging assembly shown in FIG. 6.

Although as described above a packaging assembly may have any suitable size, shape, and/or configuration (e.g., number of sides), FIGS. 4-7 illustrate the formation of one embodiment of a packaging assembly. Specifically, FIG. 4 is a top plan view of one embodiment of a blank of sheet material (designated in its entirety by reference numeral 200). FIG. 5 is a perspective view of one embodiment of a carton (designated in its entirety by 266) formed from blank 200 shown in FIG. 4. FIG. 6 is a perspective view of one embodiment of a packaging assembly (designated in its entirety by 312) including carton 266 shown in FIG. 5. FIG. 7 is a perspective view of an alternative embodiment of packaging assembly 312 shown in FIG. 6.

Referring to FIG. 4, blank 200 includes a succession of four side panels 202, 204, 206, and 208 that are connected together by a plurality of preformed, generally parallel, fold lines 210, 212, and 214, respectively. Specifically, each side panel 202, 204, 206, and 208 extends from an adjacent side panel along respective fold lines 210, 212, and 214. A side panel flap 216 extends from an end portion (generally designated by 218) of side panel 208, or alternatively from an end portion (generally designated by 220) of side panel 202, along a fold line 222 for facilitating securing end portions 218 and 220 together to form carton 266 (shown in FIG. 5). Each side panel 202, 204, 206, and 208 extends a height measured between a bottom end 224 and a top end 226.

Side panel 202 and side panel 206 each include a top support panel 228 extending from top end 226 thereof along a fold line 230 and a bottom support panel 232 extending from bottom end 224 thereof along a fold line 234. Additionally, side panel 204 and side panel 208 each include a top panel 236 extending from top end 226 thereof along a fold line 238 and a bottom panel 240 extending from bottom end 224 thereof along a fold line 242. In one embodiment, at least one of top panels 236 includes an extension 244 extending therefrom for interconnection with a slot 246 within the other top panel 236 for facilitating securing top panels 236 together to form a top 276 (shown in FIG. 5) of carton 266 (shown in FIG. 5). Similarly, in one embodiment (not shown), at least one bottom panel 240 includes an extension extending therefrom for interconnection with a slot within the other bottom panel 240 for facilitating securing bottom panels 240 together to form a bottom 278 (shown in FIG. 5) of carton 266 (shown in FIG. 5). Of course, top panels 236 and bottom panels 240 may include any suitable interconnection means in addition to, or alternatively to, the extension/slot arrangement described above. Accordingly, top panels 236 and bottom panels 240 are not limited to interconnection using an extension/slot arrangement. For example, in one embodiment, adhesive is applied to portions of top panels 236 and/or bottom panels 240. In another embodiment, top panels 236 and/or bottom panels 240 interconnect using hook-and-loop fasteners 248.

Side panels 202, 204, 206, and 208 each include an upper panel portion 250 and a lower panel portion 252. Upper panel portions 250 each include an upper panel extension 254 extending therefrom along a fold line 256, and lower panel portions 252 each include a lower panel extension 258 extending therefrom along a fold line 260. Upper panel extensions 254 are each joined to a corresponding lower panel extension 258 along a central fold line 262. As can be seen in FIG. 4, an opening 264 is defined between adjacent pairs of joined upper and lower panel extensions 254 and 258 to accommodate changing a cross-sectional area of carton 266 as will be described below.

As shown in FIG. 5, a carton 266 can be formed from blank 200 (shown in FIG. 4) by folding blank 200 about fold lines 210, 212, 214, 222, 230, 234, 238, and 242 (shown in FIG. 4). In one embodiment, an adhesive may be applied to portions of blank 200 to secure carton 266 together. Generally, side panels 202, 204, 206, and 208 (shown in FIG. 4) form four successive sides (generally designated by 268, 270, 272, and 274) of carton 266, top panels 236 (shown in FIG. 4) form a top (generally designated by 276) of carton 266, and bottom panels 240 (shown in FIG. 4) form a bottom (generally designated by 278) of carton 266. Carton 266 extends a height 280 measured between top 276 and bottom 278 of carton 266 along a central longitudinal axis 282 extending through carton 266. As can be seen in FIG. 5, in one embodiment, carton 266 includes a generally rectangular cross-sectional shape, for example, a cross section taken along the plane 4-4 extending generally perpendicularly to central longitudinal axis 282. As can also be seen in FIG. 5, each side 268, 270, 272, and 274 extends between top 276 and bottom 278 of carton 266. More specifically, in one embodiment, each side 268, 270, 272, and 274 extends from top 276 to bottom 278. Any side 268, 270, 272, or 274 may be referred to herein as a first, a second, a third, and/or a fourth side.

Upper panel portions 250 and lower panel portions 252 (shown in FIG. 4) form upper portions 284 and lower portions 286, respectively, of each side 268, 270, 272, and 274. Upper panel extensions 254 and lower panel extensions 258 form upper extensions 288 and lower extensions 290, respectively, of each side 268, 270, 272, and 274. A corner 292 is defined at an intersection between top 276 and each side 268, 270, 272, and 274. Similarly, a corner 294 is defined at an intersection between bottom 278 and each side 268, 270, 272, and 274. Moreover, a comer 296 is defined at an intersection between each adjacent side of sides 268, 270, 272, and 274.

Upper and lower extensions 288 and 290 each form a movable section (generally designated by 298, 300, 302, and 304) of carton 266. As can be seen in FIG. 5, in one embodiment, each movable section 298, 300, 302, and 304 are located along central longitudinal axis 282 at a generally equal distance from top 276. More specifically, each central fold line 262 (shown in FIG. 4) is located along central longitudinal axis 282 at a generally equal distance from top 276. Any movable section 298, 300, 302, or 304 may be referred to herein as a first, a second, a third, and/or a fourth movable section.

Movable sections 298, 300, 302, and 304 are each movable between a first position shown in FIG. 5 (and generally designated by 306) and a second position shown in FIG. 6 (and generally designated by 308). In one embodiment, movable sections 298, 300, 302, and 304 are movable from first position 306 to second position 308 by bending upper and lower extensions 288 and 290, respectively, along fold lines 256, fold lines 260, and central fold lines 262 to generally radially move central fold lines 262 with respect to central longitudinal axis 282 of carton 266. Accordingly, and as can be seen in FIGS. 5 and 6, movement between first and second positions 306 and 308, respectively, varies, or changes, a cross-sectional width of carton 266 defined between two opposite sides of sides 268, 270, 272, and 274 along the height of carton 266. In one embodiment, a cross-sectional width defined between two opposite sides of sides 268, 270, 272, and 274 and taken through movable sections 298, 300, 302, and 304 (e.g., a cross section taken along plane 5-5 in FIG. 5) is generally greater in first position 306 than in second position 308. More specifically, as can be seen in FIGS. 5 and 6, each central fold line 262 is spaced a greater radial distance from central longitudinal axis 282 in first position 306 than in second position 308. In one embodiment, at least one of movable sections 298, 300, 302, and 304 is biased in first position 306. Although movable sections 298, 300, 302, and 304 may be biased in first position 306 using any suitable mechanism, in one embodiment, a structure of carton 266 biases movable sections 298, 300, 302, and 304.

Once carton 266 has been formed, and either before, simultaneously with, or after a product is placed within carton 266, a heat-shrinkable layer (generally designated by 310) can be wrapped around at least a portion of carton 266 and heat-shrunk to form a packaging assembly, one embodiment of which is shown in FIG. 6 and generally designated by 312. Specifically, in the embodiment shown in FIG. 6 heat-shrinkable layer 310 is wrapped around sides 268, 270, 272, and 274, a portion of which extends beyond top 276 and another portion of which extends beyond bottom 278. Layer 310 is then heated to shrink heat-shrinkable layer 310 into contact with carton 266. Layer 310 shrinks to fit snuggly around carton 266. Although heat-shrinkable layer 310 can overlap any portion of carton 266, in the embodiment shown in FIG. 6 heat-shrunk layer 310 substantially overlaps sides 268, 270, 272, and 274 and corners 292, 294, and 296, and overlaps a portion of top 276 and at least a portion of bottom 278. FIG. 7 illustrates an alternative embodiment of packaging assembly 312 wherein layer 310 does not overlap any portion of top 276 or bottom 278 of carton 266. Although other types of heat-shrinkable layers may be used, in one embodiment heat-shrinkable layer 310 is a sheet of material or a sleeve of material. Additionally, although other materials may be used for layer 310, in one embodiment layer 310 includes polyethylene, polypropylene, and/or polyvinyl chloride.

Heat-shrunk layer 310 may facilitate sealing carton 266 to protect a product contained within carton 266 from tampering and to generally seal the corners/joints of carton 266 for containing the product within carton 266 as well as protecting the product from contamination. Heat-shrunk layer 310 can be used, for example, to replace bags or liners sometimes used within a container for sealing a product. The tight fit of heat-shrunk layer 310 may also facilitate maintaining a shape of carton 266 for example, to facilitate displaying, stacking and/or arranging carton 266 or a plurality thereof of cartons, and/or maintaining a shape that facilitates other functionality such as carrying the carton 266.

In one embodiment, top 276 (and/or one or more of sides 268, 270, 272, and 274) includes a handle 314 extending outwardly therefrom for carrying the assembly. Heat-shrunk layer 310 includes an opening 316 therein adjacent handle 314 such that handle 314 extends through opening 316 allowing access to handle 314 when heat-shrunk layer 310 overlaps a portion of carton 266.

In one embodiment, carton 266 and/or layer 310 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

Heat-shrinkable layer 310 may also facilitate forming of the carton, and more specifically moving moveable sections 298, 300, 302, and 304 from first position 306 to second position 308 to form packaging assembly 312. As described above, cartons having shapes that are more complex than conventional rectangular cartons may be difficult and therefore costly to manufacture.

However, in one embodiment heat-shrinkable layer 310 is wrapped around carton 266 such that heat-shrinkable layer 310 overlaps at least a portion of one or more of movable sections 298, 300, 302, and 304. As layer 310 is heated and shrinks into contact with movable sections 298, 300, 302, and 304, layer moves movable sections 298, 300, 302, and 304 from first position 306 (shown in FIG. 5) to second position 308 to form a shape of packaging assembly 312. Heat-shrunk layer 310 then holds movable sections 298, 300, 302, and 304 in second position 308 as long as layer 310 remains substantially wrapped around carton 266. In one embodiment wherein movable sections 298, 300, 302, and 304 are biased to the first position, layer 310 moves the movable sections to, and holds the movable section in, second position 308 against the bias. By moving and holding movable sections 298, 300, 302, and 304 into second position 308, layer 310 facilitates forming a shape of packaging assembly 312, and more specifically carton 266, that may be otherwise difficult and costly to form.

Figure 8:
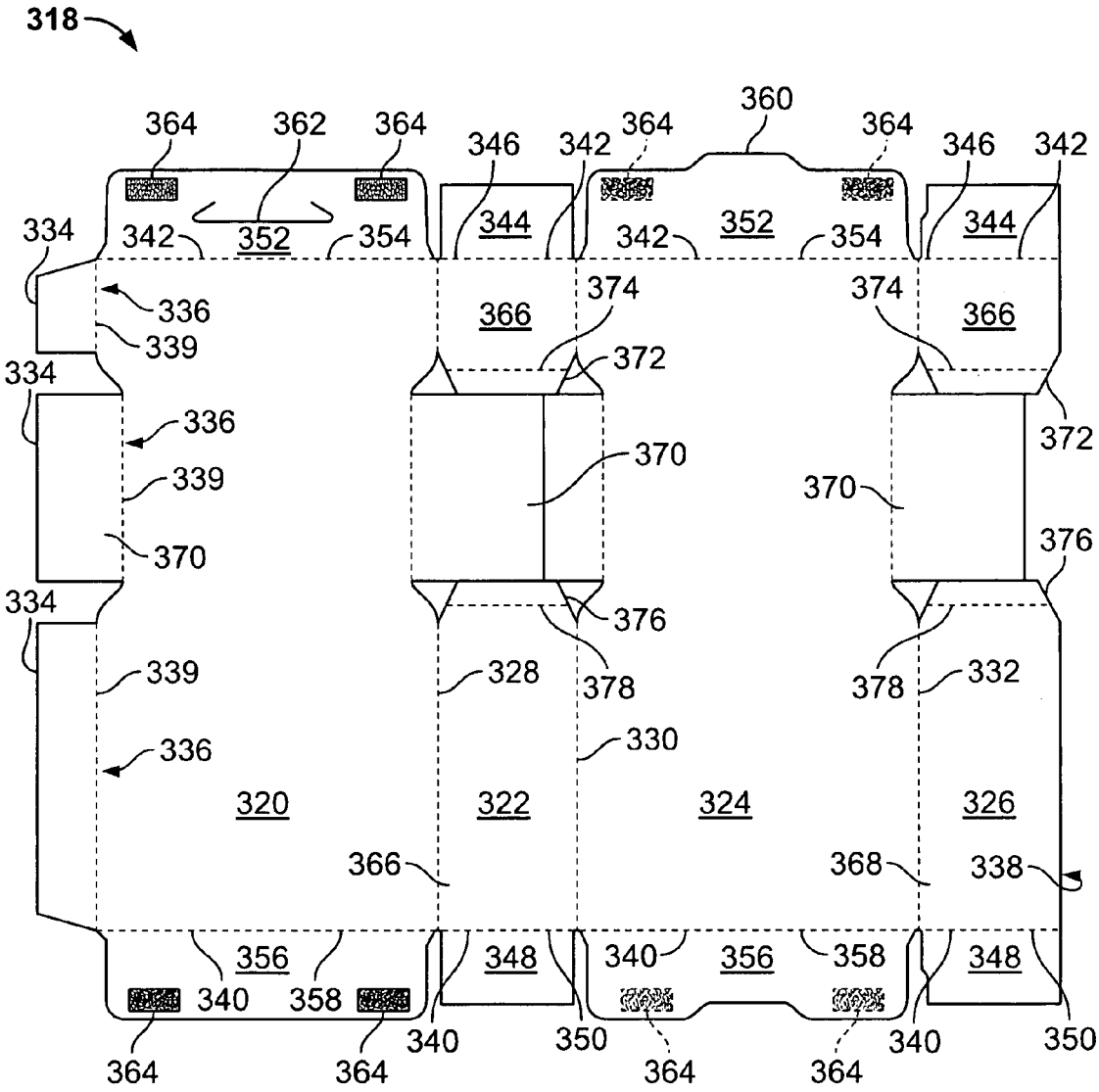
FIG. 8 is a top plan view of a blank of sheet material for forming a carton, according to one embodiment of this invention.
Figure 9:
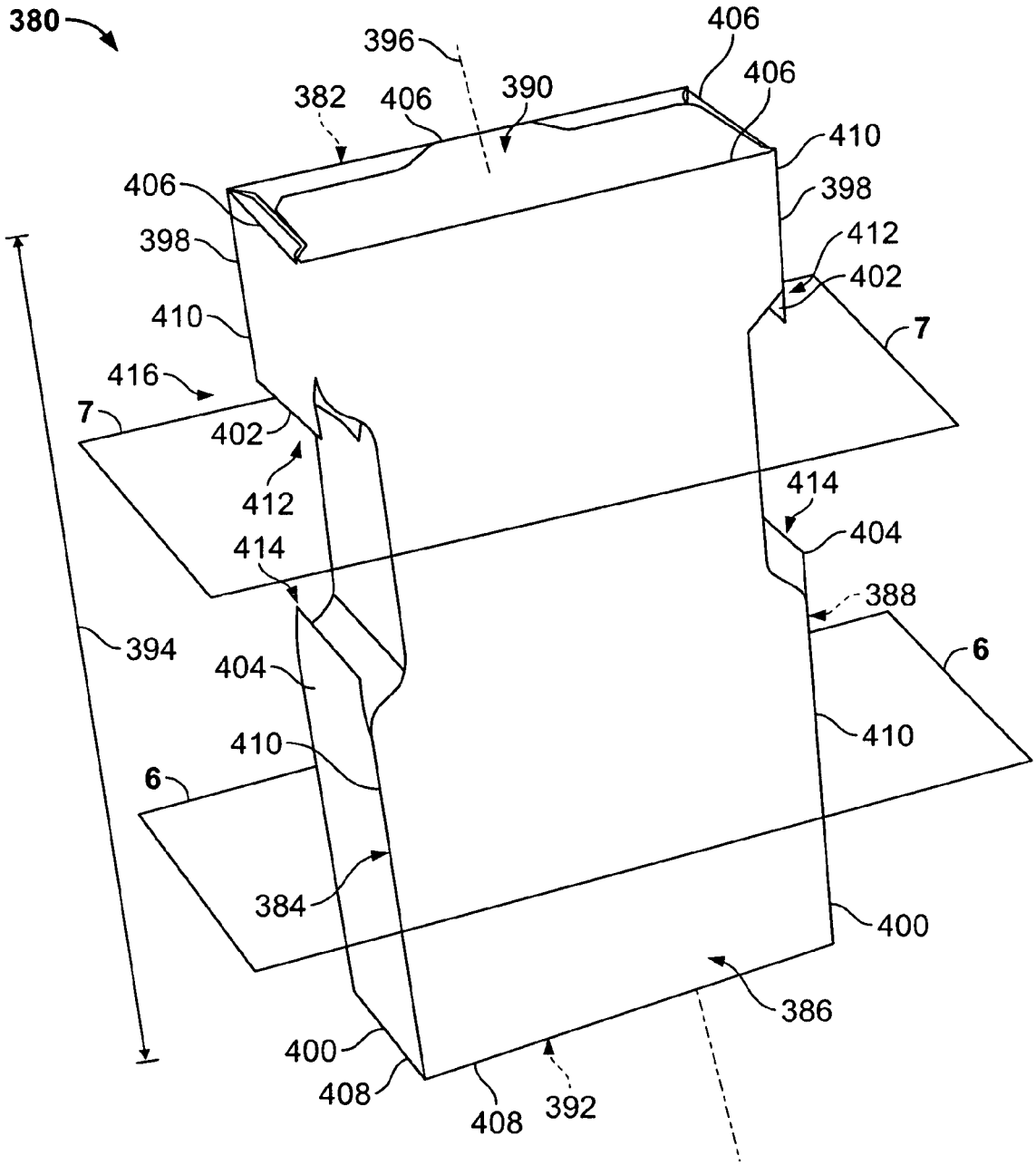
FIG. 9 is a perspective view of the carton formed from the blank shown in FIG. 8.
Figure 10:
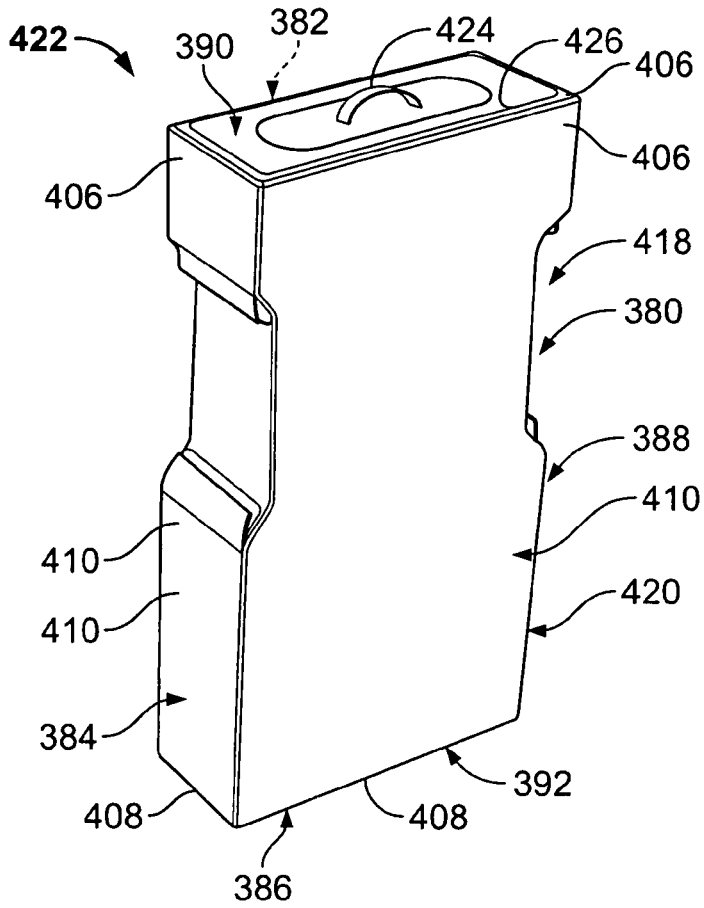
FIG. 10 is a perspective view of a packaging assembly including the carton shown in FIG. 9.
Figure 11:
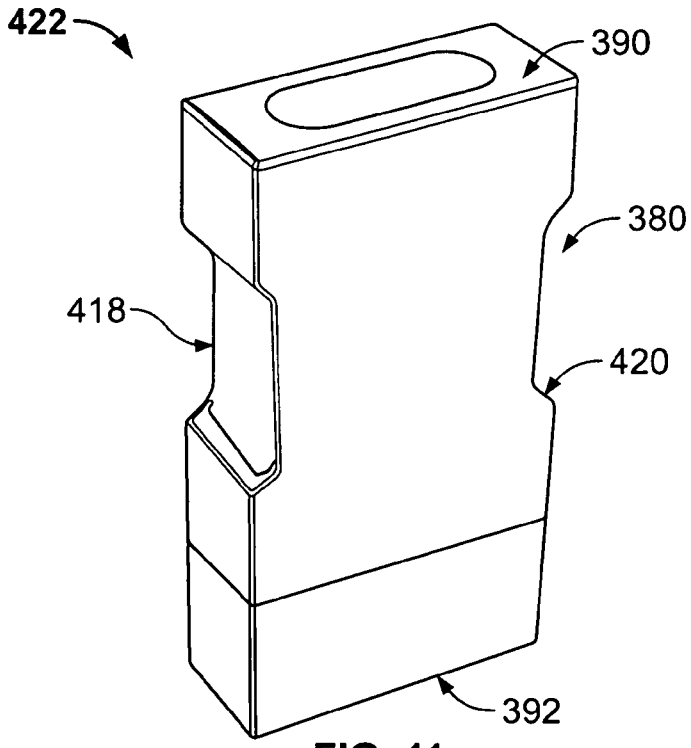
FIG. 11 is a perspective view of an alternative embodiment of the packaging assembly shown in FIG. 10.

Although as described above a packaging assembly may have any suitable size, shape, and/or configuration (e.g., number of sides), FIGS. 8-11 illustrate the formation of one embodiment of a packaging assembly. Specifically, FIG. 8 is a top plan view of one embodiment of a blank of sheet material (designated in its entirety by reference numeral 318). FIG. 9 is a perspective view of one embodiment of a carton (designated in its entirety by 380) formed from blank 318 shown in FIG. 8. FIG. 10 is a perspective view of one embodiment of a packaging assembly (designated in its entirety by 422) including carton 380 shown in FIG. 9. FIG. 11 is a perspective view of an alternative embodiment of packaging assembly 422 shown in FIG. 10.

Referring to FIG. 8, blank 318 includes a succession of four side panels 320, 322, 324, and 326 that are connected together by a plurality of preformed, generally parallel, fold lines 328, 330, and 332, respectively. Specifically, each side panel 320, 322, 324, and 326 extends from an adjacent one of the side panels along respective fold lines 328, 330, and 332. A side panel flap 334 extends from an end portion (generally designated by 336) of side panel 320, or alternatively from an end portion (generally designated by 338) of side panel 326, along a fold line 339 for facilitating securing end portions 336 and 338 together to form carton 380 (shown in FIG. 9). Each side panel 320, 322, 324, and 326 extends a height measured between a bottom end 340 and a top end 342.

Side panel 322 and side panel 326 each include a top support panel 344 extending from top end 342 thereof along a fold line 346 and a bottom support panel 348 extending from bottom end 340 thereof along a fold line 350. Additionally, side panel 320 and side panel 324 each include a top panel 352 extending from top end 342 thereof along a fold line 354 and a bottom panel 356 extending from bottom end 340 thereof along a fold line 358. In one embodiment, at least one of top panels 352 includes an extension 360 extending therefrom for interconnection with a slot 362 within other top panel 352 for facilitating securing top panels 352 together to form a top 390 (shown in FIG. 9) of carton 380 (shown in FIG. 9). Similarly, in one embodiment (not shown), at least one of bottom panels 356 includes an extension extending therefrom for interconnection with a slot within the other bottom panel 356 for facilitating securing bottom panels 356 together to form a bottom 392 (shown in FIG. 9) of carton 380 (shown in FIG. 9). Of course, top panels 352 and bottom panels 356 may include any suitable interconnection means in addition to, or alternatively to, the extension/slot arrangement described above. Accordingly, top and bottom panels 352 and 356, respectively, are not limited to interconnection using an extension/slot arrangement. For example, in one embodiment, adhesive is applied to portions of top and bottom panels 352 and 356, respectively. In another embodiment, at least one of top panels 352 and bottom panels 356 interconnect using hook-and-loop fasteners 364.

Side panels 322 and 326 each include an upper panel portion 366, a lower panel portion 368, and an intermediate panel portion 370. Upper panel portions 366 each include an upper panel extension 372 extending therefrom along a fold line 374, and lower panel portions 368 each include a lower panel extension 376 extending therefrom along a fold line 378.

As shown in FIG. 9, a carton 380 can be formed from blank 318 (shown in FIG. 8) by folding blank 318 about fold lines 328, 330, 332, 339 350, 346, 350, 354, and 358 (shown in FIG. 8). In one embodiment, an adhesive may be applied to portions of blank 318 to secure carton 380 together. Generally, side panels 320, 322, 324, and 326 (shown in FIG. 8) form four successive sides (generally designated by 382, 384, 386, and 388) of carton 380, top panels 352 (shown in FIG. 8) form a top (generally designated by 390) of carton 380, and bottom panels 356 (shown in FIG. 8) form a bottom (generally designated by 392) of carton 380. Carton 380 extends a height 394 measured between top 390 and bottom 392 of carton 380 along a central longitudinal axis 396 extending through carton 380. As can be seen in FIG. 9, in one embodiment, carton 380 includes a generally rectangular cross-sectional shape, for example, a cross section taken along the plane 6-6 extending generally perpendicularly to central longitudinal axis 396. As can also be seen in FIG. 9, each side 382, 384, 386, and 388 extends between top 390 and bottom 392 of carton 380. More specifically, in one embodiment, each side 382, 384, 386, and 388 extends from top 390 to bottom 392. Any side 382, 384, 386, or 388 may be referred to herein as a first, a second, a third, and/or a fourth side.

Upper panel portions 366 and lower panel portions 368 (shown in FIG. 8) form upper portions 398 and lower portions 400, respectively, of each side 388 and 384. Upper panel extensions 372 and lower panel extensions 376 form upper extensions 402 and lower extensions 404, respectively, of each side 388 and 384. A corner 406 is defined at an intersection between top 390 and each side 382, 384, 386, and 388. Similarly, a corner 408 is defined at an intersection between bottom 392 and each side 382, 384, 386, and 388. Moreover, a corner 410 is defined at an intersection between each adjacent side of sides 382, 384, 386, and 388.

Upper and lower extensions 402 and 404 each form a movable section (generally designated by 412 and 414) of carton 380. Any movable section 412 or 414 may be referred to herein as a first, a second, a third, and/or a fourth movable section. Movable sections 412 and 414 are each movable between a first position shown in FIG. 9 (and generally designated by 416) and a second position shown in FIG. 10 (and generally designated by 418). In one embodiment, movable sections 412 and 414 are movable from first position 416 to second position 418 by bending upper and lower extensions 402 and 404, respectively, along fold lines 374 and fold lines 378 generally toward central longitudinal axis 396 of carton 380 and such that extensions 402 and 404 are obliquely angled with respect to corresponding side 384, 388. Accordingly, and as can be seen in FIGS. 9 and 10, movement between first and second positions 416 and 418, respectively, varies, or changes, a cross-sectional width of carton 380 defined between two opposite sides of sides 384 and 388 along the height of carton 380. In one embodiment, a cross-sectional width defined between two opposite sides 384 and 388 and generally adjacent movable sections 412 and 414 (e.g., a cross section taken along plane 7-7 in FIG. 9) is generally greater in first position 416 than in second position 418. In one embodiment, at least one of movable sections 412 and 414 is biased in first position 416. Although movable sections 412 and 414 may be biased in first position 416 using any suitable mechanism, in one embodiment, a structure of carton 380 biases movable sections 412 and 414.

Once carton 380 has been formed, and either before, simultaneously with, or after a product is placed within carton 380, a heat-shrinkable layer (generally designated by 420) can be wrapped around at least a portion of carton 380 and heat-shrunk to form a packaging assembly, one embodiment of which is shown in FIG. 10 and generally designated by 422. Specifically, in the embodiment shown in FIG. 10 heat-shrinkable layer 420 is wrapped around sides 382, 384, 386, and 388, a portion of which extends beyond top 390 and another portion of which extends beyond bottom 392. Layer 420 is then heated to shrink the heat-shrinkable layer into contact with carton 380. Layer 420 shrinks to fit snuggly around carton 380. Although heat-shrinkable layer 420 can overlap any portion of carton 380, in the embodiment shown in FIG. 10 heat-shrunk layer 420 substantially overlaps sides 382, 384, 386, and 388 and corners 406, 408, and 410, and overlaps a portion of top 390 and at least a portion of bottom 392. FIG. 11 illustrates an alternative embodiment of packaging assembly 422 wherein layer 420 does not overlap any portion of top 390 or bottom 392 of carton 380. Although other types of heat-shrinkable layers may be used, in one embodiment heat-shrinkable layer 420 is a sheet of material or a sleeve of material. Additionally, although other materials may be used for layer 420, in one embodiment layer 420 includes polyethylene, polypropylene, and/or polyvinyl chloride.

Heat-shrunk layer 420 may facilitate sealing carton 380 to protect a product contained within the carton from tampering and to generally seal the comers/joints of carton 380 for containing the product within carton 380 as well as protecting the product from contamination. Heat-shrunk layer 420 can be used, for example, to replace bags or liners sometimes used within a container for sealing a product. The tight fit of heat-shrunk layer 420 may also facilitate maintaining a shape of carton 380 for example, to facilitate displaying, stacking and/or arranging carton 380 or a plurality thereof of cartons, and/or maintaining a shape that facilitates other functionality such as carrying the carton.

In one embodiment, top 390 (and/or one or more of sides 382, 384, 386, and 388) includes a handle 424 extending outwardly therefrom for carrying assembly. Heat-shrunk layer 420 includes an opening 426 therein adjacent handle 424 such that handle 424 extends through opening 426 allowing access to handle 424 when heat-shrunk layer 420 overlaps a portion of carton 380.

In one embodiment, carton 380 and/or layer 420 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

Heat-shrinkable layer 420 may also facilitate forming of the carton, and more specifically moving moveable sections 412 and 414 from first position 416 to second position 418 to form packaging assembly 422. As described above, cartons having shapes that are more complex than conventional rectangular cartons may be difficult and therefore costly to manufacture.

However, in one embodiment heat-shrinkable layer 420 is wrapped around carton 380 such that heat-shrinkable layer 420 overlaps at least a portion of one or more of movable sections 412 and 414. As layer 420 is heated and shrinks into contact with movable sections 412 and 414, layer moves movable sections 412 and 414 from first position 416 (shown in FIG. 9) to second position 418 to form a shape of packaging assembly 422. Heat-shrunk layer 420 then holds movable sections 412 and 414 in second position 418 as long as layer 420 remains substantially wrapped around carton 380. In one embodiment wherein movable sections 412 and 414 are biased to the first position, layer 420 moves the movable sections to, and holds the movable section in, second position 418 against the bias. By moving and holding movable sections 412 and 414 into second position 418, layer 420 facilitates forming a shape of packaging assembly 422, and more specifically carton 380, that may be otherwise difficult and costly to form.

Figure 12:
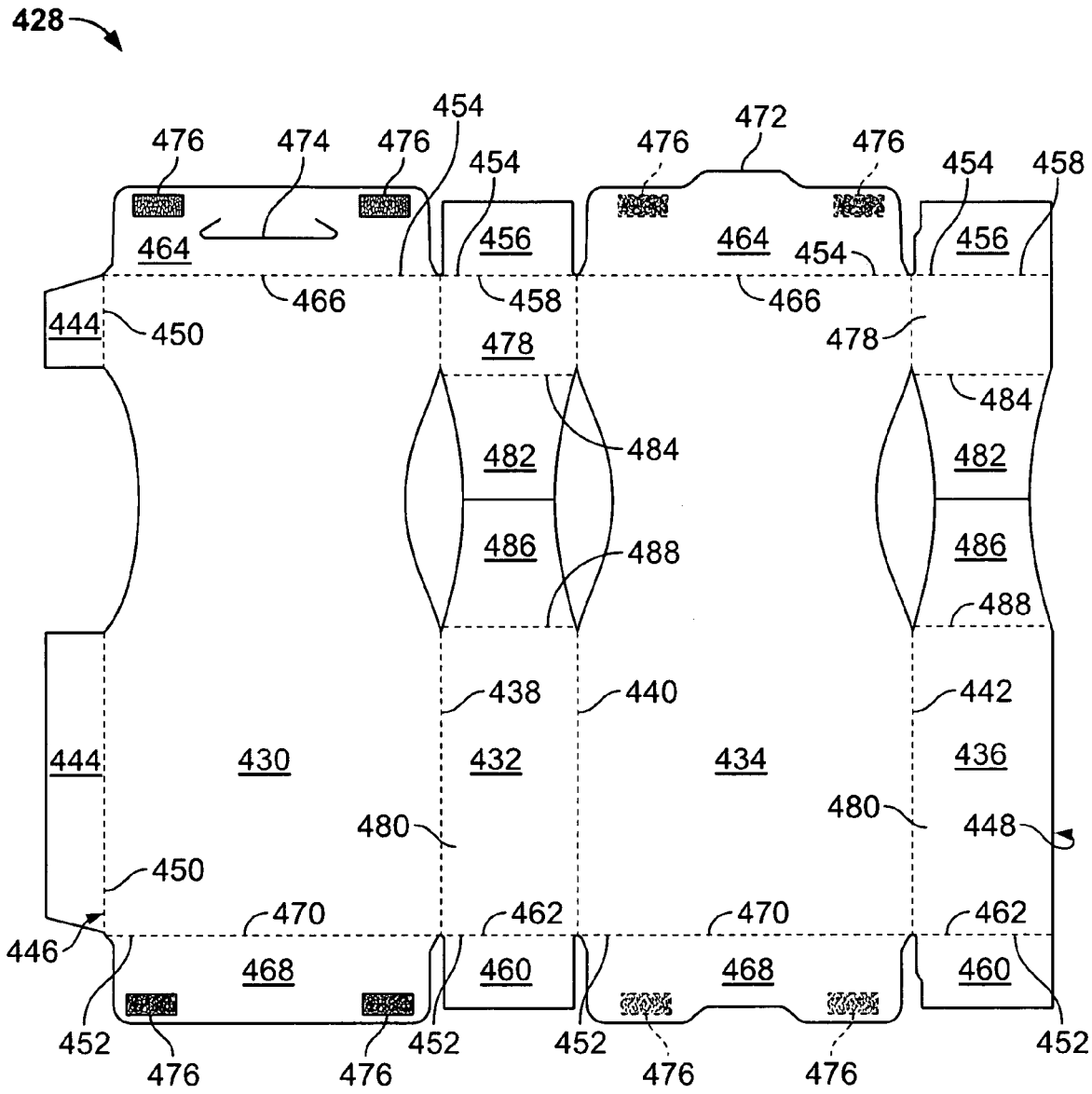
FIG. 12 is a top plan view of a blank of sheet material for forming a carton, according to one embodiment of this invention.
Figure 13:
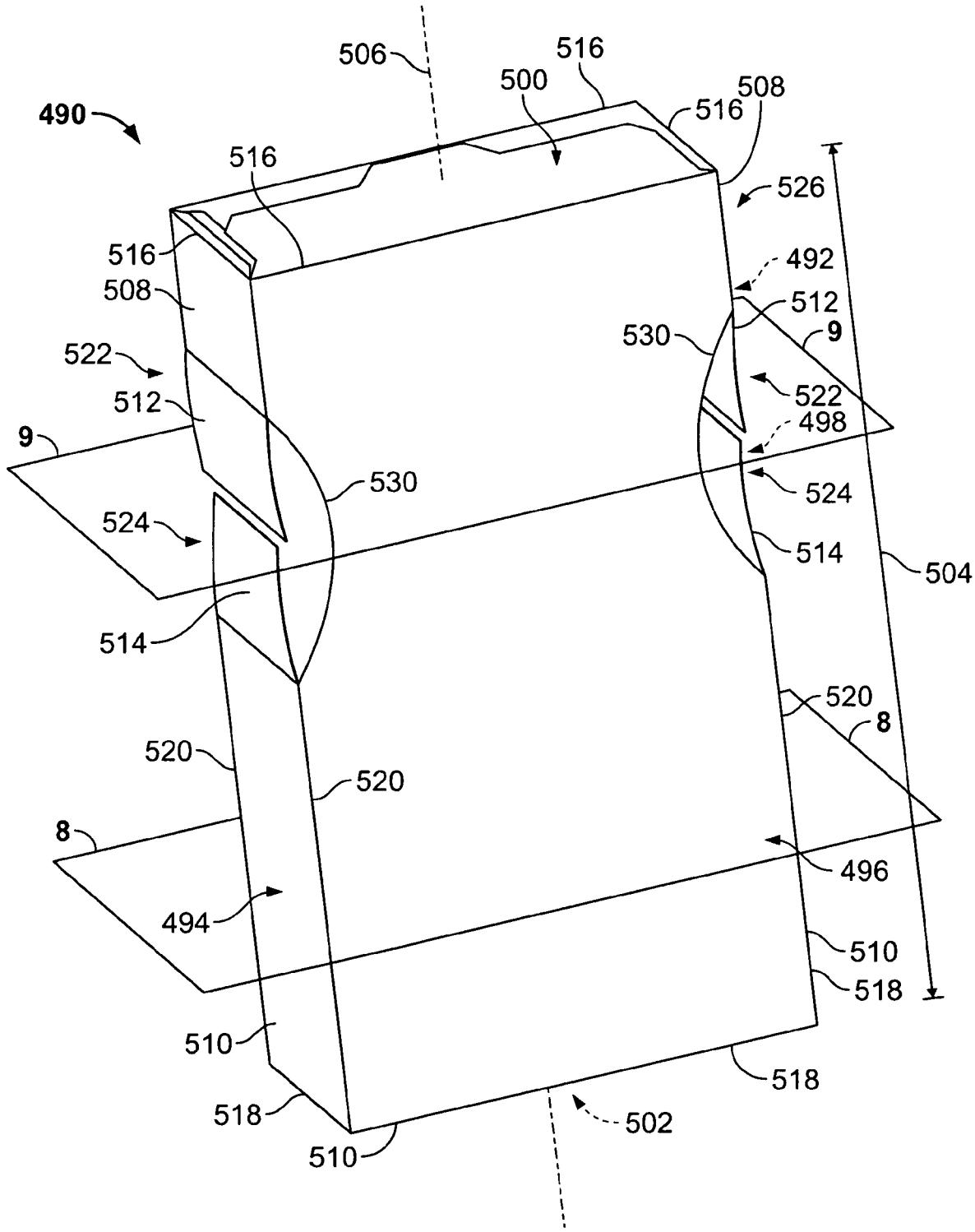
FIG. 13 is a perspective view of the carton formed from the blank shown in FIG. 12.
Figure 14:
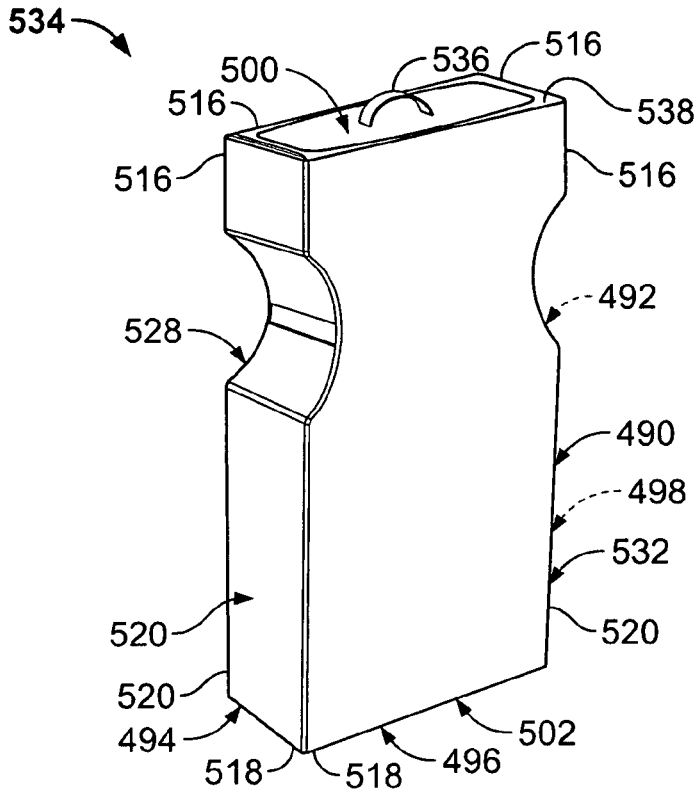
FIG. 14 is a perspective view of a packaging assembly including the carton shown in FIG. 13.
Figure 15:
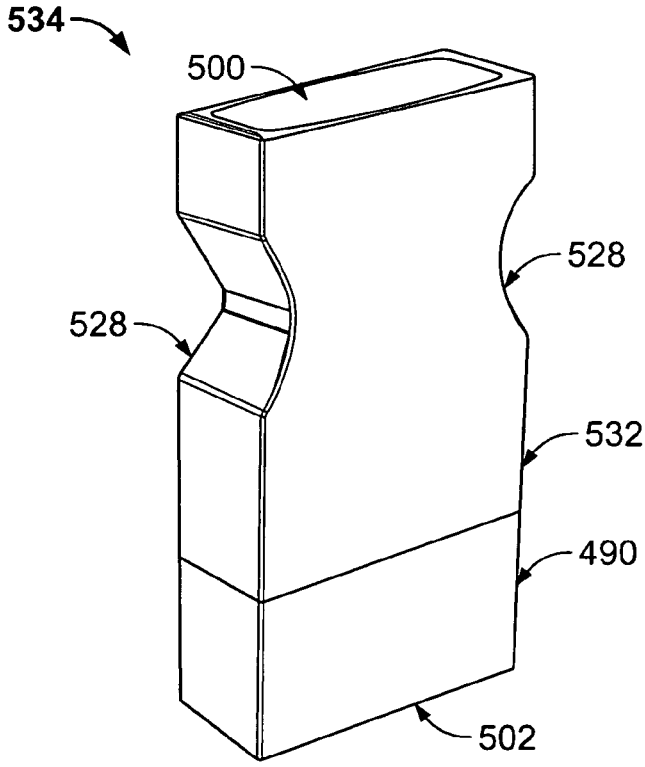
FIG. 15 is a perspective view of an alternative embodiment of the packaging assembly shown in FIG. 14.

Although as described above a packaging assembly may have any suitable size, shape, and/or configuration (e.g., number of sides), FIGS. 12-15 illustrate the formation of one embodiment of a packaging assembly. Specifically, FIG. 12 is a top plan view of one embodiment of a blank of sheet material (designated in its entirety by reference numeral 428). FIG. 13 is a perspective view of one embodiment of a carton (designated in its entirety by 490) formed from blank 428 shown in FIG. 12. FIG. 14 is a perspective view of one embodiment of a packaging assembly (designated in its entirety by 534) including carton 490 shown in FIG. 13. FIG. 15 is a perspective view of an alternative embodiment of packaging assembly 534 shown in FIG. 14.

Referring to FIG. 12, blank 428 includes a succession of four side panels 430, 432, 434, and 436 that are connected together by a plurality of preformed, generally parallel, fold lines 438, 440, and 442, respectively. Specifically, each side panel 430, 432, 434, and 436 extends from an adjacent one of side panels along respective fold lines 438, 440, and 442. A side panel flap 444 extends from an end portion (generally designated by 446) of side panel 430, or alternatively from an end portion (generally designated by 448) of side panel 436, along a fold line 450 for facilitating securing end portions 446 and 448 together to form carton 490 (shown in FIG. 13). Each side panel 430, 432, 434, and 436 extends a height measured between a bottom end 452 and a top end 454.

Side panel 432 and side panel 436 each include a top support panel 456 extending from top end 454 thereof along a fold line 458 and a bottom support panel 460 extending from bottom end 452 thereof along a fold line 462. Additionally, side panel 430 and side panel 434 each include a top panel 464 extending from top end 454 thereof along a fold line 466 and a bottom panel 468 extending from bottom end 452 thereof along a fold line 470. In one embodiment, at least one of top panels 464 includes an extension 472 extending therefrom for interconnection with a slot 474 within the other top panel 464 for facilitating securing top panels 464 together to form a top 500 (shown in FIG. 13) of carton 490 (shown in FIG. 13). Similarly, in one embodiment (not shown), at least one of bottom panels 468 includes an extension extending therefrom for interconnection with a slot within the other bottom panel 468 for facilitating securing bottom panels 468 together to form a bottom 502 (shown in FIG. 13) of carton 490 (shown in FIG. 13). Of course, top panels 464 and bottom panels 468 may include any suitable interconnection means in addition to, or alternatively to, extension/slot arrangement described above. Accordingly, top and bottom panels 464 and 468, respectively, are not limited to interconnection using an extension/slot arrangement. For example, in one embodiment, adhesive is applied to portions of top and bottom panels 464 and 468, respectively. In another embodiment, at least one of top panels 464 and bottom panels 468 interconnect using hook-and-loop fasteners 476.

Side panels 432 and 436 each include an upper panel portion 478 and a lower panel portion 480. Upper panel portions 478 each include an upper panel extension 482 extending therefrom along a fold line 484, and lower panel portions 480 each include a lower panel extension 486 extending therefrom along a fold line 488.

As shown in FIG. 13, a carton 490 can be formed from blank 428 (shown in FIG. 12) by folding blank 428 about fold lines 438, 440, 442, 462, 458, 462, 466, and 470 (shown in FIG. 12). In one embodiment, an adhesive may be applied to portions of blank 428 to secure carton 490 together. Generally, side panels 430, 432, 434, and 436 (shown in FIG. 12) form four successive sides (generally designated by 492, 494, 496, and 498) of carton 490, top panels 464 (shown in FIG. 12) form a top (generally designated by 500) of carton 490, and bottom panels 468 (shown in FIG. 12) form a bottom (generally designated by 502) of carton 490. Carton 490 extends a height 504 measured between top 500 and bottom 502 of carton 490 along a central longitudinal axis 506 extending through carton 490. As can be seen in FIG. 13, in one embodiment, carton 490 includes a generally rectangular cross-sectional shape, for example, a cross section taken along the plane 8-8 extending generally perpendicularly to central longitudinal axis 506. As can also be seen in FIG. 13, each side 492, 494, 496, and 498 extends between top 500 and bottom 502 of carton 490. More specifically, in one embodiment, each side 492, 494, 496, and 498 extends from top 500 to bottom 502. Any side 492, 494, 496, or 498 may be referred to herein as a first, a second, a third, and/or a fourth side.

Upper panel portions 478 and lower panel portions 480 (shown in FIG. 12) form upper portions 508 and lower portions 510, respectively, of each side 498 and 494. Upper panel extensions 482 and lower panel extensions 486 form upper extensions 512 and lower extensions 514, respectively, of each side 498 and 494. A corner 516 is defined at an intersection between top 500 and each side 492, 494, 496, and 498. Similarly, a corner 518 is defined at an intersection between bottom 502 and each side 492, 494, 496, and 498. Moreover, a corner 520 is defined at an intersection between each adjacent side of sides 492, 494, 496, and 498.

Upper and lower extensions 512 and 514 each form a movable section (generally designated by 522 and 524) of carton 490. Any movable section 522 or 524 may be referred to herein as a first, a second, a third, and/or a fourth movable section. Movable sections 522 and 524 are each movable between a first position shown in FIG. 13 (and generally designated by 526) and a second position shown in FIG. 14 (and generally designated by 528). In one embodiment, movable sections 522 and 524 are movable from first position 526 to second position 528 by bending upper and lower extensions 512 and 514, respectively, along fold lines 484 and fold lines 488 generally toward central longitudinal axis 506 of carton 490 such that extensions 512 and 514 are obliquely angled with respect to corresponding side 494, 498. Accordingly, and as can be seen in FIGS. 13 and 14, movement between first and second positions 526 and 528, respectively, varies, or changes, a cross-sectional width of carton 490 defined between two opposite sides of sides 494 and 498 along the height of carton 490. In one embodiment, opposite sides 494 and 498 each include a curved edge 530 to accommodate the changing cross-sectional width. Curved edge 530 extends only a portion of height 504 of carton 490, although alternatively it may extend from top 500 to bottom 502. In one embodiment, a cross-sectional width defined between two opposite sides 494 and 498 and generally adjacent movable sections 522 and 524 (e.g., a cross section taken along plane 9-9 in FIG. 13) is generally greater in first position 526 than in second position 528. In one embodiment, at least one of movable sections 522 and 524 is biased in first position 526. Although movable sections 522 and 524 may be biased in first position 526 using any suitable mechanism, in one embodiment, a structure of carton 490 biases movable sections 522 and 524.

Once carton 490 has been formed, and either before, simultaneously with, or after a product is placed within carton 490, a heat-shrinkable layer (generally designated by 532) can be wrapped around at least a portion of carton 490 and heat-shrunk to form a packaging assembly, one embodiment of which is shown in FIG. 14 and generally designated by 534. Specifically, in the embodiment shown in FIG. 14 heat-shrinkable layer 532 is wrapped around sides 492, 494, 496, and 498, a portion of which extends beyond top 500 and another portion of which extends beyond bottom 502. Layer 532 is then heated to shrink the heat-shrinkable layer into contact with carton 490. Layer 532 shrinks to fit snuggly around carton 490. Although heat-shrinkable layer 532 can overlap any portion of carton 490, in the embodiment shown in FIG. 14 heat-shrunk layer 532 substantially overlaps sides 492, 494, 496, and 498 and corners 516, 518, and 520, and overlaps a portion of top 500 and at least a portion of bottom 502. FIG. 15 illustrates an alternative embodiment of packaging assembly 534 wherein layer 532 does not overlap any portion of top 500 or bottom 502 of carton 490. Although other types of heat-shrinkable layers may be used, in one embodiment heat-shrinkable layer 532 is a sheet of material or a sleeve of material. Additionally, although other materials may be used for layer 532, in one embodiment layer 532 includes polyethylene, polypropylene, and/or polyvinyl chloride.

Heat-shrunk layer 532 may facilitate sealing carton 490 to protect a product contained within the carton from tampering and to generally seal the comers/joints of carton 490 for containing the product within carton 490 as well as protecting the product from contamination. Heat-shrunk layer 532 can be used, for example, to replace bags or liners sometimes used within a container for sealing a product. The tight fit of heat-shrunk layer 532 may also facilitate maintaining a shape of carton 490 for example, to facilitate displaying, stacking and/or arranging carton 490 or a plurality thereof of cartons, and/or maintaining a shape that facilitates other functionality such as carrying the carton.

In one embodiment, top 500 (and/or one or more of sides 492, 494, 496, and 498) includes a handle 536 extending outwardly therefrom for carrying the assembly. Heat-shrunk layer 532 includes an opening 538 therein adjacent handle 536 such that handle 536 extends through opening 538 allowing access to the handle when heat-shrunk layer 532 overlaps a portion of carton 490.

In one embodiment, carton 490 and/or layer 532 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

Heat-shrinkable layer 532 may also facilitate forming of the carton, and more specifically moving moveable sections 522 and 524 from first position 526 to second position 528 to form packaging assembly 534. As described above, cartons having shapes that are more complex than conventional rectangular cartons may be difficult and therefore costly to manufacture.

However, in one embodiment heat-shrinkable layer 532 is wrapped around carton 490 such that heat-shrinkable layer 532 overlaps at least a portion of one or more of movable sections 522 and 524. As layer 532 is heated and shrinks into contact with movable sections 522 and 524, layer moves movable sections 522 and 524 from first position 526 (shown in FIG. 13) to second position 528 to form a shape of packaging assembly 534. Heat-shrunk layer 532 then holds movable sections 522 and 524 in second position 528 as long as layer 532 remains substantially wrapped around carton 490. In one embodiment wherein movable sections 522 and 524 are biased to the first position, layer 532 moves the movable sections to, and holds the movable section in, second position 528 against the bias. By moving and holding movable sections 522 and 524 into second position 528, layer 532 facilitates forming a shape of packaging assembly 534, and more specifically carton 490, that may be otherwise difficult and costly to form.

Figure 16:
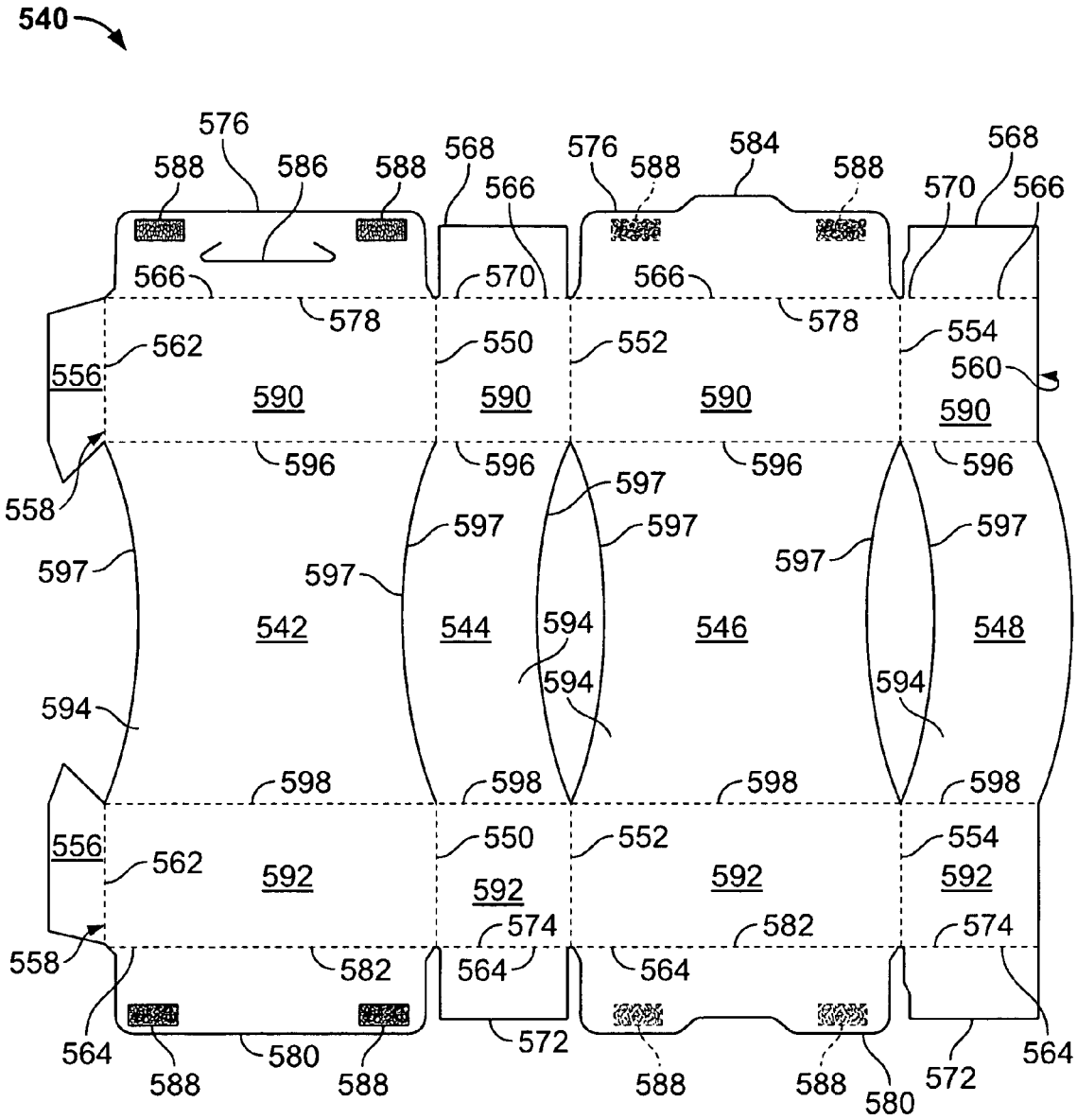
FIG. 16 is a top plan view of a blank of sheet material for forming a carton, according to one embodiment of this invention.
Figure 17:
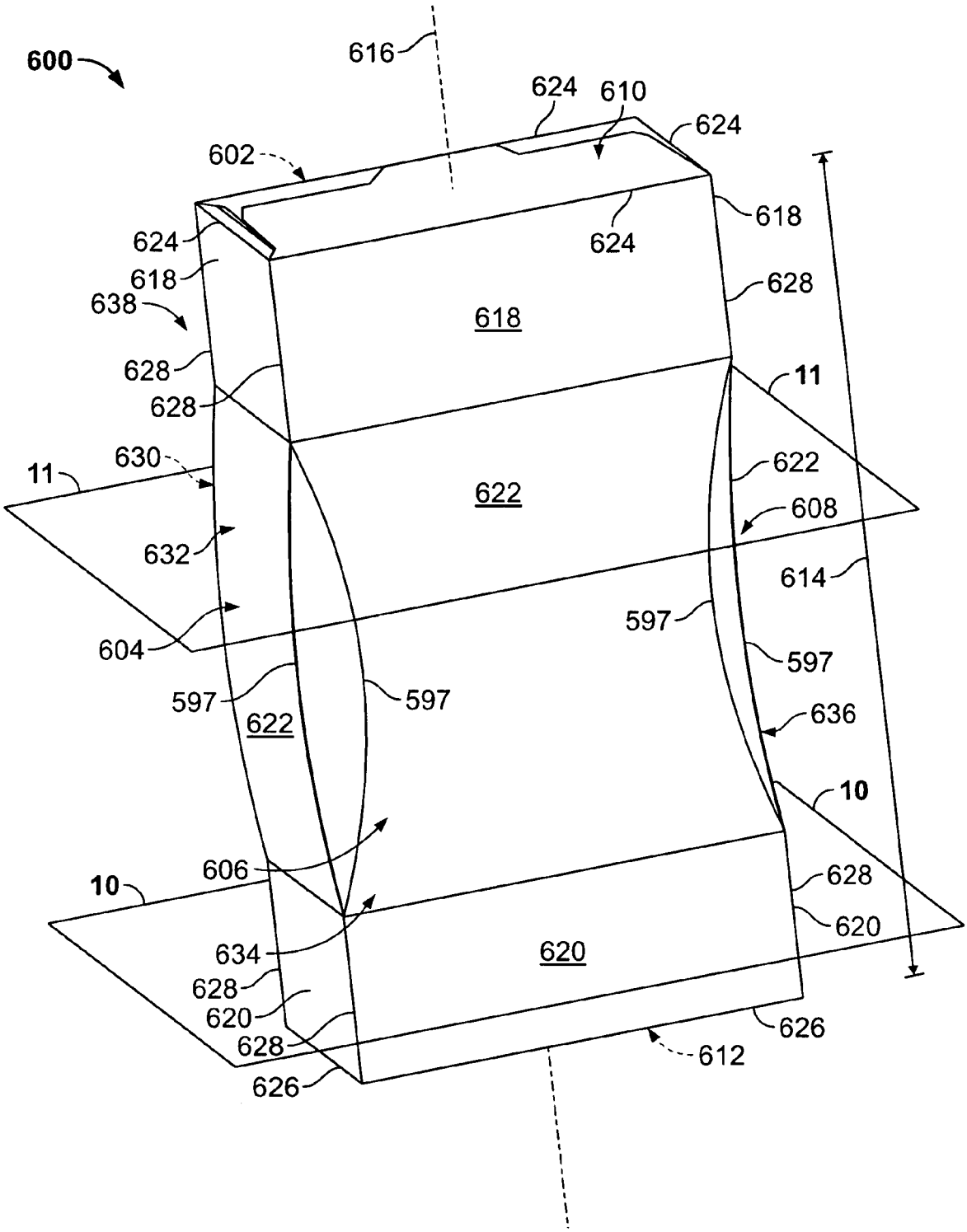
FIG. 17 is a perspective view of the carton formed from the blank shown in FIG. 16.
Figure 18:
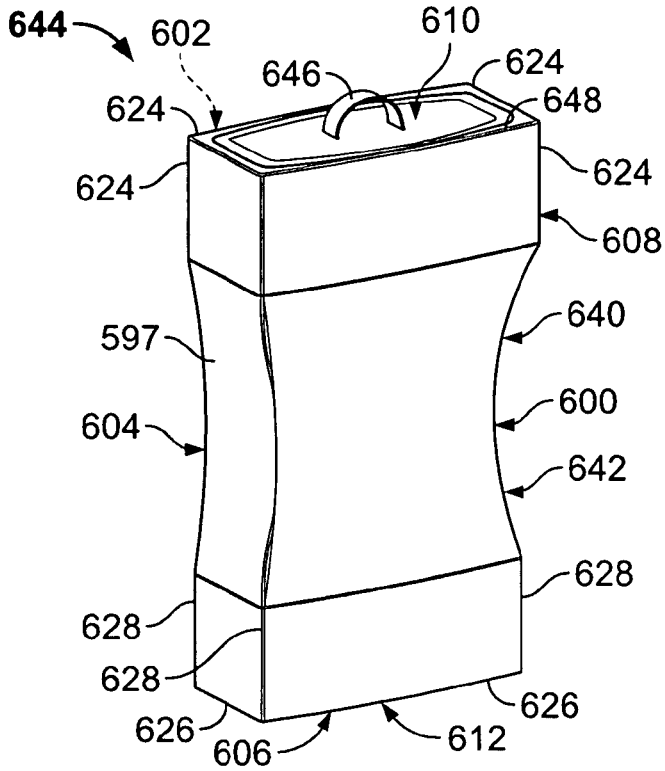
FIG. 18 is a perspective view of a packaging assembly including the carton shown in FIG. 17.
Figure 19:
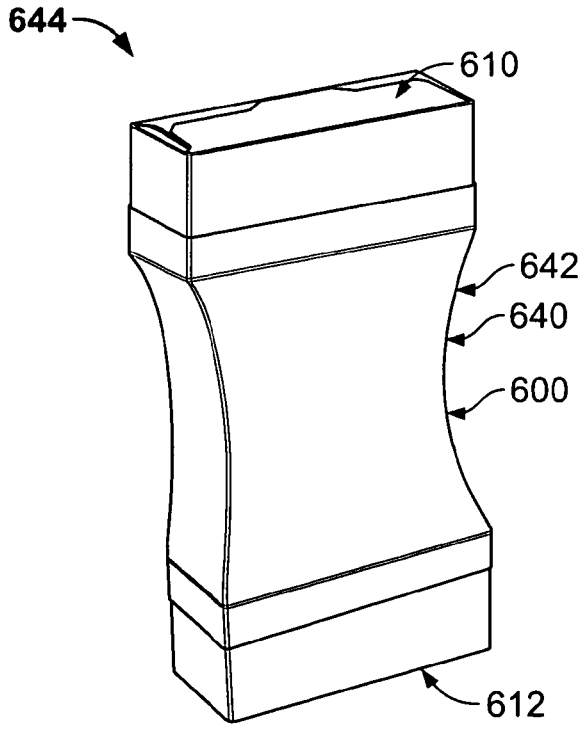
FIG. 19 is a perspective view of an alternative embodiment of the packaging assembly shown in FIG. 18.

Although as described above a packaging assembly may have any suitable size, shape, and/or configuration (e.g., number of sides), FIGS. 16-19 illustrate the formation of one embodiment of a packaging assembly. Specifically, FIG. 16 is a top plan view of one embodiment of a blank of sheet material (designated in its entirety by reference numeral 540). FIG. 17 is a perspective view of one embodiment of a carton (designated in its entirety by 600) formed from blank 540 shown in FIG. 16. FIG. 18 is a perspective view of one embodiment of a packaging assembly (designated in its entirety by 644) including carton 600 shown in FIG. 17. FIG. 19 is a perspective view of an alternative embodiment of packaging assembly 644 shown in FIG. 18.

Referring to FIG. 16, blank 540 includes a succession of four side panels 542, 544, 546, and 548 that are connected together by a plurality of preformed, generally parallel, fold lines 550, 552, and 554, respectively. Specifically, each side panel 542, 544, 546, and 548 extends from an adjacent one of the side panels along respective fold lines 550, 552, and 554. A side panel flap 556 extends from an end portion (generally designated by 558) of side panel 542, or alternatively from an end portion (generally designated by 560) of side panel 548, along a fold line 562 for facilitating securing end portions 558 and 560 together to form carton 600 (shown in FIG. 17). Each side panel 542, 544, 546, and 548 extends a height measured between a bottom end 564 and a top end 566.

Side panel 544 and side panel 548 each include a top support panel 568 extending from top end 566 thereof along a fold line 570 and a bottom support panel 572 extending from bottom end 564 thereof along a fold line 574. Additionally, side panel 542 and side panel 546 each include a top panel 576 extending from top end 566 thereof along a fold line 578 and a bottom panel 580 extending from bottom end 564 thereof along a fold line 582. In one embodiment, at least one of top panels 576 includes an extension 584 extending therefrom for interconnection with a slot 586 within other top panel 576 for facilitating securing top panels 576 together to form a top 610 (shown in FIG. 17) of carton 600 (shown in FIG. 17). Similarly, in one embodiment (not shown), at least one of bottom panels 580 includes an extension extending therefrom for interconnection with a slot within the other bottom panel 580 for facilitating securing bottom panels 580 together to form a bottom 612 (shown in FIG. 17) of carton 600 (shown in FIG. 17). Of course, top panels 576 and bottom panels 580 may include any suitable interconnection means in addition to, or alternatively to, extension/slot arrangement described above. Accordingly, top and bottom panels 576 and 580, respectively, are not limited to interconnection using an extension/slot arrangement. For example, in one embodiment, adhesive is applied to portions of top and bottom panels 576 and 580, respectively. In another embodiment, at least one of top panels 576 and bottom panels 580 interconnect using hook-and-loop fasteners 588.

Side panels 542, 544, 546, and 548 each include an upper panel portion 590, a lower panel portion 592, and an intermediate panel portion 594. Intermediate panel portions 594 each extend from upper panel portions 590 along a fold line 596 to lower panel portions 592 along a fold line 598. Side panels 542, 544, 546, and 548 also each includes curved edges 597.

As shown in FIG. 17, a carton 600 can be formed from blank 540 (shown in FIG. 16) by folding blank 540 about fold lines 550, 552, 554, 562, 570, 574, 578, and 582 (shown in FIG. 16). In one embodiment, an adhesive may be applied to portions of blank 540 to secure carton 600 together. Generally, side panels 542, 544, 546, and 548 (shown in FIG. 16) form four successive sides (generally designated by 602, 604, 606, and 608) of carton 600, top panels 576 (shown in FIG. 16) form a top (generally designated by 610) of carton 600, and bottom panels 580 (shown in FIG. 16) form a bottom (generally designated by 612) of carton 600. Carton 600 extends a height 614 measured between top 610 and bottom 612 of carton 600 along a central longitudinal axis 616 extending through carton 600. As can be seen in FIG. 17, in one embodiment, carton 600 includes a generally rectangular cross-sectional shape, for example, a cross section taken along the plane 10-10 extending generally perpendicularly to central longitudinal axis 616. As can also be seen in FIG. 17, each side 602, 604, 606, and 608 extends between top 610 and bottom 612 of carton 600. More specifically, in one embodiment, each side 602, 604, 606, and 608 extends from top 610 to bottom 612. Any side 602, 604, 606, or 608 may be referred to herein as a first, a second, a third, and/or a fourth side.

Upper panel portions 590, lower panel portions 592, and intermediate panel portions 594 (shown in FIG. 12) form upper portions 618, lower portions 620, and intermediate portions 622, respectively, of each side 602, 604, 606, and 608. A corner 624 is defined at an intersection between top 610 and each side 602, 604, 606, and 608. Similarly, a corner 626 is defined at an intersection between bottom 612 and each side 602, 604, 606, and 608. Moreover, a corner 628 is defined at an intersection between each adjacent side of sides 602, 604, 606, and 608. Additionally, as discussed above, sides 602, 604, 606, and 608 each include curved edges 597. In one embodiment, curved edges 597 extend only a portion of the height of carton 600, although alternatively curved edges 597 extend from top 610 to bottom 612 of carton 600.

Sides 602, 604, 606, and 608 each form a movable section (generally designated by 630, 632, 634, and 636, respectively) of carton 600. Any movable sections 630, 632, 634, or 636 may be referred to herein as a first, a second, a third, and/or a fourth movable section. Movable sections 630, 632, 634, and 636 are each movable between a first position shown in FIG. 17 (and generally designated by 638) and a second position shown in FIG. 18 (and generally designated by 640). In one embodiment, movable sections 630, 632, 634, and 636 are movable from first position 638 to second position 640 by bending them along fold lines 596 and 598 (shown in FIG. 16). Accordingly, and as can be seen in FIGS. 17 and 18, movement between first and second positions 638 and 640, respectively, varies, or changes, a cross-sectional width of carton 600 defined between two opposite sides of sides 604 and 608 along the height of carton 600. Additionally, because of curved edges 597, movement from first position 638 to second position 640 curves (or increases a curvature of) sides 602, 604, 606, and/or 608 such that sides 602, 604, 606, and 608 each include a curved surface. In one embodiment, only a portion of sides 602, 604, 606, and/or 608 are curved in second position 640 as shown in FIG. 18. Alternatively, in another embodiment, sides 602, 604, 606, and/or 608 are curved from top 610 to bottom 612 of carton 600.

In one embodiment, a cross-sectional width defined between two opposite sides of sides 602, 604, 606, and 608 and generally adjacent movable sections 630, 632, 634, and 636 (e.g., a cross section taken along plane 11-11 in FIG. 17) is generally greater in first position 638 than in second position 640. In one embodiment, at least one of movable sections 630, 632, 634, and 636 is biased in first position 638. Although movable sections 630, 632, 634, and 636 may be biased in first position 638 using any suitable mechanism, in one embodiment, a structure of carton 600 biases movable sections 630, 632, 634, and 636.

Once carton 600 has been formed, and either before, simultaneously with, or after a product is placed within carton 600, a heat-shrinkable layer (generally designated by 642) can be wrapped around at least a portion of carton 600 and heat-shrunk to form a packaging assembly, one embodiment of which is shown in FIG. 18 and generally designated by 644. Specifically, in the embodiment shown in FIG. 18 heat-shrinkable layer 642 is wrapped around sides 602, 604, 606, and 608, a portion of which extends beyond top 610 and another portion of which extends beyond bottom 612. Layer 642 is then heated to shrink the heat-shrinkable layer into contact with carton 600. Layer 642 shrinks to fit snuggly around carton 600. Although heat-shrinkable layer 642 can overlap any portion of carton 600, in the embodiment shown in FIG. 18 heat-shrunk layer 642 substantially overlaps sides 602, 604, 606, and 608 and corners 624, 626, and 628, and overlaps a portion of top 610 and at least a portion of bottom 612. FIG. 19 illustrates an alternative embodiment of packaging assembly 644 wherein layer 642 does not overlap any portion of top 610 or bottom 612 of carton 600. Although other types of heat-shrinkable layers may be used, in one embodiment heat-shrinkable layer 642 is a sheet of material or a sleeve of material. Additionally, although other materials may be used for layer 642, in one embodiment layer 642 includes polyethylene, polypropylene, and/or polyvinyl chloride.

Heat-shrunk layer 642 may facilitate sealing carton 600 to protect a product contained within the carton from tampering and to generally seal the comers/joints of carton 600 for containing the product within carton 600 as well as protecting the product from contamination. Heat-shrunk layer 642 can be used, for example, to replace bags or liners sometimes used within a container for sealing a product. The tight fit of heat-shrunk layer 642 may also facilitate maintaining a shape of carton 600 for example, to facilitate displaying, stacking and/or arranging carton 600 or a plurality thereof of cartons, and/or maintaining a shape that facilitates other functionality such as carrying the carton.

In one embodiment, top 610 (and/or one or more sides 602, 604, 606, and 608) includes a handle 646 extending outwardly therefrom for carrying the assembly. Heat-shrunk layer 642 includes an opening 648 therein adjacent handle 646 such that handle 646 extends through opening 648 allowing access to handle 646 when heat-shrunk layer 642 overlaps a portion of carton 600.

In one embodiment, carton 600 and/or layer 642 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

Heat-shrinkable layer 642 may also facilitate forming of the carton, and more specifically moving moveable sections 630, 632, 634, and 636 from first position 638 to second position 640 to form packaging assembly 644. As described above, cartons having shapes that are more complex than conventional rectangular cartons may be difficult and therefore costly to manufacture.

However, in one embodiment heat-shrinkable layer 642 is wrapped around carton 600 such that heat-shrinkable layer 642 overlaps at least a portion of one or more of movable sections 630, 632, 634, and 636. As layer 642 is heated and shrinks into contact with movable sections 630, 632, 634, and 636, layer 642 moves movable sections 630, 632, 634, and 636 from first position 638 (shown in FIG. 17) to second position 640 to form a shape of packaging assembly 644. Heat-shrunk layer 642 then holds movable sections 630, 632, 634, and 636 in second position 640 as long as layer 642 remains substantially wrapped around carton 600. In one embodiment wherein movable sections 630, 632, 634, and 636 are biased to the first position, layer 642 moves the movable sections to, and holds the movable section in, second position 640 against the bias. By moving and holding movable sections 630, 632, 634, and 636 into second position 640, layer 642 facilitates forming a shape of packaging assembly 644, and more specifically carton 600, that may be otherwise difficult and costly to form.

Figure 20:
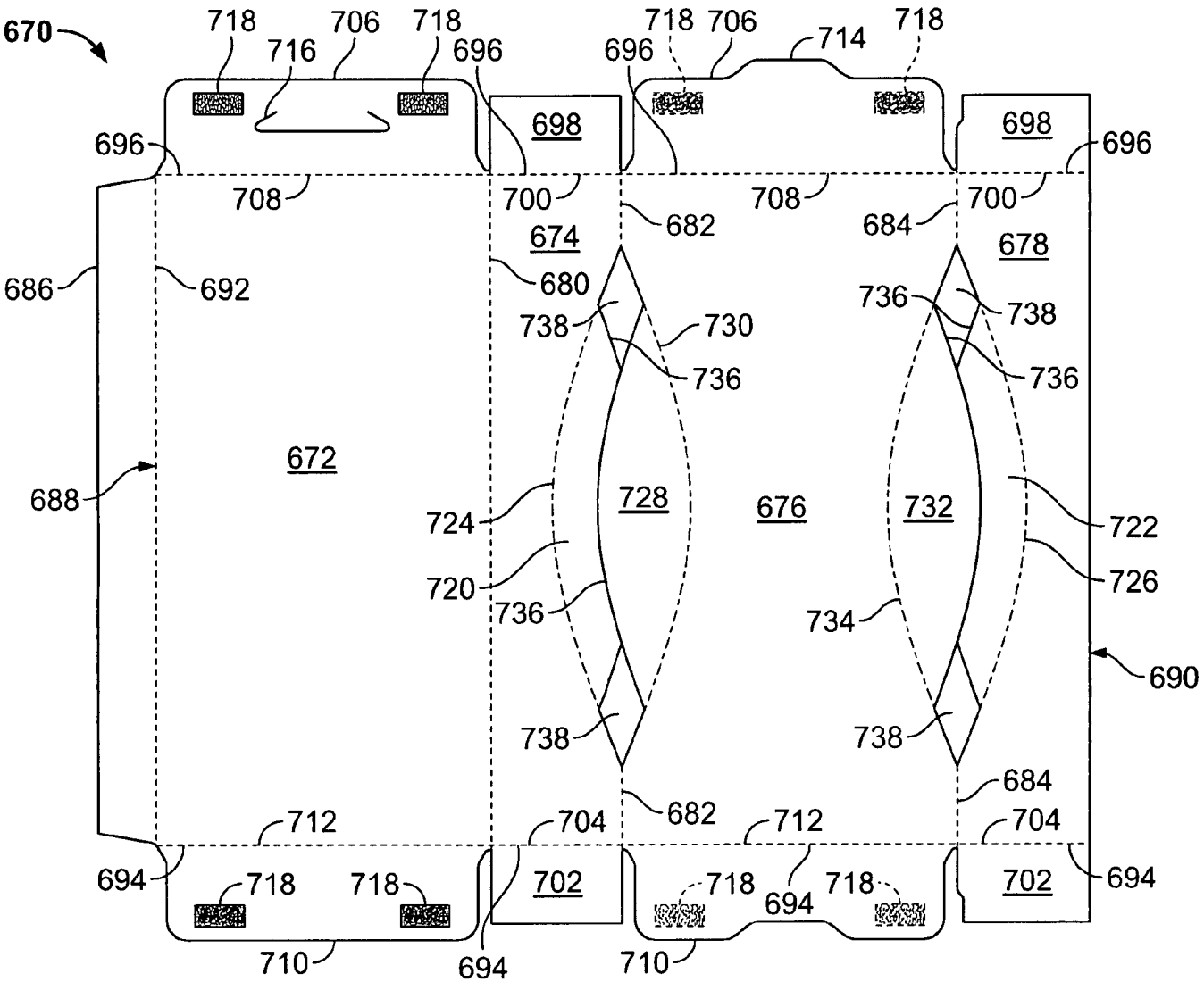
FIG. 20 is a top plan view of a blank of sheet material for forming a carton, according to one embodiment of this invention.
Figure 21:
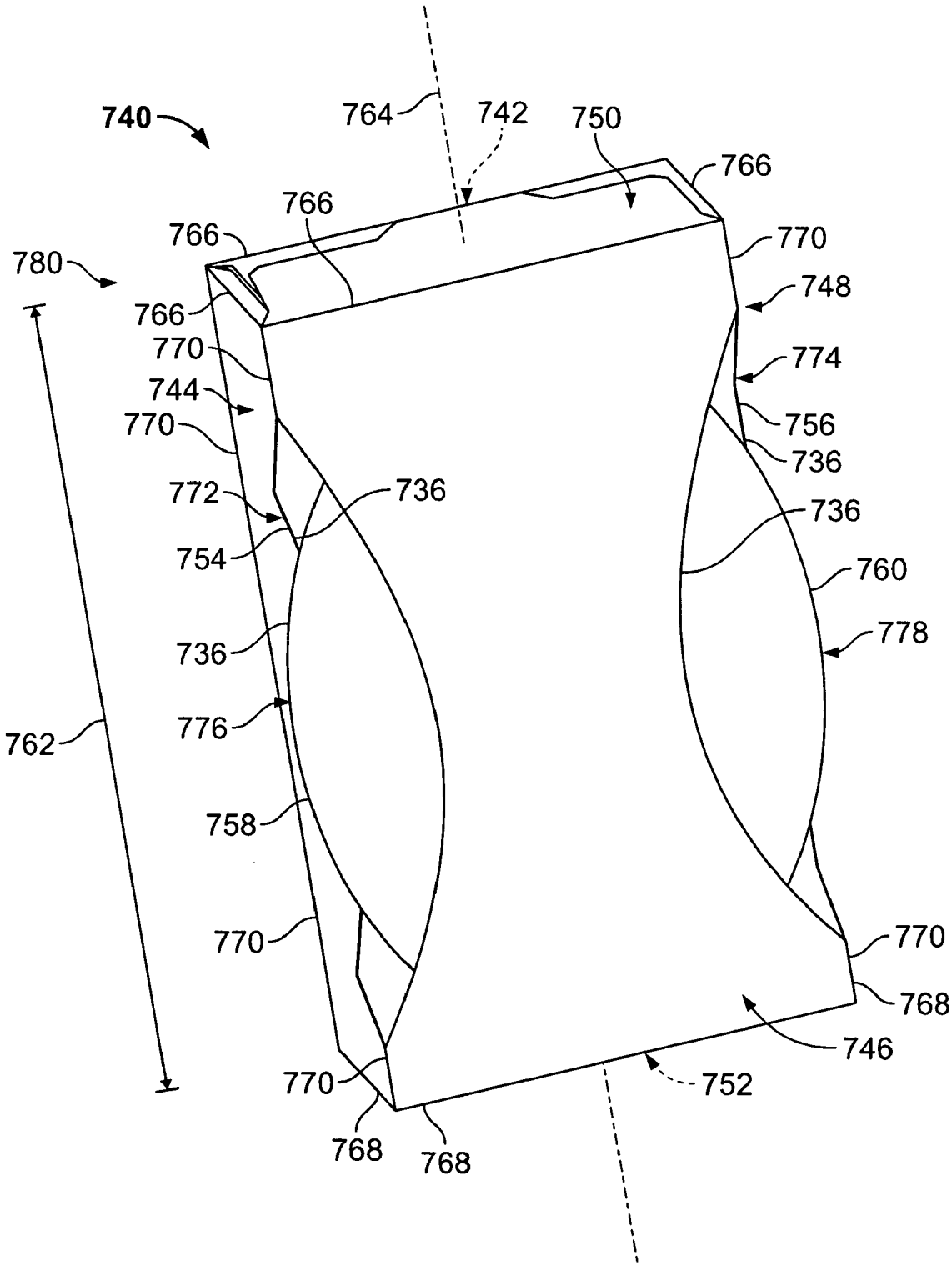
FIG. 21 is a perspective view of the carton formed from the blank shown in FIG. 20.
Figure 22:
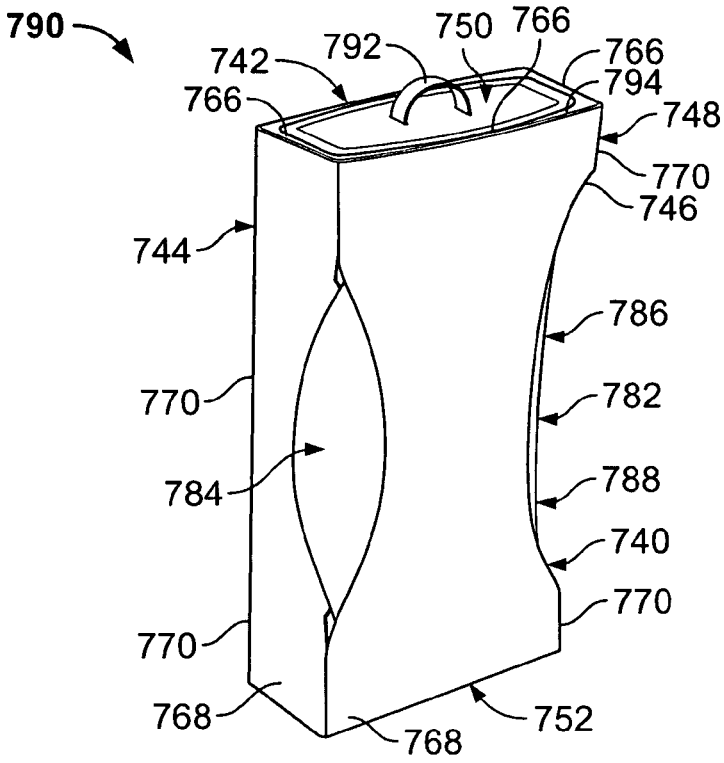
FIG. 22 is a perspective view of a packaging assembly including the carton shown in FIG. 21.

Although as described above a packaging assembly may have any suitable size, shape, and/or configuration (e.g., number of sides), FIGS. 20-23 illustrate the formation of one embodiment of a packaging assembly. Specifically, FIG. 20 is a top plan view of one embodiment of a blank of sheet material (designated in its entirety by reference numeral 670). FIG. 21 is a perspective view of one embodiment of a carton (designated in its entirety by 740) formed from blank 670 shown in FIG. 20. FIG. 22 is a perspective view of one embodiment of a packaging assembly (designated in its entirety by 790) including carton 740 shown in FIG. 21. FIG.

23 is a perspective view of an alternative embodiment of packaging assembly 790 shown in FIG. 22.

Referring to FIG. 20, blank 670 includes a succession of four side panels 672, 674, 676, and 678 that are connected together by a plurality of preformed, generally parallel, fold lines 680, 682, and 684, respectively. Specifically, each side panel 672, 674, 676, and 678 extends from an adjacent one of the side panels along respective fold lines 680, 682, and 684. A side panel flap 686 extends from an end portion (generally designated by 688) of side panel 672, or alternatively from an end portion (generally designated by 690) of side panel 678, along a fold line 692 for facilitating securing end portions 688 and 690 together to form carton 740 (shown in FIG. 21). Each side panel 672, 674, 676, and 678 extends a height measured between a bottom end 694 and a top end 696.

Side panel 674 and side panel 678 each include a top support panel 698 extending from top end 696 thereof along a fold line 700 and a bottom support panel 702 extending from bottom end 694 thereof along a fold line 704. Additionally, side panel 672 and side panel 676 each include a top panel 706 extending from top end 696 thereof along a fold line 708 and a bottom panel 710 extending from bottom end 694 thereof along a fold line 712. In one embodiment, at least one of top panels 706 includes an extension 714 extending therefrom for interconnection with a slot 716 within the other top panel 706 for facilitating securing top panels 706 together to form a top 750 (shown in FIG. 21) of carton 740 (shown in FIG. 21). Similarly, in one embodiment (not shown), at least one of bottom panels 710 includes an extension extending therefrom for interconnection with a slot within the other bottom panel 710 for facilitating securing bottom panels 710 together to form a bottom 752 (shown in FIG. 21) of carton 740 (shown in FIG. 21). Of course, top panels 706 and bottom panels 710 may include any suitable interconnection means in addition to, or alternatively to, extension/slot arrangement described above. Accordingly, top and bottom panels 706 and 710, respectively, are not limited to interconnection using an extension/slot arrangement. For example, in one embodiment, adhesive is applied to portions of top and bottom panels 706 and 710, respectively. In another embodiment, at least one of top panels 706 and bottom panels 710 interconnect using hook-and-loop fasteners 718.

Side panels 674 and 678 each include an extension panel 720 and 722, respectively, extending therefrom along a fold line 724, 726, respectively. Side panel 676 also includes an extension panel 728 extending therefrom along a fold line 730 and an opposite extension panel 732 extending along a fold line 734. In one embodiment, fold lines 724, 726, 730, and/or 734 are curved. Moreover, in one embodiment extension panel 720, 722, 728, and/or 732 includes a curved edge 736. Any extension panel 720, 722, 728, or 732 may be referred to herein as a first, second, third, and/or fourth extension. Additionally, as can be seen in FIG. 20, a plurality of openings 738 are formed between adjacent panels of extension panels 720, 722, 728, and 732.

As shown in FIG. 21, a carton 740 can be formed from blank 670 (shown in FIG. 20) by folding blank 670 about fold lines 680, 682, 684, 692, 700, 704, 708, and 712 (shown in FIG. 20). In one embodiment, an adhesive may be applied to portions of blank 670 to secure carton 740 together. Generally, side panels 672, 674, 676, and 678 (shown in FIG. 20) form four successive sides (generally designated by 742, 744, 746, and 748) of carton 740, top panels 706 (shown in FIG. 20) form a top (generally designated by 750) of carton 740, and bottom panels 710 (shown in FIG. 20) form a bottom (generally designated by 752) of carton 740. Extension panels 720, 722, 728, and 732 each form a respective extension 754, 756, 758, and 760. Carton 740 extends a height 762 measured between top 750 and bottom 752 of carton 740 along a central longitudinal axis 764 extending through carton 740. As can also be seen in FIG. 21, each side 742, 744, 746, and 748 extends between top 750 and bottom 752 of carton 740. More specifically, in one embodiment, each side 742, 744, 746, and 748 extends from top 750 to bottom 752. Any side 742, 744, 746, or 748 may be referred to herein as a first, a second, a third, and/or a fourth side.

A corner 766 is defined at an intersection between top 750 and each side 742, 744, 746, and 748. Similarly, a corner 768 is defined at an intersection between bottom 752 and each side 742, 744, 746, and 748. Moreover, a comer 770 is defined at an intersection between each adjacent side of sides 742, 744, 746, and 748. Additionally, as discussed above, extensions 754, 756, 758, and 760 each include curved edges 736.

Extensions 754, 756, 758, and 760 each form a movable section (generally designated by 772, 774, 776, and 778, respectively) of carton 740. Any movable section 772, 774, 776, or 778 may be referred to herein as a first, a second, a third, and/or a fourth movable section. Movable sections 772, 774, 776, and 778 are each movable between a first position shown in FIG. 21 (and generally designated by 780) and a second position shown in FIG. 22 (and generally designated by 782). In one embodiment, movable sections 772, 774, 776, and 778 are movable from first position 780 to second position 782 by bending them along the fold lines corresponding fold lines 724, 726, 730, and 734 (shown in FIG. 20). Accordingly, and as can be seen in FIGS. 21 and 22, movement between first and second positions 780 and 782, respectively, creates a side (generally designated by 784) defined between side 744 and side 746 and a side (generally designated by 786) defined between side 746 and side 748. In one embodiment, side 784 is obliquely angled with respect to side 744 and side 786 is obliquely angled with respect to side 746. Any side 742, 744, 746, 748, 784, or 786 may be referred to herein as a first, a second, a third, a fourth, a fifth, and/or a sixth side. In one embodiment, sides 784 and/or 786 extend only partially between top 750 and bottom 752 of carton 740. Alternatively, sides 784 and/or 786 extend from top 750 to bottom 752 of carton 740.

Specifically, movable section 772 (extension 754) is bended along fold line 724 towards an interior of carton 781 such that section 772 is obliquely angled with respect to side 744. Similarly, movable section 776 (extension 758) is bended along fold line 730 towards an interior of carton 781 such that section 776 is obliquely angled with respect to side 746 and such that section 776 at least partially overlaps section 772. Movable section 774 (extension 756) is also bended along fold line 726 towards an interior of carton 781 such that section 774 is obliquely angled with respect to side 748. Similarly, movable section 778 (extension 760) is bended along fold line 734 towards an interior of carton 781 such that section 778 is obliquely angled with respect to side 746 and such that section 778 at least partially overlaps section 774. As can be seen in FIG. 22, in one embodiment movement from first position 780 to second position 782 at least partially closes openings 738 (shown in FIG. 20). Additionally, because of curved edges 736, movement from first position 780 to second position 782 curves (or increases a curvature of) side 746 such that side 746 includes a curved surface. In one embodiment, only a portion of side 746 is curved in second position 782 as shown in FIG. 22. Alternatively, in another embodiment side 746 is curved from top 750 to bottom 752 of carton 740. In one embodiment, at least one of movable sections 772, 774, 776, and 778 is biased in first position 780. Although movable sections 772, 774, 776, and 778 may be biased in first position 780 using any suitable mechanism, in one embodiment, a structure of carton 740 biases movable sections 772, 774, 776, and 778.

Figure 23:
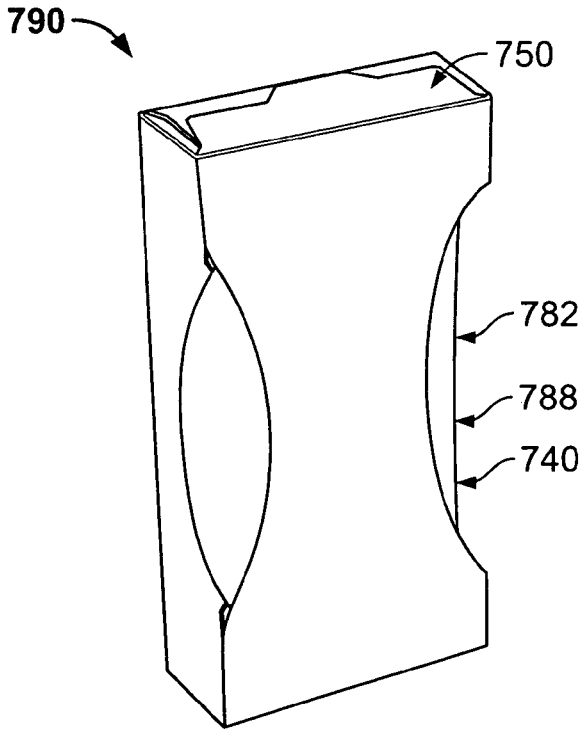
FIG. 23 is a perspective view of an alternative embodiment of the packaging assembly shown in FIG. 22.

Once carton 740 has been formed, and either before, simultaneously with, or after a product is placed within carton 740, a heat-shrinkable layer (generally designated by 788) can be wrapped around at least a portion of carton 740 and heat-shrunk to form a packaging assembly, one embodiment of which is shown in FIG. 22 and generally designated by 790. Specifically, in the embodiment shown in FIG. 22 heat-shrinkable layer 788 is wrapped around sides 742, 744, 746, 748, 784, and 786, a portion of which extends beyond top 750 and another portion of which extends beyond bottom 752. Layer 788 is then heated to shrink the heat-shrinkable layer into contact with carton 740. Layer 788 shrinks to fit snuggly around carton 740. Although heat-shrinkable layer 788 can overlap any portion of carton 740, in the embodiment shown in FIG. 22 heat-shrunk layer 788 substantially overlaps sides 742, 744, 746, 748, 784, and 786 and corners 766, 768, and 770, and overlaps a portion of top 750 and at least a portion of bottom 752. FIG. 23 illustrates an alternative embodiment of packaging assembly 790 wherein layer 788 does not overlap any portion of top 750 or bottom 752 of carton 740. Although other types of heat-shrinkable layers may be used, in one embodiment heat-shrinkable layer 788 is a sheet of material or a sleeve of material. Additionally, although other materials may be used for layer 788, in one embodiment layer 788 includes polyethylene, polypropylene, and/or polyvinyl chloride.

Heat-shrunk layer 788 may facilitate sealing carton 740 to protect a product contained within the carton from tampering and to generally seal the corners/joints of carton 740 for containing the product within carton 740 as well as protecting the product from contamination. Heat-shrunk layer 788 can be used, for example, to replace bags or liners sometimes used within a container for sealing a product. The tight fit of heat-shrunk layer 788 may also facilitate maintaining a shape of carton 740 for example, to facilitate displaying, stacking and/or arranging carton 740 or a plurality thereof of cartons, and/or maintaining a shape that facilitates other functionality such as carrying the carton.

In one embodiment, top 750 (and/or one or more of sides 742, 744, 746, and 748) includes a handle 792 extending outwardly therefrom for carrying the assembly. Heat-shrunk layer 788 includes an opening 794 therein adjacent handle 792 such that handle 792 extends through opening 794 allowing access to handle 792 when heat-shrunk layer 788 overlaps a portion of carton 740.

In one embodiment, carton 740 and/or layer 788 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

Heat-shrinkable layer 788 may also facilitate forming of the carton, and more specifically moving moveable sections 772, 774, 776, and 778 from first position 780 to second position 782 to form packaging assembly 790. As described above, cartons having shapes that are more complex than conventional rectangular cartons may be difficult and therefore costly to manufacture.

However, in one embodiment heat-shrinkable layer 788 is wrapped around carton 740 such that heat-shrinkable layer 788 overlaps at least a portion of one or more of movable sections 772, 774, 776, and 778. As layer 788 is heated and shrinks into contact with movable sections 772, 774, 776, and 778, layer moves movable sections 772, 774, 776, and 778 from first position 780 (shown in FIG. 21) to second position 782 to form a shape of packaging assembly 790. Heat-shrunk layer 788 then holds movable sections 772, 774, 776, and 778 in second position 782 as long as layer 788 remains substantially wrapped around carton 740. In one embodiment wherein movable sections 772, 774, 776, and 778 are biased to the first position, layer 788 moves the movable sections to, and holds the movable section in, second position 782 against the bias. By moving and holding movable sections 772, 774, 776, and 778 into second position 782, layer 788 facilitates forming a shape of packaging assembly 790, and more specifically carton 740, that may be otherwise difficult and costly to form.

In one embodiment, carton 854 and/or layer 880 includes a marking thereon, such as, but not limited to, indicia that communicates the product, a manufacturer of the product, and/or a seller of the product. For example, printed text that indicates a product's name and briefly describes the product, logos and trademarks that indicate a manufacturer and/or seller of the product, and/or designs and/or ornamentation that attracts attention.

Referring to FIGS. 24-41, a packaging assembly of the present invention may have any suitable size, shape and/or configuration, e.g., number of sides. The present invention is described below in reference to its application in connection with several embodiments. However, it will be obvious to those skilled in the art and guided by the teachings herein provided that the invention is likewise applicable to any suitable packaging assembly having any suitable number of top panels, bottom panels and/or side panels, and forming any suitable packaging assembly shape.

Figure 24:
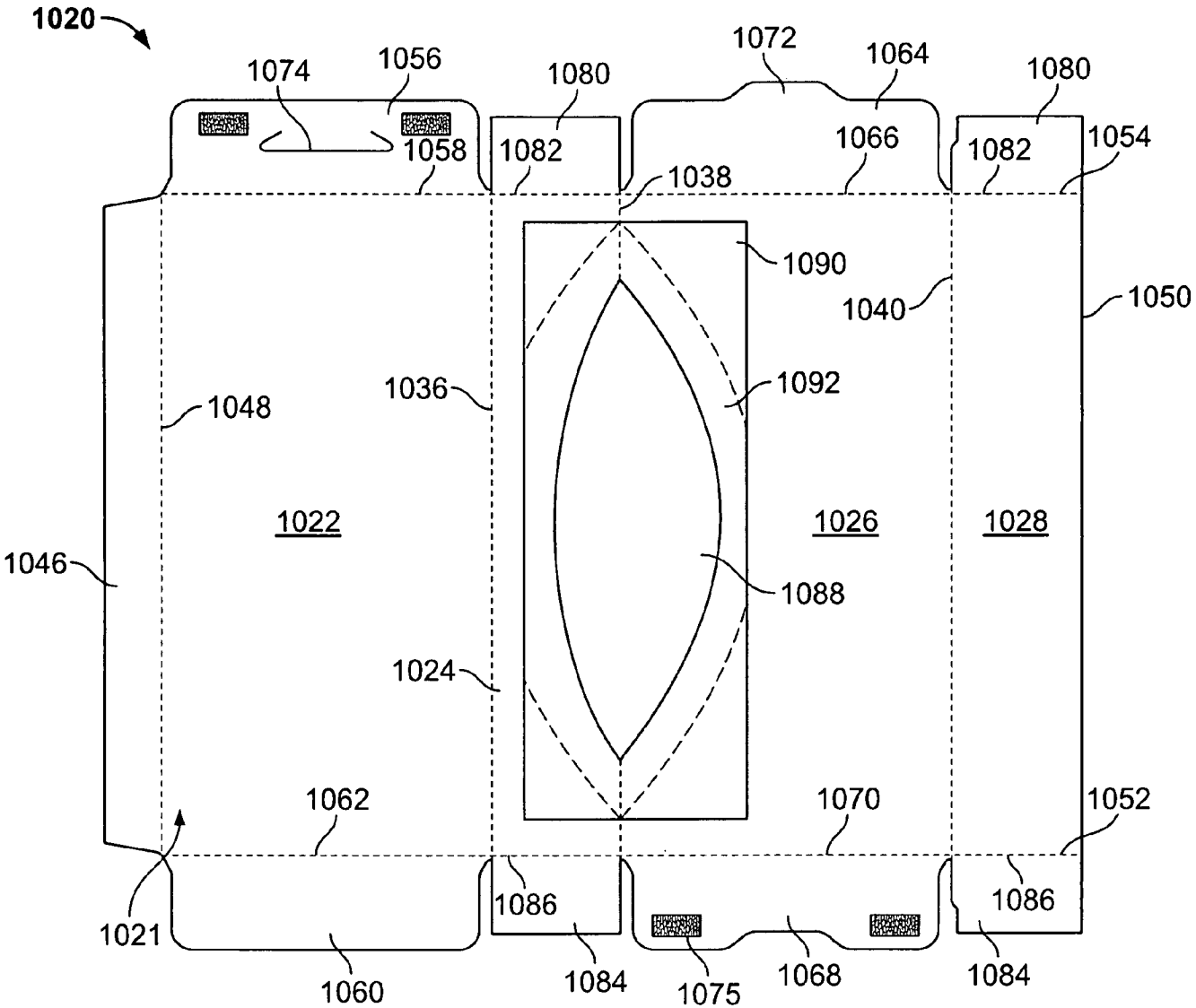
FIG. 24 is a top plan view of a blank of sheet material for forming a carton, according to one embodiment of this invention.
Figure 25:
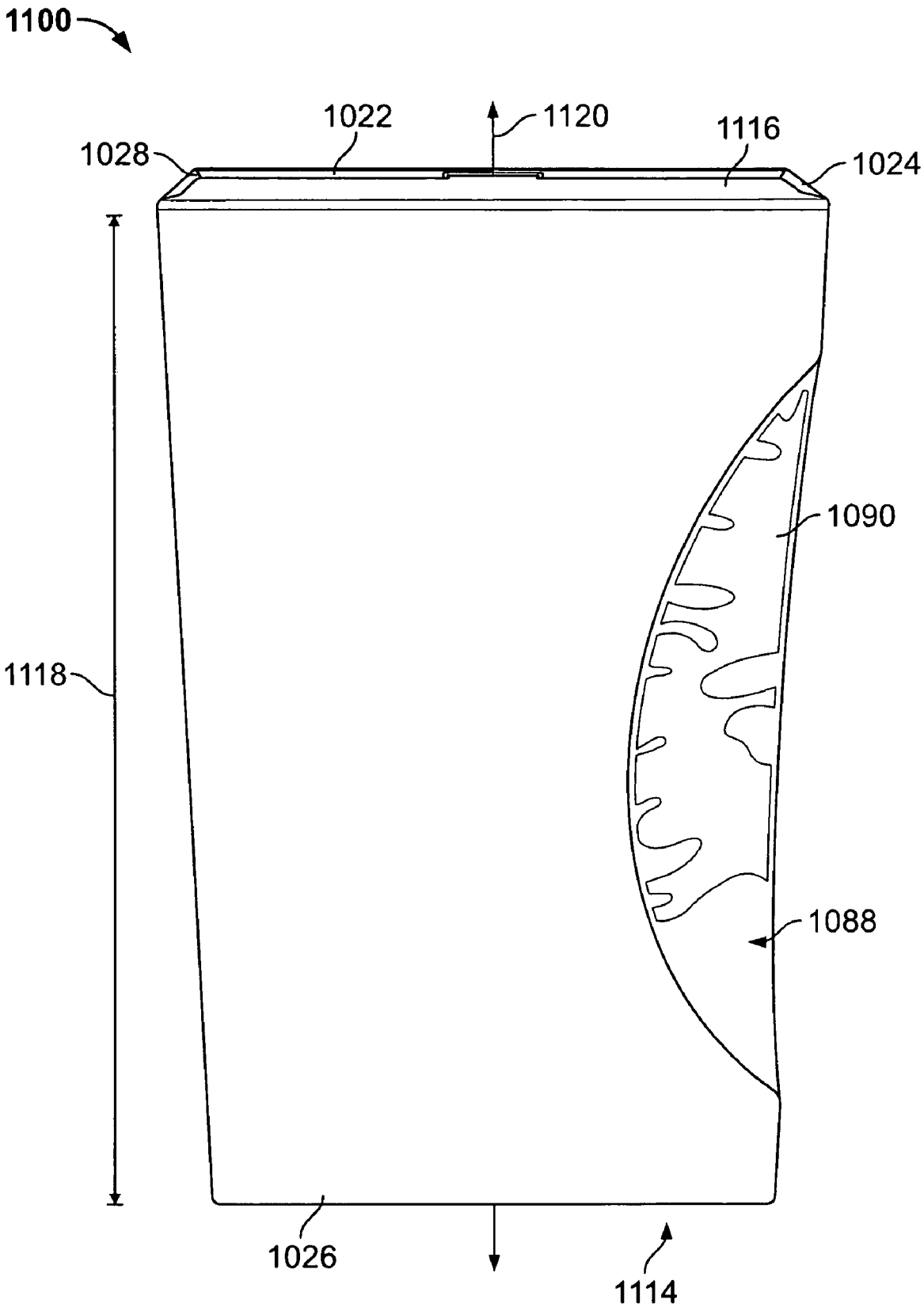
FIG. 25 is a perspective view of the carton formed from the blank shown in FIG. 24.
Figure 26:
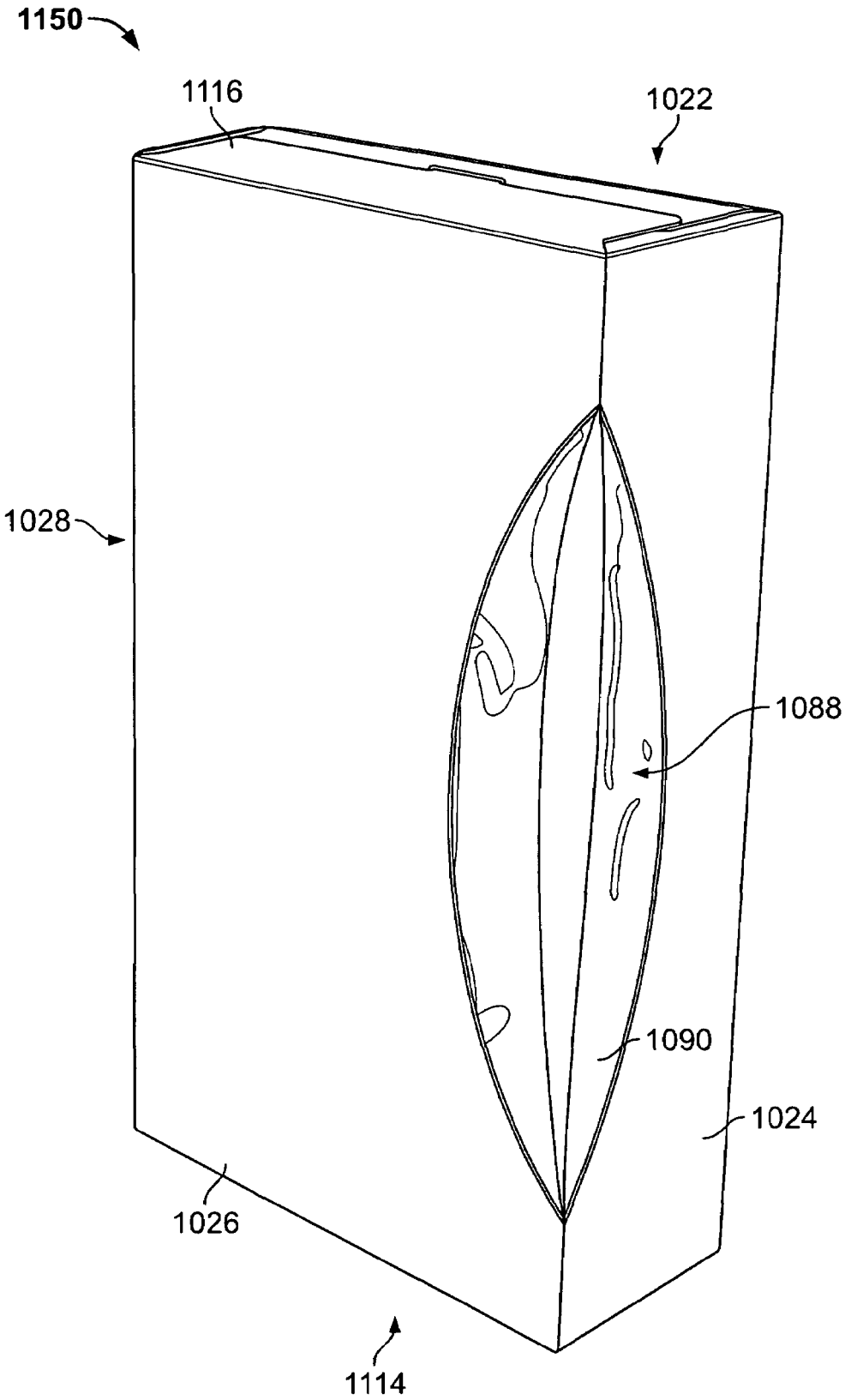
FIG. 26 is a perspective view of a packaging assembly including the carton shown in FIG. 25.

FIGS. 24-26 show a packaging assembly according to one embodiment. Specifically, FIG. 24 is a top plan view of a blank of sheet material 1020. FIG. 25 is a perspective view of a carton 1100 formed from blank 1020. FIG. 26 is a perspective view of a packaging assembly 1150 including carton 1100 formed from blank 1020.

Referring to FIG. 24, in one embodiment, blank 1020 has an interior surface 1021 and an opposing exterior surface. Blank 1020 includes a succession of side panels 1022, 1024, 1026 and 1028 that are connected together by a plurality of preformed, generally parallel, fold lines 1036, 1038 and 1040, respectively. Side panels 1022, 1024, 1026 and 1028 extend from an adjacent side panel along respective fold lines 1036, 1038 and 1040. A side panel flap 1046 extends from side panel 1022 along an end fold line 1048 to secure side panel flap 1046 to side panel 1028 to form carton 1100. In an alternative embodiment, a side panel flap (not shown) extends from side panel 1028 along an end fold line (not shown) formed along an edge 1050 of side panel 1028 to secure the side panel flap to side panel 1022 to form carton 1100.

Each side panel 1022, 1024, 1026 and 1028 extends a height measured between a bottom end 1052 and a top end 1054. As shown in FIG. 24, a top support panel 1056 extends from side panel 1022 at top end 1054 along a fold line 1058 and a bottom support panel 1060 extends from side panel 1022 at bottom end 1052 along a fold line 1062. Additionally, a top support panel 1064 extends from side panel 1026 at top end 1054 along a fold line 1066 and a bottom support panel 1068 extends from side panel 1026 at bottom end 1052 along a fold line 1070. Top support panel 1064 is connected to top support panel 1056 to form a top 1114, shown in FIG. 25, of carton 1100. In one embodiment, top support panel 1064 includes at least one tab 1072 extending therefrom, which engages with a cooperating slit 1074 formed in top support panel 1056 to secure top support panel 1064 to top support panel 1056 to form top 1114. Bottom support panel 1068 is connected to bottom support panel 1060 to from a bottom 1116, shown in FIG. 25, of carton 1100. As shown in FIG. 24, in one embodiment, bottom support panel 1068 includes at least one hook component 1075 of a hook-and-loop fastener, such as a VELCRO fastener (VELCRO is a registered trademark of VELCRO Industries B.V., Curacao, Netherlands), that cooperates with a loop component (not shown) of the hook-and-loop fastener positioned on bottom support panel 1060 to secure bottom support panel 1068 to bottom support panel 1060. In one embodiment, a top flap 1080 is connected to side panel 1024 and/or side panel 1028 along fold line 1082 at top end 1054 for cooperating with top support panels 1056, 1064 to form top 1114. Similarly, a bottom flap 1084 is connected to side panel 1024 and/or side panel 1026 along a fold line 1086 at bottom end 1052 for cooperating with bottom support panels 1060, 1068 to form bottom 1116. It is apparent to those skilled in the art and guided by the teachings herein provided that any suitable connecting mechanism can be used to connect top support panel 1056 to top support panel 1064 and/or bottom support panel 1060 to bottom support panel 1068. For example, in one embodiment, adhesive is applied to top support panels 1056, 1064, bottom support panels 1060, 1068, top flaps 1080 and/or bottom flaps 1084 to connect the respective panels.

Referring to FIGS. 24-26, in one embodiment, at least one of side panel 1022, 1024, 1026 and/or 1028 is movable between an initially biased first position and a second position having a curved or arcuate surface. Referring further to FIG. 24, in a particular embodiment, blank 1020 includes two movable side panels, namely side panel 1024 and adjacent side panel 1026. Movable side panel 1024 partially defines a void 1088 and movable side panel 1026, connected to movable side panel 1024 along fold line 1038, defines a remaining portion of void 1088. It is apparent to those skilled in the art and guided by the teachings herein provided that any suitable number of voids 1088 may be formed in blank 1020 to form carton 1100 in a desired shape, as discussed below.

A heat-shrink patch 1090 is applied to interior surface 1021 of blank 1020 and connected to at least a portion of movable side panel 1024 and movable side panel 1026 defining void 1088 to cover void 1088. In one embodiment, heat-shrink patch 1090 is a sheet or patch of shrinkable material that includes polyethylene, polypropylene, polyvinyl chloride, polyester, polyester glycol, nylon and/or oriented polystyrene. In an alternative embodiment, any suitable shrinkable material known to those skilled in the art and guided by the teachings herein provided is used to fabricate heat-shrink patch 1090. Further, in one embodiment, heat-shrink patch 1090 is transparent. Heat-shrink patch 1090 is movable from an initial, first or pre-shrunk configuration to a second or shrunk configuration having a shorter width and/or shorter length than in the pre-shrunk configuration. For example, heat-shrink patch 1090 is shrinkable to move from the pre-shrunk configuration to the shrunk configuration to move or urge movable side panel 1024 and/or 1026 to the second position. As heat-shrink patch 1090 shrinks, such as by applying suitable heat, void 1088 at least partially closes to move or urge movable side panels 1024 and 1026 with respect to adjacent side panels 1022, 1024, 1026 and/or 1028.

In one embodiment, heat-shrink patch 1090 includes at least one layer of a flexible, heat-shrinkable plastic film having an activated shrink temperature of a least about140° F., and suitably about 150° F. to about 195°F. The film has a gauge thickness of about 50 gauge to about 150 gauge. In one embodiment, the film is formulated with a balanced shrink ratio, or balanced orientation, such that the film shrinks an equal amount in a machine direction or orientation of the film and a cross-machine or transverse direction or orientation of the film. The balanced shrink ratio facilitates a uniform and consistent shrink profile and will not distort printed indicia and/or decorative patterns printed on the film upon the application of heat. Further, the film has a shrink factor of about 10% to about 50% such that the film will shrink in the machine direction and the transverse direction by about 10% to about 50%. In alternative embodiments, the film is formulated with an unbalanced shrink ratio such that the film shrinks to a greater degree in one of the machine direction and the transverse direction. In a particular alternative embodiment, the film has a shrink factor in the machine direction different than a shrink factor in the transverse direction such that the film will shrink in opposite directions by a different percentage of an initial length. In another alternative embodiment, heat-shrink patch 1090 includes a stretched film coupled to interior surface 1021 in a stretched configuration.

In a particular embodiment, heat-shrink patch 1090 is coupled to movable side panel 1024 and movable side panel 1026 along a boundary line or area, generally shown by phantom line 1092 in FIG. 24, which substantially surrounds and/or defines void 1088. Heat-shrink patch 1090 is coupled to interior surface 1021 of blank 1020 at movable side panel 1024 and movable side panel 1026 using any suitable coupling process, such as by applying an adhesive material or an adhesive layer to interior surface 1021 and/or a portion of heat-shrink patch 1090, and applying a suitable pressure to couple heat-shrink patch 1090 to interior surface 1021.

As shown in FIG. 25, carton 1100 is formed from blank 1020 by folding blank 1020 about fold lines 1036, 1038, 1040, 1048, 1058, 1062, 1066, 1070, 1082 and 1086. In one embodiment, an adhesive is applied to portions of blank 1020 to secure carton 1100 together. Top support panels 1056, 1064, and top flaps 1080 form top 1114. Bottom support panels 1060, 1068, and bottom flaps 1084 form bottom 1116. Carton 1100 extends a height 1118 measured between top 1114 and bottom 1116 of carton 1100 along a central longitudinal axis 1120 extending through carton 1100. Once carton 1100 has been formed, and either before, simultaneously with, or after a product is placed within carton 1100, heat-shrink patch 1090 is heat-shrunk to form packaging assembly 1150, as shown in FIG. 26.

Carton 1100 formed from blank 1020 is subjected to a suitable heating process, as described above, to melt heat-shrink patch 1090 causing heat-shrink patch 1090 to shrink without adversely affecting the coupling of heat-shrink patch 1090 to interior surface 1021 of blank 1020. As heat-shrink patch 1090 melts and shrinks, movable side panel 1024 and movable side panel 1026 are moved or urged together to at least partially close void 1088. After the heating process, heat-shrink patch 1090 cools and remains in the shrunk configuration to hold or retain carton 1100 in a substantially fixed second position. In this embodiment, with heat-shrink patch 1090 in the shrunk position, heat-shrink patch 1090 retains movable side panel 1024 and/or movable side panel 1026 in the second position. As shown in FIG. 26, movable side panel 1024 and/or movable side panel 1026 has an arcuate or curved surface in the second position.

In this embodiment, side panel 1024 and/or side panel 1026 is movable between a first position, as shown in FIG. 25, and a second position, as shown in FIG. 26. Accordingly, movement between the first position and the second position varies or changes a cross-sectional area of carton 1100 defined between side panels 1022, 1024, 1026 and 1028 along height 1118 of carton 1100. In a particular embodiment, movable side panel 1024 and/or movable side panel 1026 is biased in the first position, as shown in FIG. 25 using any suitable mechanism, such as a structure of carton 1100. In alternative embodiments, only a portion or section of side panel 1022, 1024, 1026 and/or 1028 is movable between the first position and the second position.

In one embodiment, heat-shrink patch 1090 at least partially seals carton 1100 to protect a product contained within the carton from tampering, as well as protecting the product from contamination. Heat-shrink patch 1090 can be used, for example, to replace bags or liners sometimes used within a container for sealing a product. Further, heat-shrink patch 1090 maintains a shape of carton 1100 for example, to facilitate displaying, stacking and/or arranging carton 1100 or a plurality of cartons, and/or maintaining the carton shape.

Further, heat-shrink patch 1090 facilitates forming of carton 1100, and more specifically moving or urging moveable side panels 1024, 1026 from the first position, as shown in FIG. 25, to the second position to form packaging assembly 1150, as shown in FIG. 26. As described above, cartons having shapes that are more complex than conventional rectangular cartons may be difficult and therefore costly to manufacture. As heat-shrink patch 1090 is heated and shrinks, heat-shrink patch 1090 moves, draws or urges movable side panels 1024, 1026 to the second position to form a shape of packaging assembly 1150. Heat-shrink patch 1090 holds side panels 1024, 1026 in the second position. In one embodiment wherein movable side panels 1024, 1026 are biased to the first position, heat-shrink patch 1090 moves the movable side panels to, and holds the movable side panels in, the second position against the bias. By moving and holding movable side panels 1024 and 1026 in the second position, heat-shrink patch 1090 forms a shape of packaging assembly 1150, and more specifically carton 1100, that may be otherwise difficult and costly to form.

Figure 27:
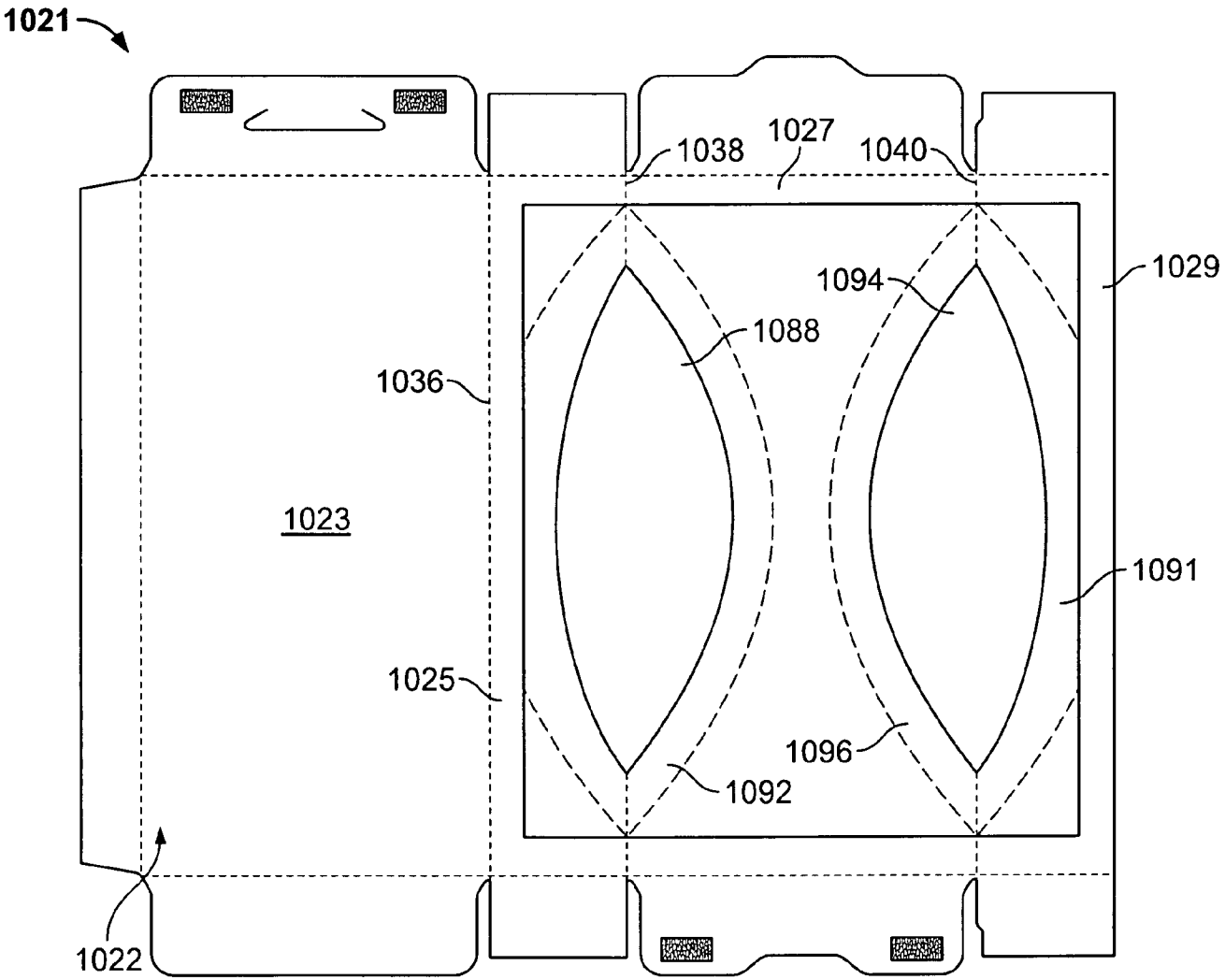
FIG. 27 is a top plan view of a blank of sheet material for forming a carton, according to one embodiment of this invention.
Figure 28:
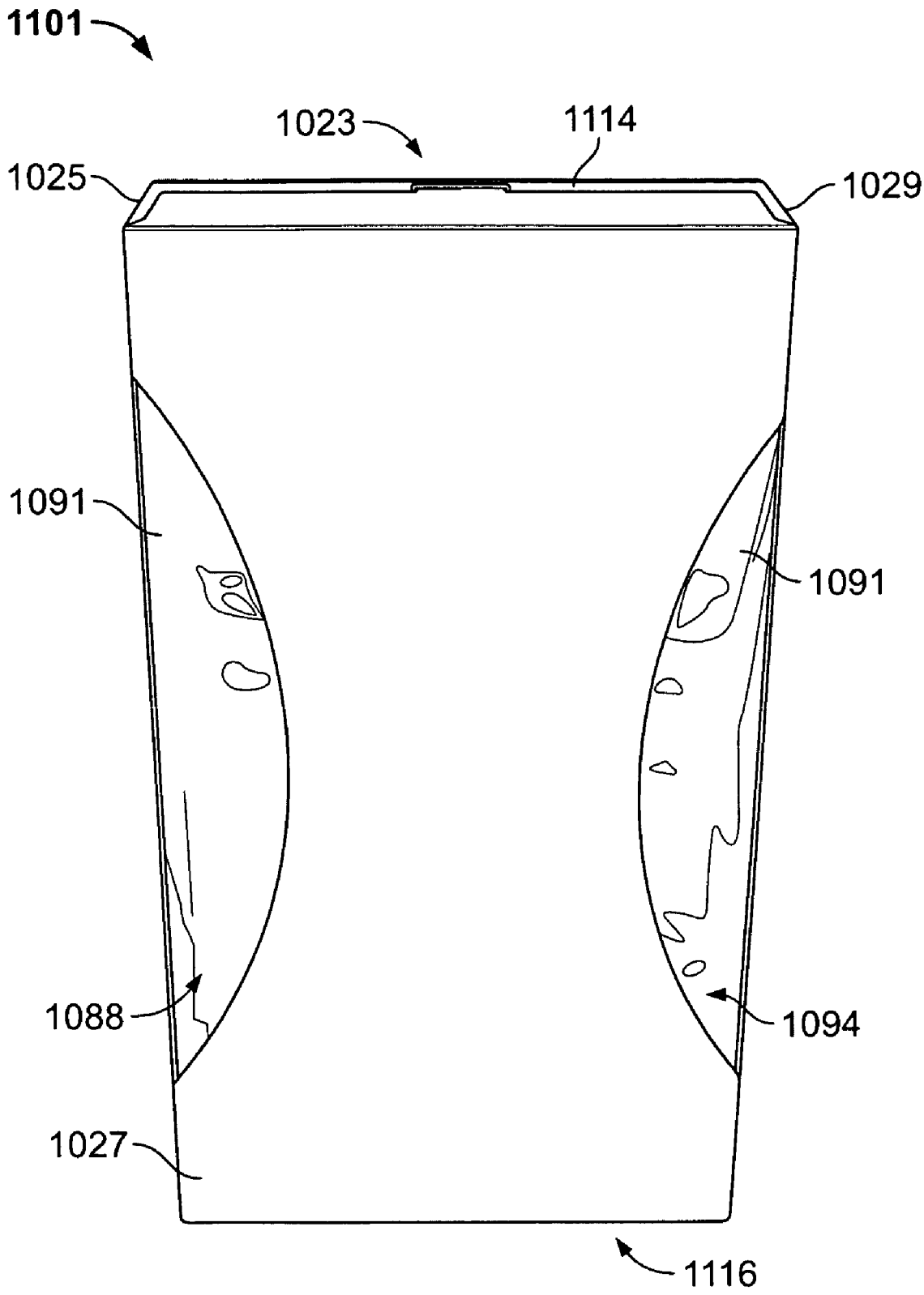
FIG. 28 is a perspective view of the carton formed from the blank shown in FIG. 27.
Figure 29:
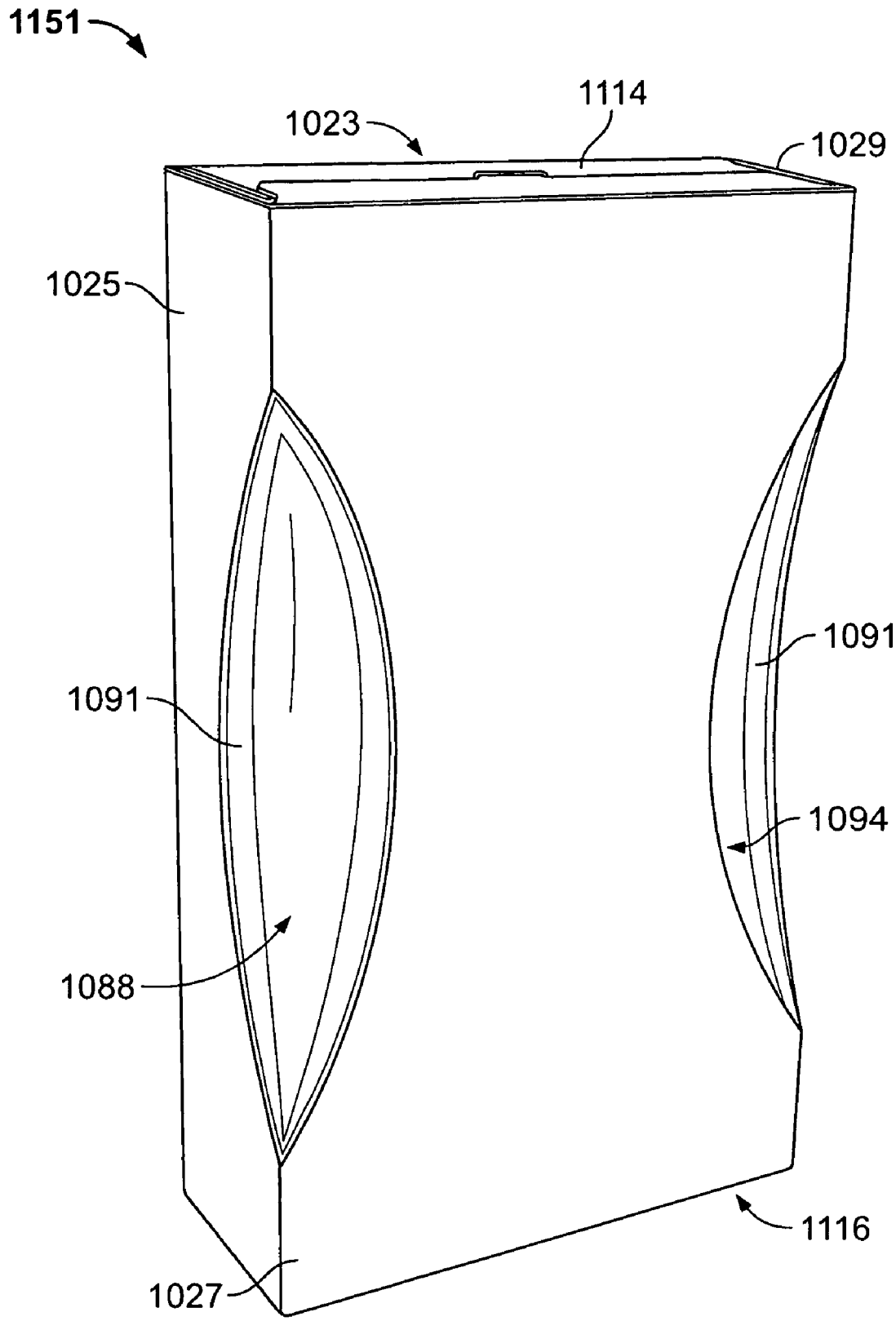
FIG. 29 is a perspective view of a packaging assembly including the carton shown in FIG. 28.

FIGS. 27-29 show a packaging assembly according to an alternative embodiment. Specifically, FIG. 27 is a top plan view of blank of sheet material 1021. FIG. 28 is a perspective view of carton 1101 formed from blank 1021. FIG. 29 is a perspective view of packaging assembly 1151 including carton 1101 formed from blank 1021. Several element reference numbers shown in FIGS. 27-29 are used to indicate an element or a component that is identical to the corresponding element or component described above and shown in FIGS. 24-26. In this embodiment, an additional void is defined by blank 1021, as described below.

Referring to FIG. 27, in this embodiment, blank 1021 has an interior surface 1022 and an opposing exterior surface. Blank 1021 includes a succession of side panels 1023, 1025, 1027 and 1029 that are connected together by a plurality of preformed, generally parallel, fold lines 1036, 1038 and 1040, respectively. Side panels 1023, 1025, 1027 and 1029 extend from an adjacent side panel along respective fold lines 1036, 1038 and 1040. Side panel 1023, 1025, 1027 and/or 1029 is movable between a first position and a second position. Each movable side panel 1023, 1025, 1027 and/or 1029 defines at least a portion of a void at a first fold line and at least a portion of a void at a second fold line opposing the first fold line. As shown in FIGS. 27-29, blank 1021 includes three movable side panels, namely side panel 1025, side panel 1027 and side panel 1029. Movable side panel 1025 defines a portion of void 1088 along fold line 1038. Movable side panel 1027 defines a remaining portion of void 1088 on a first side edge of movable side panel 1027 along fold line 1038. Further, an opposing second side edge of movable side panel 1027 defines a portion of a second void 1094 along fold line 1040. Movable side panel 1029 defines a remaining portion of void 1094 along fold line 1040.

Heat-shrink patch 1091 covers void 1088 and void 1094. Heat-shrink patch 1091 is coupled to movable side panel 1025 and movable side panel 1027 along boundary line or area, generally shown by phantom line 1092 in FIG. 27, which substantially surrounds and/or defines void 1088. Further, heat-shrink patch 1091 is coupled to movable side panel 1027 and movable side panel 1029 along a boundary line or area, generally shown by phantom line 1096 in FIG. 27, which substantially surrounds and/or defines void 1094. In an alternative embodiment, heat-shrink patch 1091 is coupled to movable side panel 1025 and movable side panel 1027 along boundary area 1092 to cover first void 1088 and a second heat-shrink patch (not shown) is coupled to movable side panel 1027 and movable side panel 1029 along boundary area 1096 to cover second void 1094. Heat-shrink patch 1091 is coupled to interior surface 1022 of blank 1021 at movable side panel 1025, movable side panel 1027 and movable side panel 1029 using any suitable coupling process.

In this embodiment, carton 1101 formed from blank 1021, as shown in FIG. 28, is subjected to a suitable heating process to initiating melting and shrinkage of heat-shrink patch 1091 without adversely affecting the coupling of heat-shrink patch 1091 to interior surface 1022 of blank 1021. As heat-shrink patch 1091 melts and shrinks, movable side panel 1025 and movable side panel 1027 are moved or urged together to at least partially close void 1088, and movable side panel 1027 and movable side panel 1029 are moved or urged together to at least partially close void 1094. After the heating process, heat-shrink patch 1091 cools and remains in the shrunk configuration to hold or retain carton 1101 in a substantially fixed second position. With heat-shrink patch 1091 in the shrunk position, heat-shrink patch 1091 retains movable side panel 1025, movable side panel 1027 and/or movable side panel 1029 in the second position. As shown in FIG. 29, movable side panel 1025, movable side panel 1027 and/or movable side panel 1029 has an arcuate or curved surface in the second position.

Figure 30:
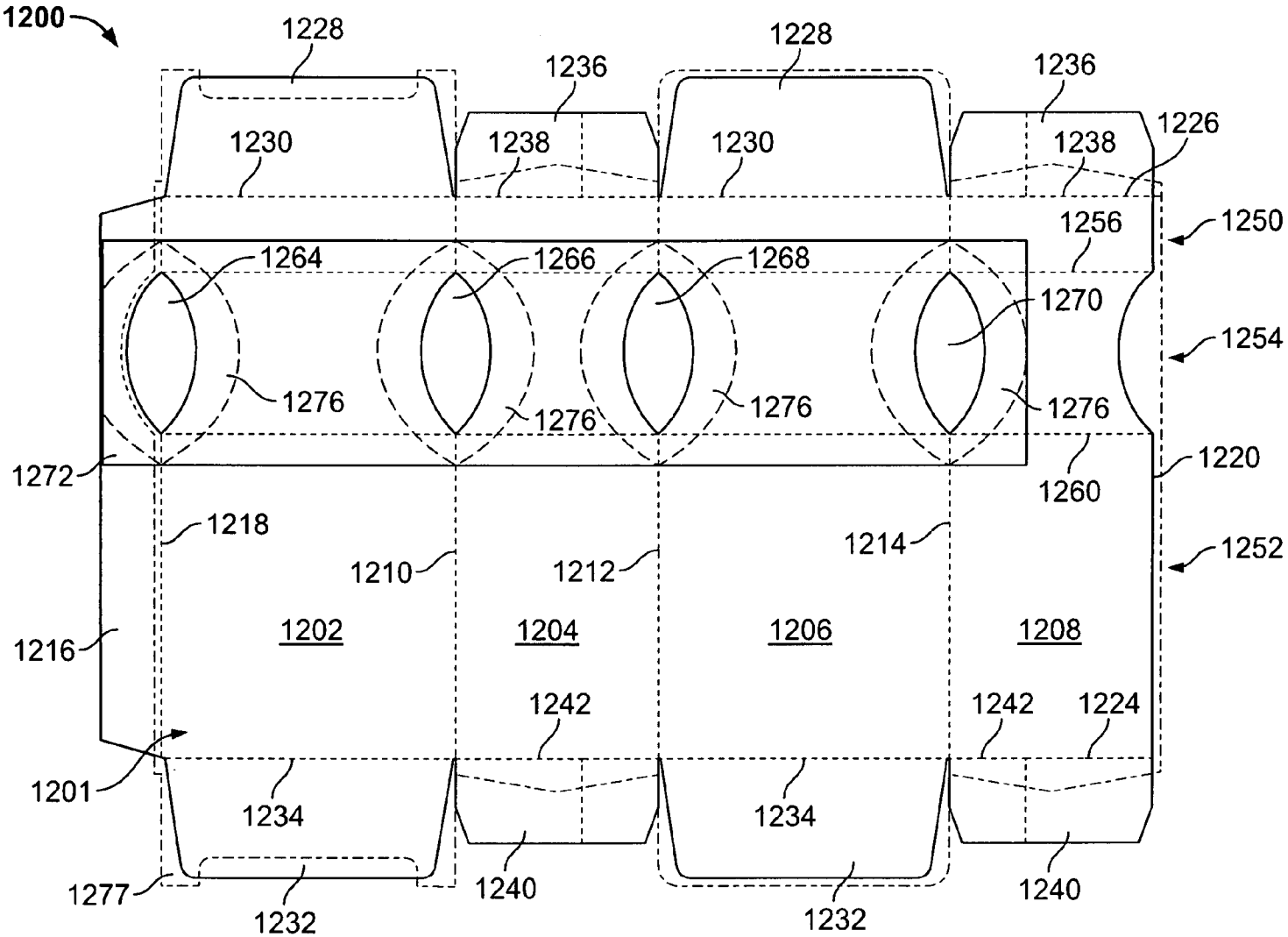
FIG. 30 is a top plan view of a blank of sheet material for forming a carton, according to one embodiment of this invention.
Figure 31:
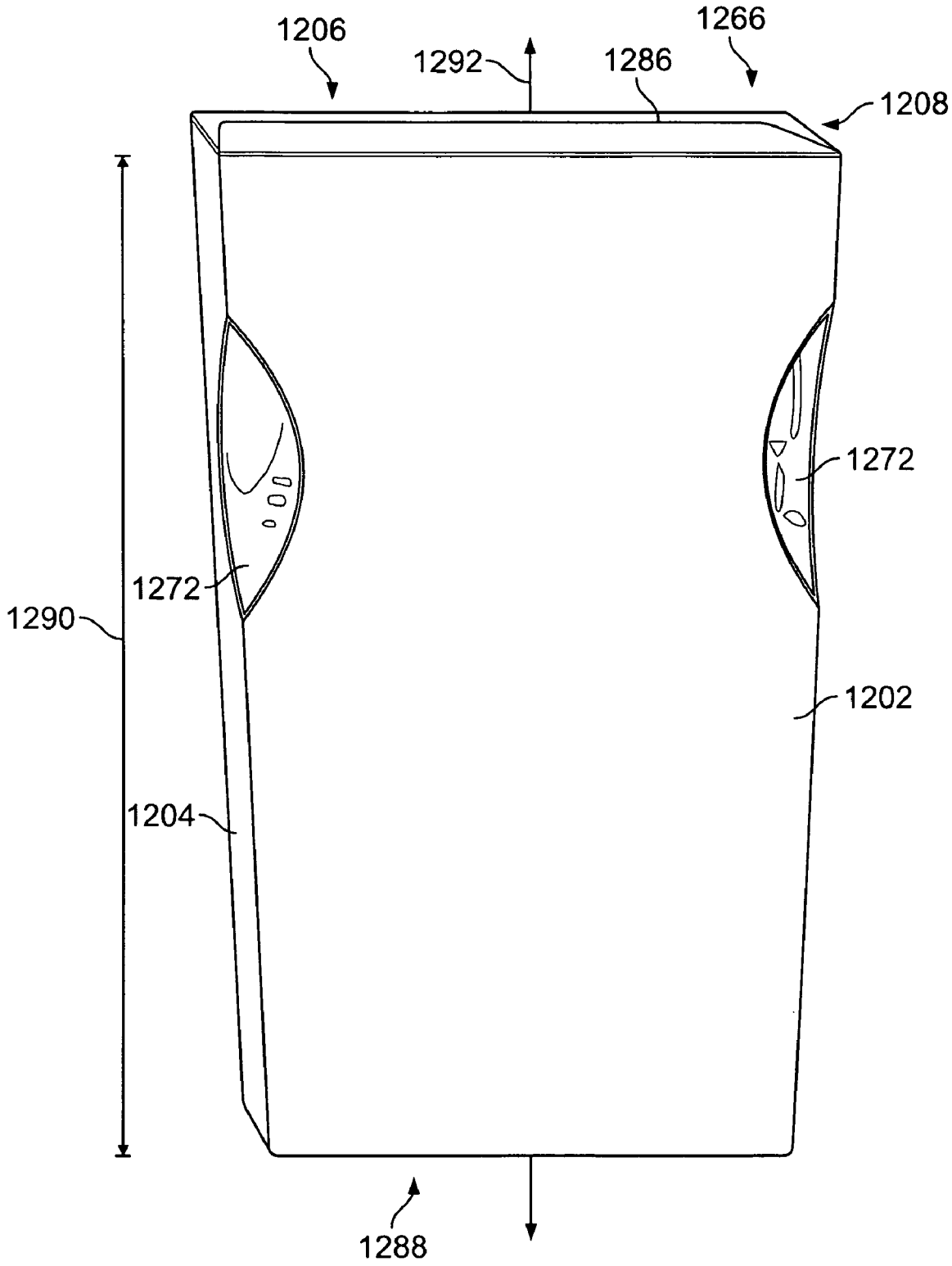
FIG. 31 is a perspective view of the carton formed from the blank shown in FIG. 30.
Figure 32:
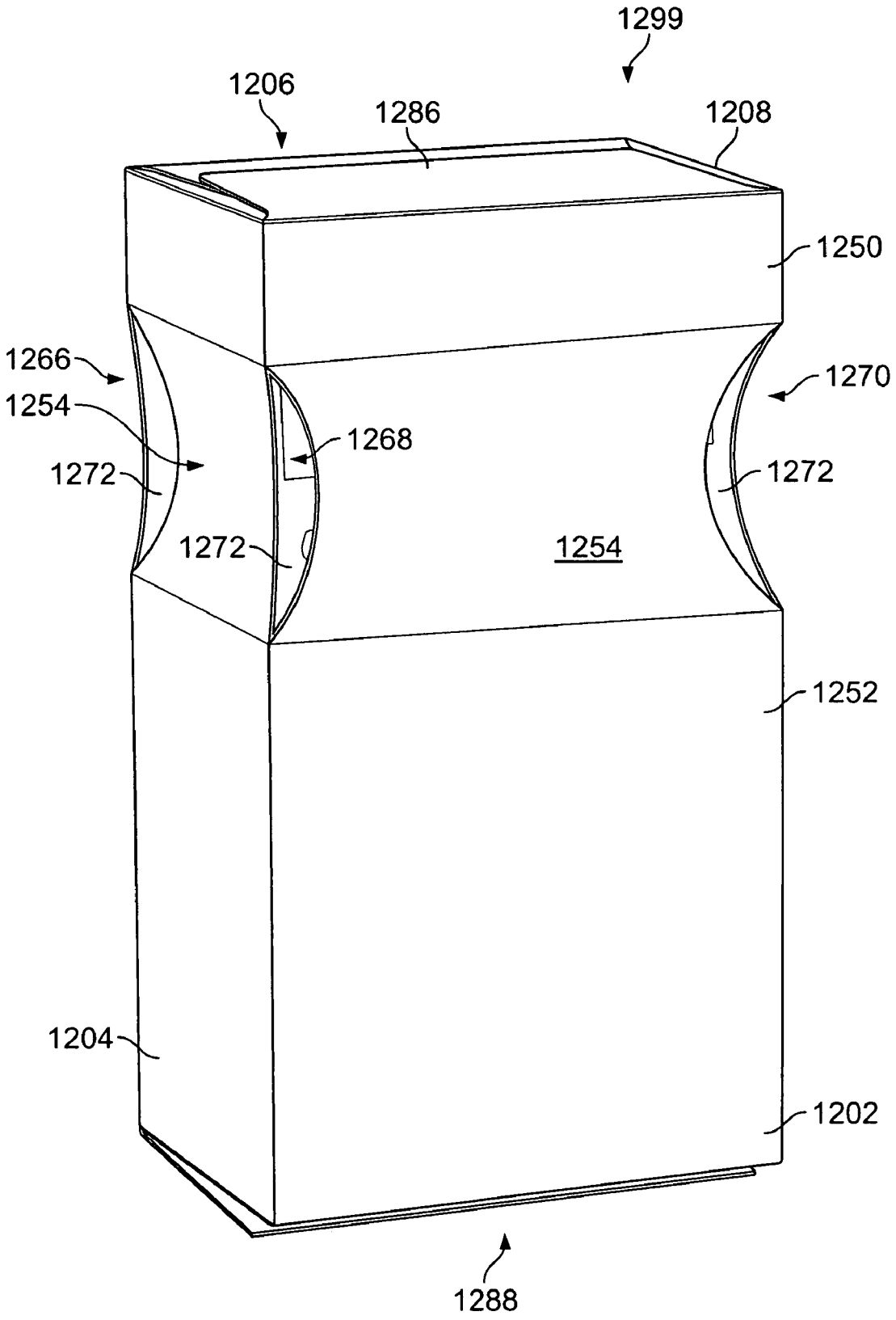
FIG. 32 is a perspective view of a packaging assembly including the carton shown in FIG. 31.

FIGS. 30-32 show a packaging assembly according to one embodiment. Specifically, FIG. 30 is a top plan view of a blank of sheet material 1200. FIG. 31 is a perspective view of a carton 1266 formed from blank 1200 shown in FIG. 30. FIG. 32 is a perspective view of a packaging assembly 1299 including carton 1266 shown in FIG. 31.

As shown in FIG. 30, in one embodiment, blank 1200 has an interior surface 1201 and an opposing exterior surface. Blank 1200 includes a succession of four side panels 1202, 1204, 1206 and 1208 that are connected together by a plurality of preformed, generally parallel, fold lines 1210, 1212 and 1214, respectively. Each side panel 1202, 1204, 1206 and 1208 extends from an adjacent side panel along respective fold lines 1210, 1212 and 1214. A side panel flap 1216 extends from an end portion of side panel 1202 along fold line 1218 to secure side panel flap 1216 to side panel 1208 to form carton 1266, as shown in FIG. 31. In an alternative embodiment, a side panel flap (not shown) extends from an end portion 1220 of side panel 1208 to secure the side panel flap to side panel 1202 to form carton 1266. Each side panel 1202, 1204, 1206 and 1208 extends a height measured between a bottom end 1224 and a top end 1226.

A top support panel 1228 extends from side panel 1202 and/or side panel 1206 at top end 1226 along a fold line 1230. Similarly, a bottom support panel 1232 extends from side panel 1202 and/or side panel 1206 at bottom end 1224 along a fold line 1234. In one embodiment, a top flap 1236 extends from side panel 1204 and/or side panel 1208 along a fold line 1238 and/or a bottom flap 1240 extends from side panel 1204 and/or side panel 1208 at bottom end 1224 along a fold line 1242. In one embodiment, adhesive is applied to top support panels 1228, bottom support panels 1232, top flaps 1236 and/or bottom flaps 1240 to connect the respective panels. In an alternative embodiment, one top support panel 1228 includes an extension or tab (not shown) that extends therefrom for engagement with a slot (not shown) formed within the other top support panel 1228 to secure top support panels 1228 together to form a top 1286 of carton 1266, as shown in FIG. 31. Similarly, one bottom support panels 1232 includes an extension or tab (not shown) that extends therefrom for engagement with a slot (not shown) within the other bottom support panel 1232 to secure bottom support panels 1232 together to form a bottom 1288 of carton 1266, as shown in FIG. 31. In another alternative embodiment, top support panels 1228 and bottom support panels 1232 are connected together using hook-and-loop fasteners (not shown), as described above. It is apparent to those skilled in the art and guided by the teachings herein provided that any suitable connecting mechanism can be used to connected top support panels 1228 together and/or bottom support panels 1232 together.

Referring to FIGS. 30-32, side panel 1202, 1204, 1206 and/or 1208, or at least a portion thereof, is movable between an initially biased first position and a second position having an arcuate or curved surface. As shown in FIG. 30, in one embodiment, each side panel 1202, 1204, 1206 and 1208 includes an upper panel portion 1250, a lower panel portion 1252 and an intermediate panel portion 1254 extending between and connecting upper panel portion 1250 and lower panel portion 1252. Intermediate panel portion 1254 is connected to upper panel portion 1250 along a fold line 1256 and to lower panel portion 1252 along a fold line 1260. In this embodiment, intermediate panel portion 1254 is movable from the initially biased first position to the second position having an arcuate or curved surface. As shown in FIG. 30, a void is defined between adjacent intermediate panel portions 1254 to accommodate changing a cross-sectional area of carton 1266, as described below.

As shown in FIG. 30, movable side panel 1202 partially defines a first void 1264 along a first side edge corresponding to fold line 1218 and partially defines a second void 1266 along a second side edge corresponding to fold line 1210. Side panel flap 1216, connected to movable side panel 1202 along fold line 1218, defines a remaining portion of first void 1264. Movable side panel 1204, connected to movable side panel 1202 along fold line 1210, defines a remaining portion of second void 1266 and partially defines a third void 1268 along a second side edge corresponding to fold line 1212. Movable side panel 1206, connected to movable side panel 1204 along fold line 1212, defines a remaining portion of third void 1268 and partially defines a fourth void 1270 along a second side edge corresponding to fold line 1214. Movable side panel 1208, connected to movable side panel 1206 along fold line 1214, defines a remaining portion of fourth void 1270. In one embodiment, moveable side panel 1208 further defines an arcuate portion that generally corresponds to the remaining portion of first void 1264 defined by side panel flap 1216 when carton 1266 is assembled.

A heat-shrink patch 1272 is coupled to interior surface 1201 of blank 1200 to cover each void 1264, 1266, 1268 and 1270. In a particular embodiment, heat-shrink patch 1272 is coupled to side panel flap 1216, movable side panel 1202, movable side panel 1204, movable side panel 1206 and movable side panel 1208 along a boundary line or area, generally shown by phantom line 1276, which substantially surrounds and/or define voids 1264, 1266, 1268 and 1270. Heat-shrink patch 1272 is coupled to interior surface 1201 of blank 1200 at side panel flap 1216 and movable intermediate panel portions 1254 of side panels 1202, 1204, 1206 and 1208, using any suitable coupling process, such as by applying an adhesive material or an adhesive layer to interior surface 1201 within boundary area 1276 and/or a portion of heat-shrink patch 1272, and applying a suitable pressure to couple heat-shrink patch 1272 to interior surface 1201. In an alternative embodiment, a heat-shrink layer, generally shown by phantom line 1277 in FIG. 30, is applied to the exterior surface of blank 1200, opposing interior surface 1201.

As shown in FIG. 31, carton 1266 is formed from blank 1200 by folding blank 1200 about fold lines 1210, 1212, 1214, 1218, 1230, 1234, 1238 and 1242. In one embodiment, an adhesive may be applied to portions of blank 1200 to secure carton 1266 together. Top support panels 1228 and top flaps 1236 form top 1286 of carton 1266, and bottom support panels 1232 and bottom flaps 1240 form bottom 1288 of carton 1266. Carton 1266 extends a height 1290 measured between top 1286 and bottom 1288 of carton 1266 along a central longitudinal axis 1292 extending through carton 1266. As shown in FIG. 31, in a first or pre-shrunk configuration, carton 1266 has a generally rectangular cross-sectional shape. Once carton 1266 has been formed, and either before, simultaneously with, or after a product is placed within carton 1266, heat-shrink patch 1272 is heat-shrunk to form packaging assembly 1299, as shown in FIG. 32.

In one embodiment, carton 1266 formed from blank 1200 is subjected to a suitable heating process, as described above, to melt heat-shrink patch 1272 causing heat-shrink patch 1272 to shrink without adversely affecting the coupling of heat-shrink patch 1272 to interior surface 1201. As heat-shrink patch 1272 melts and shrinks, intermediate panel portion 1254 of side panel flap 1216 and intermediate panel portion 1254 of movable side panels 1202, 1204, 1206 and 1208 are moved or urged to the second position to at least partially close corresponding voids 1264, 1266, 1268 and 1270. After the heating process, heat-shrink patch 1272 cools and remains in the shrunk configuration to hold or retain carton 1266 in a substantially fixed second position. In this embodiment, with heat-shrink patch 1272 in the shrunk position, heat-shrink patch 1272 retains intermediate panel portion 1254 of movable side panel 1202, 1204, 1206 and/or 1208 in the second position. As shown in FIG. 32, intermediate panel portion 1254 has an arcuate or curved surface in the second position.

Accordingly, movement between the first position and the second position varies or changes a cross-sectional area of carton 1266 defined between side panels 1202, 1204, 1206 and 1208 along height 1290 of carton 1266. In a particular embodiment, each movable side panel 1202, 1204, 1206 and 1208 is biased in the first position, as shown in FIG. 31. In this embodiment, movable side panel 1202, 1204, 1206 and/or 1208 may be biased in the first position using any suitable mechanism, such as a structure of carton 1266 biasing movable side panels 1202, 1204, 1206 and/or 1208. In alternative embodiments, only a portion or section of side panel 1202, 1204, 1206 and/or 1208 is movable between the first position and the second position, such as intermediate panel portions 1254.

Figure 33:
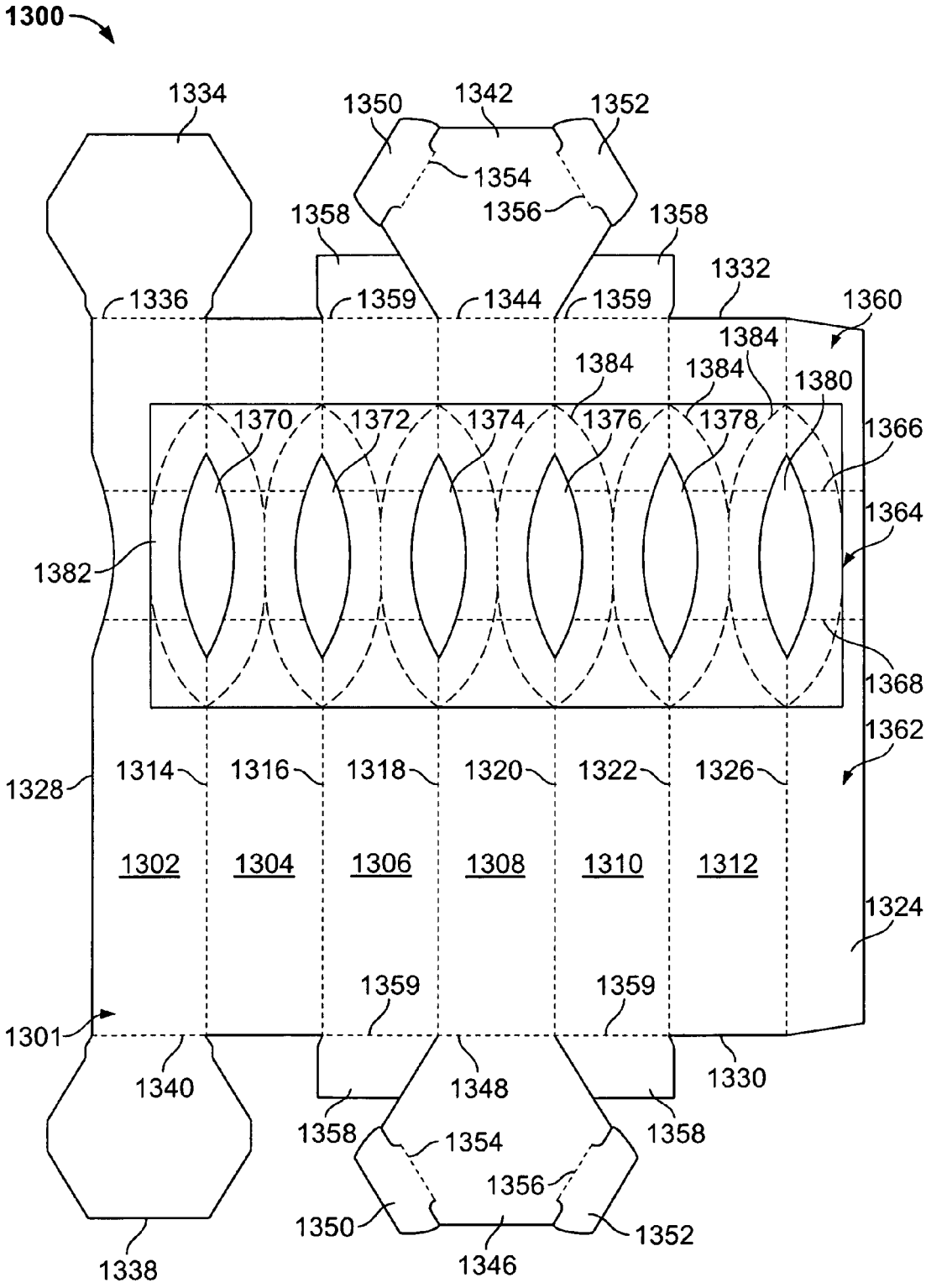
FIG. 33 is a top plan view of a blank of sheet material for forming a carton, according to one embodiment of this invention.
Figure 34:
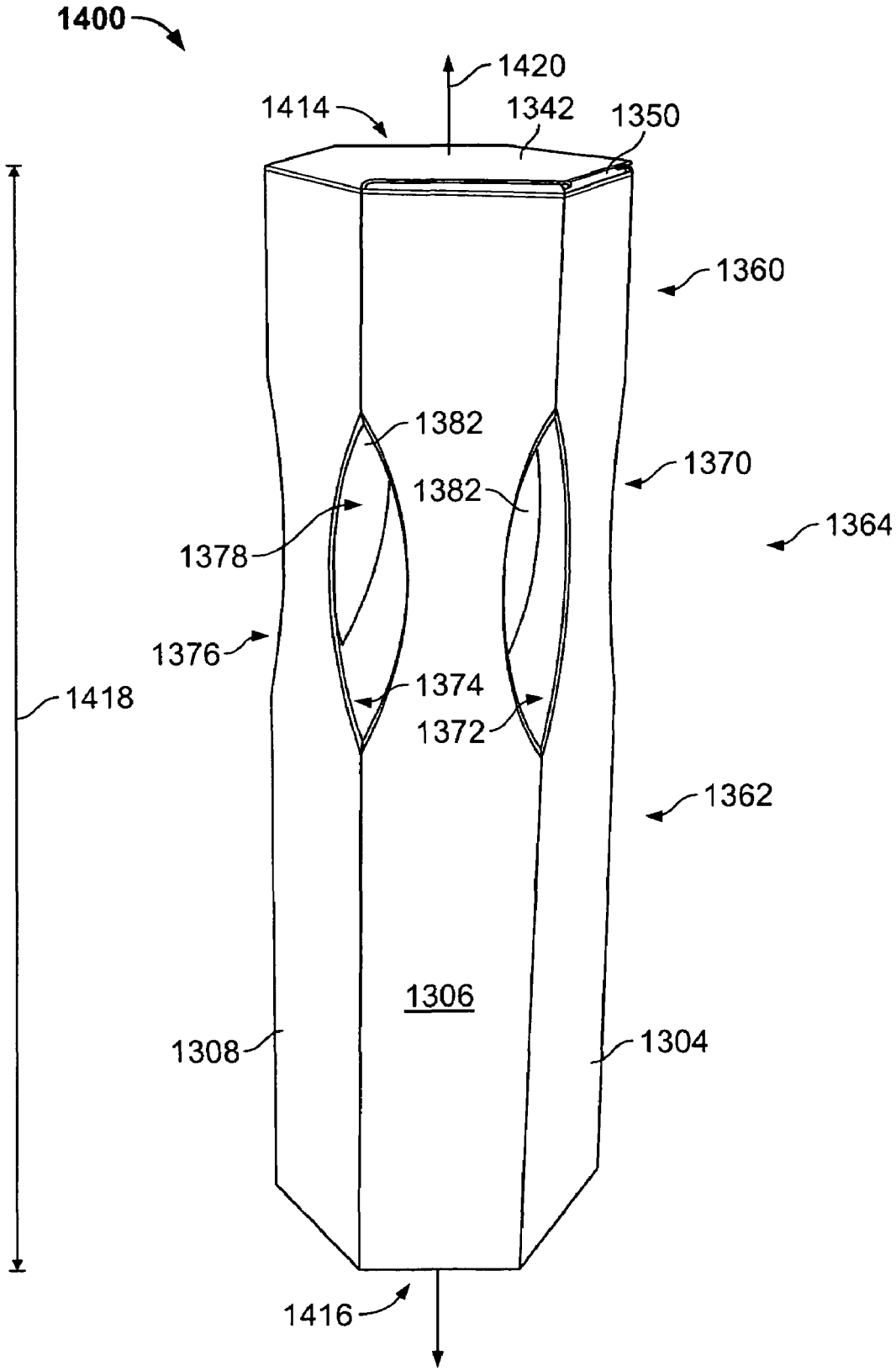
FIG. 34 is a perspective view of the carton formed from the blank shown in FIG. 33.
Figure 35:
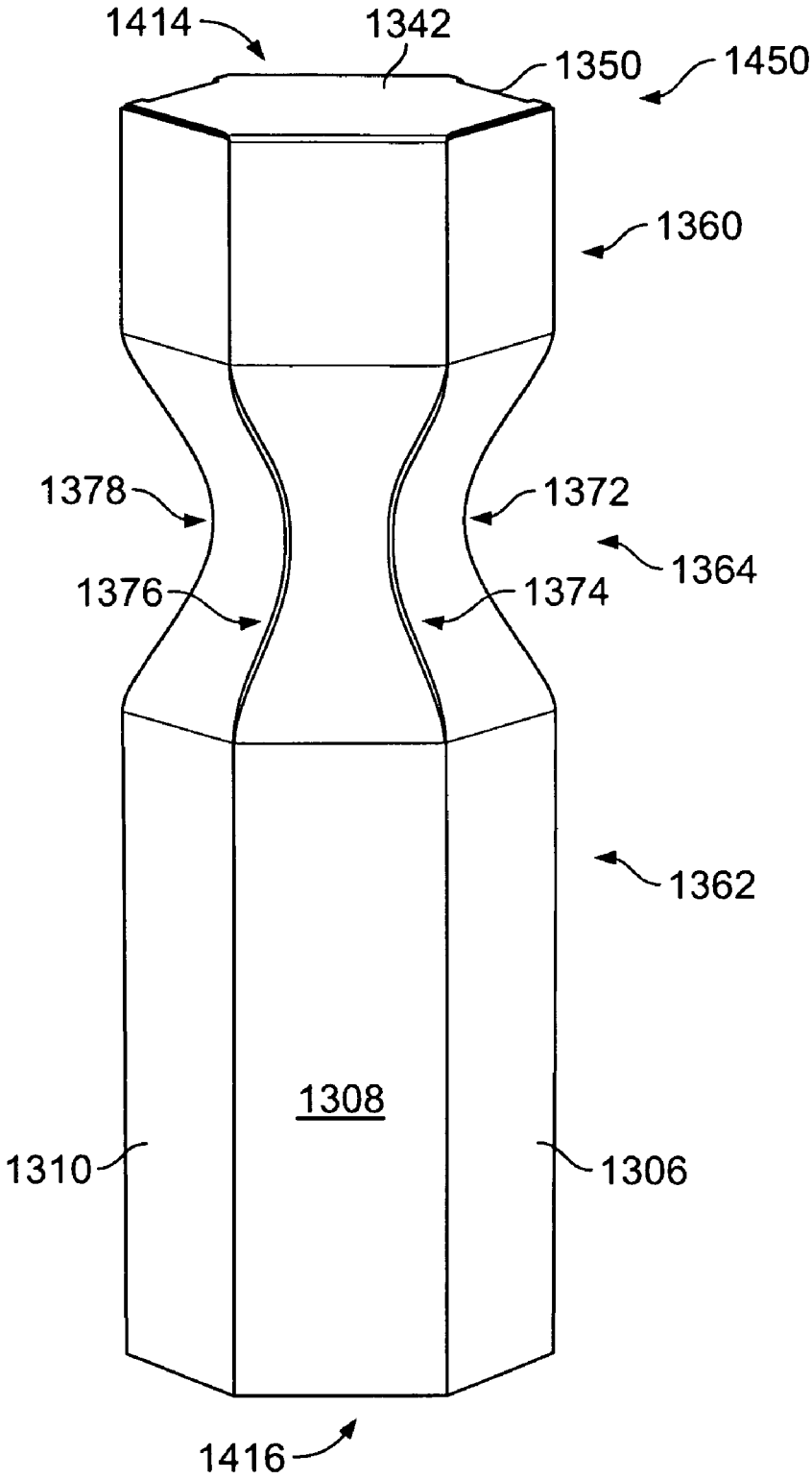
FIG. 35 is a perspective view of a packaging assembly including the carton shown in FIG. 34.

FIGS. 33-35 show a packaging assembly according to one embodiment. Specifically, FIG. 33 is a top plan view of a blank of sheet material 1300. FIG. 34 is a perspective view a carton 1400 formed from blank 1300 shown in FIG. 33. FIG. 35 is a perspective view of a packaging assembly 1450 including carton 1400 shown in FIG. 34.

Referring to FIG. 33, in one embodiment, blank 1300 has an interior surface 1301 and an opposing exterior surface. Blank 1300 includes a succession of six side panels 1302, 1304, 1306, 1308, 1310 and 1312 that are connected together by a plurality of preformed, generally parallel, fold lines 1314, 1316, 1318, 1320 and 1322, respectively. Each side panel 1302, 1304, 1306, 1308, 1310 and 1312 extends from an adjacent side panel along respective fold lines 1314, 1316, 1318, 1320 and 1322. A side panel flap 1324 extends from an end portion of side panel 1312 along fold line 1326 to secure side panel flap 1324 to side panel 1302 to form carton 1400, as shown in FIG. 34. In an alternative embodiment, a side panel flap (not shown) extends from edge 1328 of side panel 1302 to secure the side panel flap to side panel 1312 to form carton 1400. Each side panel 1302, 1304, 1306, 1308, 1310 and 1312 extends a height measured between a bottom end 1330 and a top end 1332 of blank 1300.

A top support panel 1334 extends from side panel 1302 at top end 1332 along a fold line 1336 and a bottom support panel 1338 extends from side panel 1302 at bottom end 1330 along a fold line 1340. Additionally, a top support panel 1342 extends from side panel 1308 at top end 1332 along a fold line 1344 and a bottom panel 1346 extends from side panel 1308 at bottom end 1330 along a fold line 1348. Top support panel 1342 and bottom support panel 1346 include two securement tabs 1350 and 1352 extending therefrom along respective fold lines 1354 and 1356 for facilitating securing top support panel 1342 and bottom support panel 1346 to side panels 1302, 1304, 1306, 1308, 1310 and 1312 to form a top 1414 and a bottom 1416 of carton 1400, respectively, as shown in FIG. 34. In one embodiment, a tab 1358 extends from side panel 1306 and/or side panel 1310 at top end 1332 and/or bottom end 1330 along a fold line 1359 for mating with securement tabs 1350 or 1352 to form carton 1400. In an alternative embodiment, any suitable connecting mechanism is used to secure top support panels 1334, 1342 and/or bottom support panels 1338 and/or 1346 to side panels 1302, 1304, 1306, 1308, 1310 and/or 1312 to form carton 1400.

Referring to FIGS. 33-35, side panel 1302, 1304, 1306, 1308, 1310 and/or 1312, or at least a portion thereof, is movable between an initially biased first position and a second position having an arcuate or curved surface. As shown in FIG. 33, each side panel 1302, 1304, 1306, 1308, 1310 and 1312 includes an upper panel portion 1360, a lower panel portion 1362 and an intermediate panel portion 1364 extending between and connecting upper panel portion 1360 and lower panel portion 1362. Intermediate panel portion 1364 is connected to upper panel portion 1360 along a fold line 1366 and to lower panel portion 1362 along a fold line 1368. In this embodiment, intermediate panel portion 1364 is movable from the initially biased first position to the second position having an arcuate or curved surface. As shown in FIG. 33, a void is defined between adjacent intermediate panel portions 1364 to accommodate changing a cross-sectional area of carton 1400, as described below.

Referring further to FIG. 33, in one embodiment, intermediate panel portions 1364 of side panels 1302, 1304, 1306, 1308, 1310 and 1312 are movable between the initially biased first position and the second position. In this embodiment, movable side panel 1302 defines an arcuate portion along edge 1328 that generally corresponds to a portion of void 1380 when carton 1400 is assembled. Movable side panel 1302 partially defines a first void 1370 along a second side edge corresponding to fold line 1314. Movable side panel 1304, connected to movable side panel 1302 along fold line 1314, defines a remaining portion of first void 1370 and partially defines a second void 1372 along a second side edge corresponding to fold line 1316. Movable side panel 1306, connected to movable side panel 1304 along fold line 1316, defines a remaining portion of second void 1372 and partially defines a third void 1374 along a second side edge corresponding to fold line 1318. Movable side panel 1308, connected to movable side panel 1306 along fold line 1318, defines a remaining portion of third void 1374 and partially defines a fourth void 1376 along a second side edge corresponding to fold line 1320. Movable side panel 1310, connected to movable side panel 1308 along fold line 1320, defines a remaining portion of fourth void 1376 and partially defines a fifth void 1378 along a second side edge corresponding to fold line 1322. Movable side panel 1312, connected to movable side panel 1310 along fold line 1322, defines a remaining portion of fifth void 1378 and partially defines a sixth void 1380 along a second side edge corresponding to fold line 1326. Side panel flap 1324, connected to movable side panel 1312 along fold line 1326, defines a remaining portion of sixth void 1380.

A heat-shrink patch 1382 is coupled to interior surface 1301 of blank 1300 to cover each void 1370, 1372, 1374, 1376, 1378 and 1380. In a particular embodiment, heat-shrink patch 1382 is coupled to each movable side panel 1302, 1304, 1306, 1308, 1310 and 1312, and movable side panel flap 1324, along a boundary line or area, generally shown by phantom line 1384, which substantially surrounds and/or defines voids 1370, 1372, 1374, 1376, 1378 and 1380. Heat-shrink patch 1382 is coupled to interior surface 1301 of blank 1300 at each movable side panel 1302, 1304, 1306, 1308, 1310 and 1312, and movable side panel flap 1324, using any suitable coupling process, such as by applying an adhesive material or an adhesive layer to interior surface 1301 and/or a portion of heat-shrink patch 1382, and applying a suitable pressure to couple heat-shrink patch 1382 to interior surface 1301.

As shown in FIG. 34, carton 1400 is formed from blank 1300 by folding blank 1300 about fold lines 1314, 1316, 1318, 1320, 1322, 1326, 1336, 1340, 1344, 1348, 1354, 1356 and 1359. In one embodiment, an adhesive is applied to portions of blank 1300 to secure carton 1300 together. Top support panels 1334, 1342 form a top 1414 of carton 1400, and bottom support panels 1338, 1346 form a bottom 1416 of carton 1400. Carton 1400 extends a height 1418 measured between top 1414 and bottom 1416 of carton 1400 along a central longitudinal axis 1420 extending through carton 1400. As shown in FIG. 34, in a first or pre-shrunk configuration, carton 1400 includes a generally hexagonal cross-sectional shape extending generally perpendicularly to central longitudinal axis 1420. Once carton 1400 has been formed, and either before, simultaneously with, or after a product is placed within carton 1400, heat-shrink patch 1382 is heat-shrunk to form packaging assembly 1450, as shown in FIG. 35.

In one embodiment, carton 1400 is subjected to a suitable heating process, as described above, to melt heat-shrink patch 1382 causing heat-shrink patch 1382 to shrink without adversely affecting the coupling of heat-shrink patch 1382 to interior surface 1301. As heat-shrink patch 1382 melts and shrinks, movable intermediate panel portion 1364 of side panel 1302, 1304, 1306, 1308, 1310 and/or 1312, and movable side panel flap 1324, are moved or urged to the second position to at least partially close corresponding void 1370, 1372, 1374, 1376, 1378, and/or 1380. After the heating process, heat-shrink patch 1382 cools and remains in the shrunk configuration to hold or retain carton 1400 in a substantially fixed second position. In this embodiment, with heat-shrink patch 1382 in the shrunk position, heat-shrink patch 1382 retains movable intermediate panel portion 1364 of side panel 1302, 1304, 1306, 1308, 1310 and/or 1312 in the second position. As shown in FIG. 35, movable intermediate panel portion 1364 an arcuate or curved surface in the second position.

Referring further to FIGS. 34 and 35, at least a portion of intermediate panel portion 1364 extends between fold line 1366 and fold line 1368 such that intermediate portion 1364 is movable between the first position and the second position. Accordingly, movement between the first position and the second position varies or changes a cross-sectional area of carton 1400 defined between side panels 1302, 1304, 1306, 1308, 1310 and 1312 along height 1418 of carton 1400. In a particular embodiment, each movable side panel 1302, 1304, 1306, 1308, 1310 and 1312 including movable intermediate panel portion 1364 is biased in the first position, as shown in FIG. 34. Movable side panel 1302, 1304, 1306, 1308, 1310 and/or 1312 is biased in the first position using any suitable mechanism, such as a structure of carton 1400 biasing movable side panels 1302, 1304, 1306, 1308, 1310 and/or 1312. In this embodiment, a portion of upper panel portion 1360 and/or a portion of lower panel portion 1362 may also move with intermediate portion 1364, depending upon whether the corresponding void extends past fold line 1366 towards top end 1332 and/or past fold line 1368 towards bottom end 1330.

Figure 36:
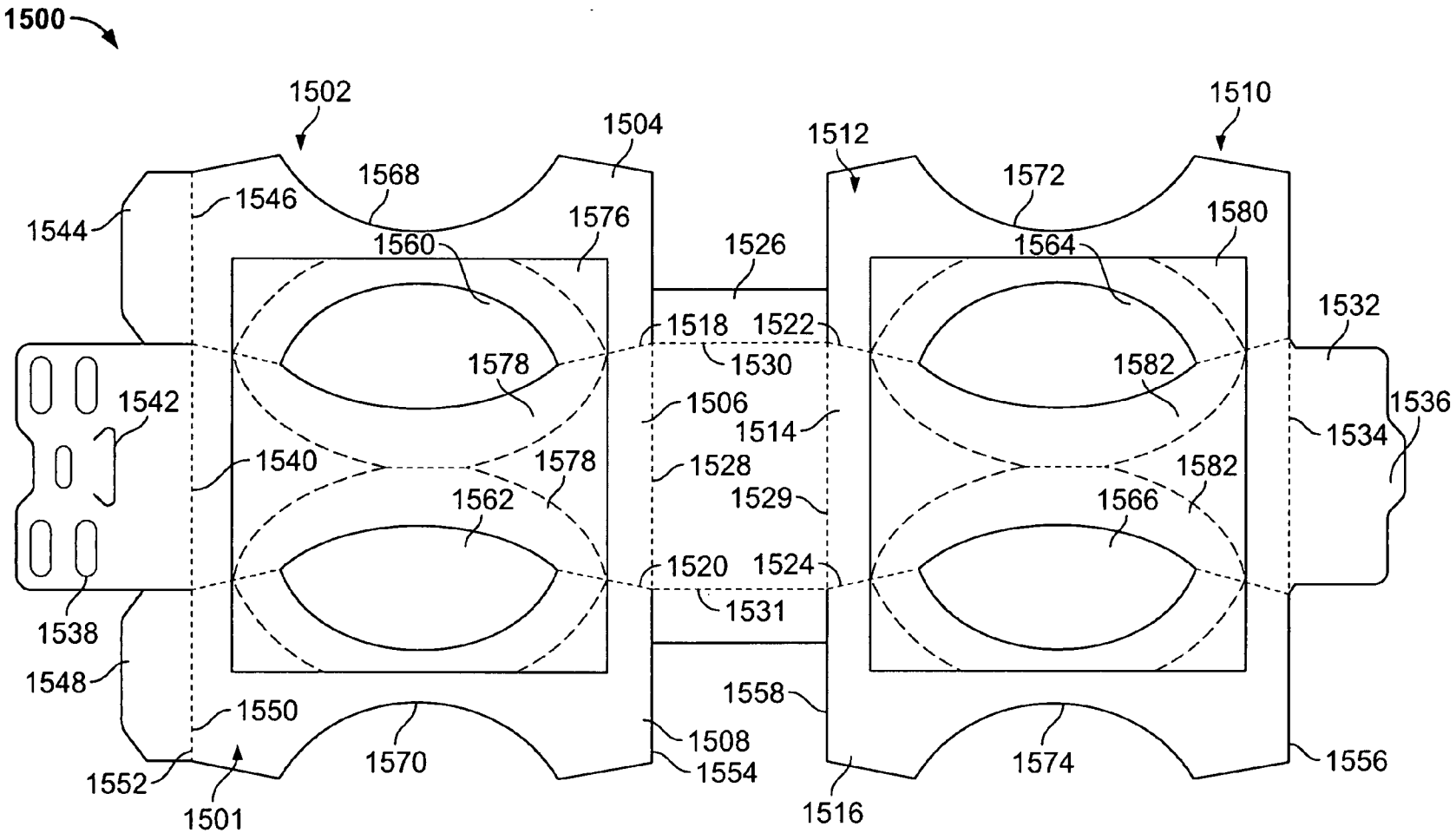
FIG. 36 is a top plan view of a blank of sheet material for forming a carton, according to one embodiment of this invention.
Figure 37:
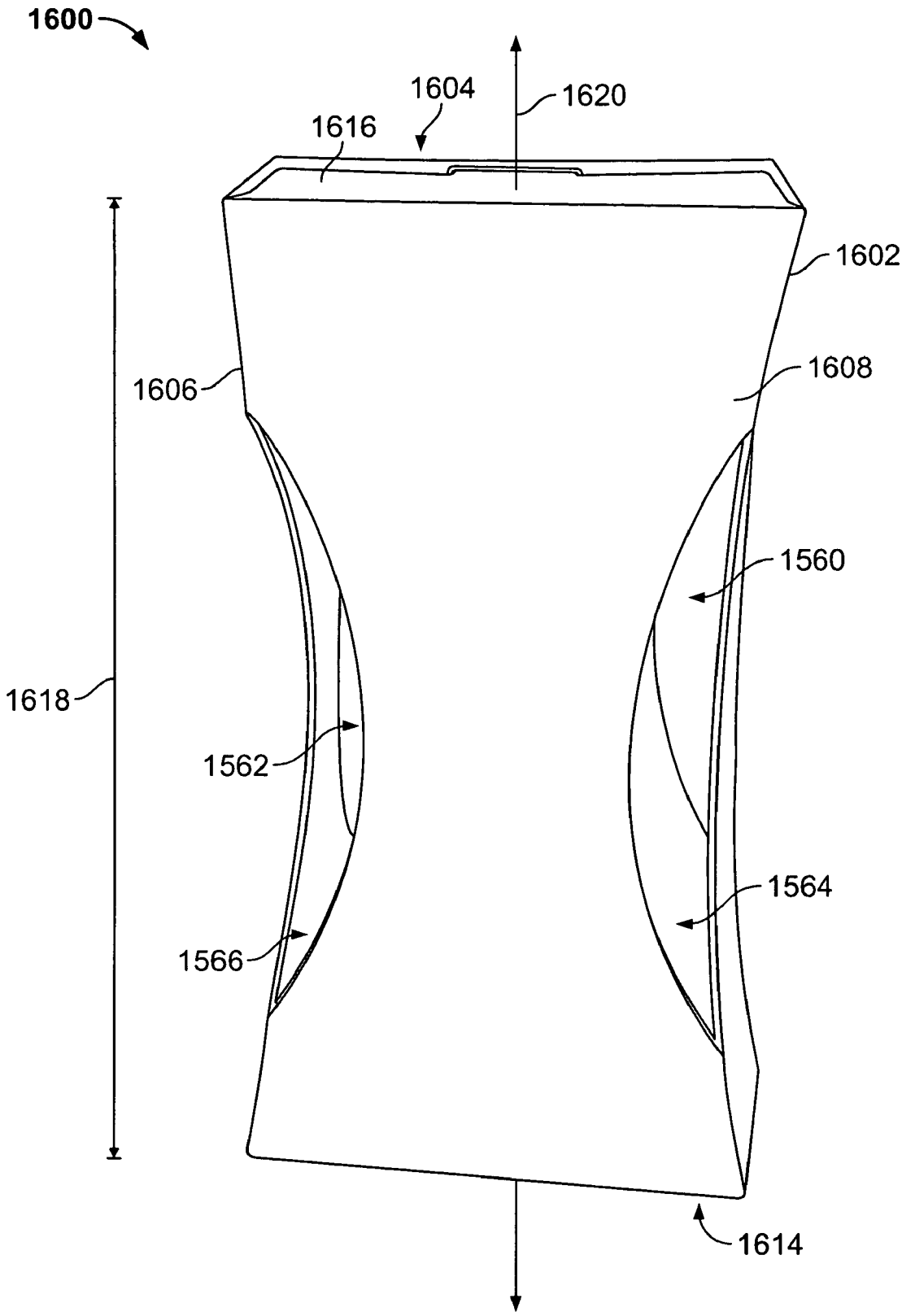
FIG. 37 is a perspective view of the carton formed from the blank shown in FIG. 36.
Figure 38:
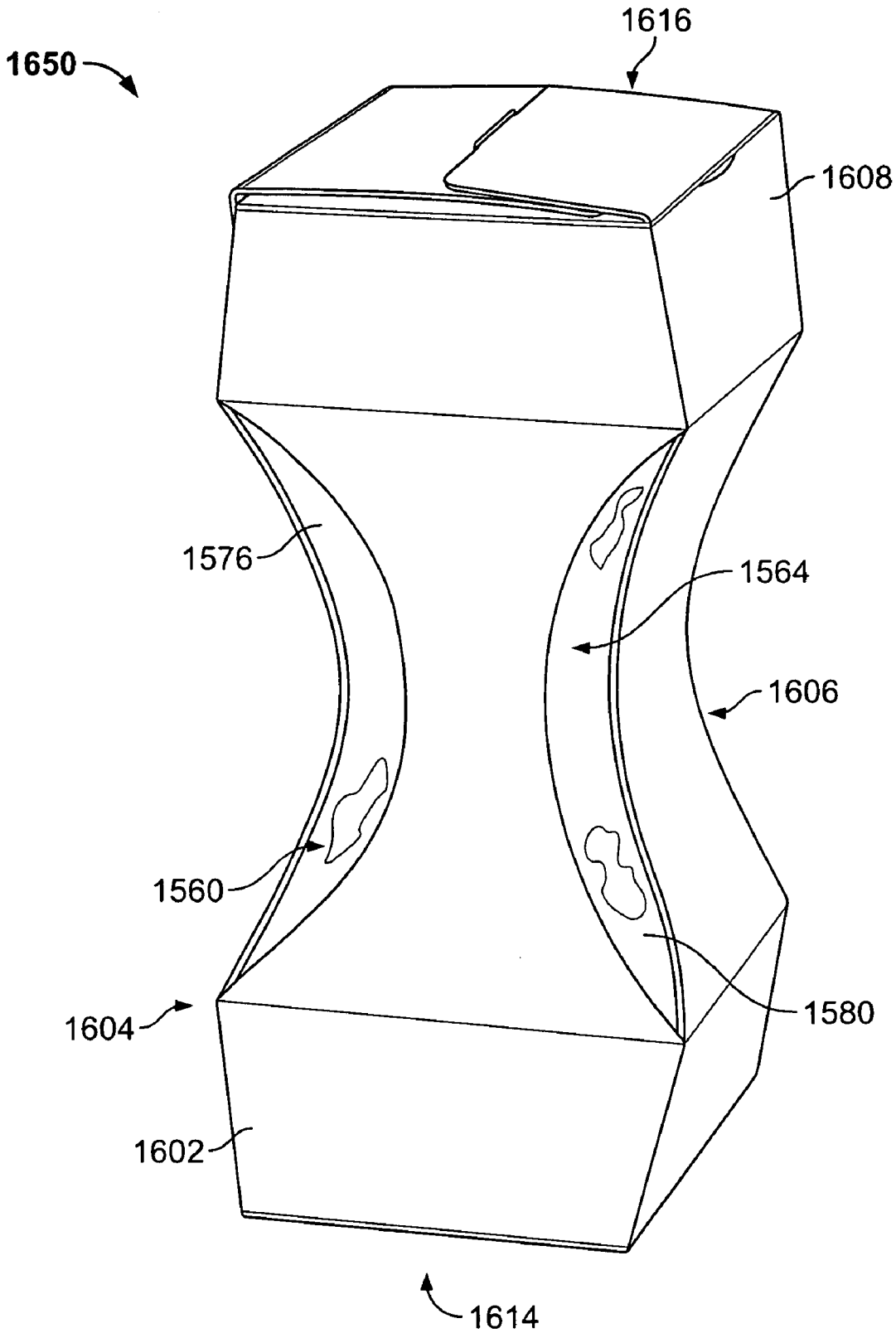
FIG. 38 is a perspective view of a packaging assembly including the carton shown in FIG. 37.

FIGS. 36-38 show a packaging assembly according to one embodiment. Specifically, FIG. 36 is a top plan view of a blank of sheet material 1500. FIG. 37 is a perspective view a carton 1600 formed from blank 1500 shown in FIG. 36. FIG. 38 is a perspective view of a packaging assembly 1650 including carton 1600 shown in FIG. 37.

Referring to FIG. 36, in one embodiment, blank 1500 has an interior surface 1501 and an opposing exterior surface. Blank 1500 include a first series 1502 of three successive side panels 1504, 1506, 1508, and a second series 1510 of three successive side panels 1512, 1514 and 1516. Side panels 1504, 1506 and 1508 are connected together by preformed fold lines 1518 and 1520, and side panels 1512, 1514 and 1516 are similarly connected together by preformed fold lines 1522 and 1524, respectively. First series 1502 is coupled to second series 1510 by a bottom support panel 1526. In this embodiment, side panel 1506 is connected to bottom support panel 1526 along a fold line 1528 and side panel 1514 is connected to bottom support panel 1526 along a fold line 1529, generally opposing fold line 1528. Further, a fold line 1530 and a generally opposing and parallel fold line 1531 are also formed in bottom panel 1526, as shown in FIG. 36. Each side panel 1504, 1506 and 1508 extends a height measured between a bottom end 1552 and a top end 1554 and each side panel 1512, 1514 and 1516 extends a height measured between a bottom end 1556 and a top end 1558. Side panel 1504 is coupled to side panel 1512, and side panel 1508 is coupled to side panel 1516 to form carton 1600, as shown in FIG. 37.

Blank 1500 also includes a first top support panel 1532 connected to side panel 1514 along fold line 1534 and extends outwardly therefrom. First top support panel 1532 includes a tab 1536. An opposing second top support panel 1538 is connected to side panel 1506 along fold line 1540 and extends outwardly therefore. Second top support panel 1538 forms or defines a slot 1542. With first top support panel 1532 folded with respect to side panel 1514 and second top support panel 1538 folded with respect to side panel 1506, tab 1536 engages with slot 1542 to secure first top support panel 1532 to second top support panel 1538 to form carton 1600, as shown in FIG. 37. In an alternative embodiment, top support panel 1532 and top support panel 1538 are connected using any suitable connecting mechanism. For example, an adhesive is applied to portions of top support panel 1532 and/or top support panel 1538. As shown in FIG. 36, in one embodiment, a first top panel 1544 is connected to side panel 1504 along a fold line 1546 and a second top panel 1548 is connected to side panel 1508 along a fold line 1550 to provide additional support to the top of carton 1600.

As shown in FIG. 36, in one embodiment, at least a portion of each side panel 1504, 1506, 1508, 1512, 1514 and 1516 is movable between an initially biased first position and a second position. As shown in FIG. 36, a void is at least partially defined between adjacent side panels to accommodate changing a cross-sectional area of carton 1600. In this embodiment, movable side panel 1504 defines an arcuate portion along edge 1568 and partially defines a first void 1560 along a second side edge generally corresponding to fold line 1518. Movable side panel 1506, connected to movable side panel 1504 along fold line 1518, defines a remaining portion of first void 1560 and partially defines a second void 1562 along a second side edge generally corresponding to fold line 1520. Movable side panel 1508, connected to movable side panel 1506 along fold line 1520, defines a remaining portion of second void 1562 and defines an arcuate portion along edge 1570.

Similarly, movable side panel 1512 defines an arcuate portion along edge 1572 that generally corresponds with the portion of first void 1560 defined by movable side panel 1504 with carton 1600 in the assembly configuration and partially defines third void 1564 along a second side edge generally corresponding to fold line 1522. Movable side panel 1514, connected to movable side panel 1512 along fold line 1522, defines a remaining portion of third void 1564 and partially defines fourth void 1566 along a second side edge generally corresponding to fold line 1524. Movable side panel 1516, connected to movable side panel 1514 along fold line 1524, defines a remaining portion of fourth void 1566 and defines an arcuate portion along edge 1574 that generally corresponds with the portion of second void 1562 defined by movable side panel 1508 with carton 1600 in assembly configuration.

A first heat-shrink patch 1576 is coupled to interior surface 1501 of blank 1500 to cover each void 1560 and 1562. In a particular embodiment, heat-shrink patch 1576 is coupled to each movable side panel 1504, 1506 and 1508 at least along a boundary line or area, generally shown as phantom line 1578, which substantially surrounds and/or defines voids 1560 and 1562. Heat-shrink patch 1576 is coupled to interior surface 1501 at each movable side panel 1504, 1506 and 1508 using any suitable coupling process, such as by applying an adhesive material or an adhesive layer to interior surface 1501 and/or a portion of heat-shrink patch 1576, and applying a suitable pressure to couple heat-shrink patch 1576 to interior surface 1501.

A second heat-shrink patch 1580 is coupled to interior surface 1501 of blank 1500 to cover each void 1564 and 1566. In a particular embodiment, heat-shrink patch 1580 is coupled to each movable side panel 1512, 1514 and 1516 at least along a boundary line or area, generally shown by phantom line 1582, which substantially surrounds and/or defines voids 1564 and 1566. Heat-shrink patch 1580 is coupled to interior surface 1501 at each movable side panel 1512, 1514 and 1516 using any suitable coupling process, such as by applying an adhesive material or an adhesive layer to interior surface 1501 and/or a portion of heat-shrink patch 1580, and applying a suitable pressure to couple heat-shrink patch 1580 to interior surface 1501.

As shown in FIG. 37, carton 1600 can be formed from blank 1500 by folding blank 1500 about fold lines 1518, 1520, 1522, 1524, 1528, 1529, 1530, 1531, 1534, 1540, 1546 and 1550. In one embodiment, an adhesive may be applied to portions of blank 1500 to secure carton 1600 together. Side panel 1504 is connected to side panel 1512 to form side 1602, and side panel 1508 is connected to side panel 1516 to form side 1606. Side panel 1506 forms side 1604 and side panel 1514 forms side 1608 of carton 1600, as shown in FIG. 37. Bottom support panel 1526 forms bottom 1614 of carton 1600. Top support panel 1532 connected to top support panel 1538, and top panels 1544 and 1548, form top 1616 of carton 1600. Carton 1600 extends a height 1618 measured between bottom 1614 and top 1616 of carton 1600 along a central longitudinal axis 1620 extending through carton 1600. In a first or pre-shrunk configuration, carton 1600 includes sides 1602, 1604, 1606 and 1608 in a pre-shrunk, first position. In one embodiment, the structure of carton 1600 biases sides 1602, 1604, 1606 and 1608 in the first position. Once carton 1600 has been formed, and either before, simultaneously with, or after a product is placed within carton 1600, heat-shrink patches 1576 and 1580 are heat-shrunk to form a packaging assembly 1650, as shown in FIG. 38.

In this embodiment, carton 1600 formed from blank 1500 is subjected to a suitable heating process, as described above, to melt heat-shrink patches 1576 and 1580 causing heat-shrink patches 1576 and 1580 to shrink without adversely affecting the coupling of heat-shrink patches 1576 and 1580 to interior surface 1501. As heat-shrink patches 1576 and 1580 melt and shrink, movable side panels 1504, 1506 and 1508, and movable side panels 1512, 1514 and 1516, respectively, are moved or urged together to at least partially close corresponding void 1560, 1562, 1564 and 1566. After the heating process, heat-shrink patches 1576 and 1580 cool and remain in the shrunk configuration to hold or retain carton 1600 in a substantially fixed second position. In this embodiment, with heat-shrink patches 1576 and 1580 in the shrunk position, heat-shrink patches 1576 and 1580 retain movable side panels 1504, 1506, 1508, 1512, 1514 and/or 1516 in the second position.

Accordingly, movement between the first position and the second position varies or changes a cross-sectional area of carton 1600 defined between sides 1602, 1604, 1606 and 1608 along the height of carton 1600. In alternative embodiments, only a portion or section of side 1602, 1604, 1606 and/or 1608 is movable between the first position and the second position.

Figure 39:
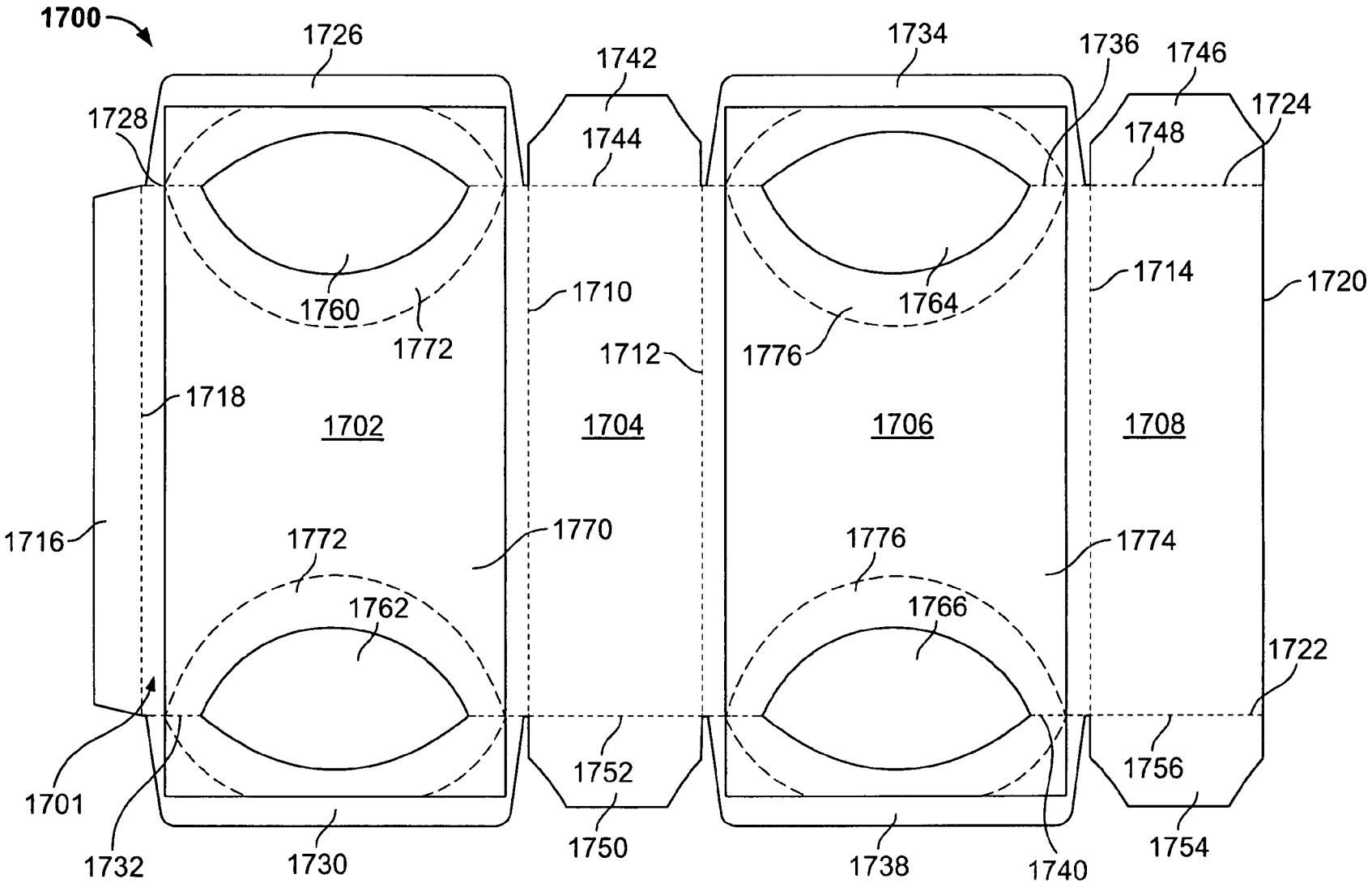
FIG. 39 is a top plan view of a blank of sheet material for forming a carton, according to one embodiment of this invention.
Figure 40:
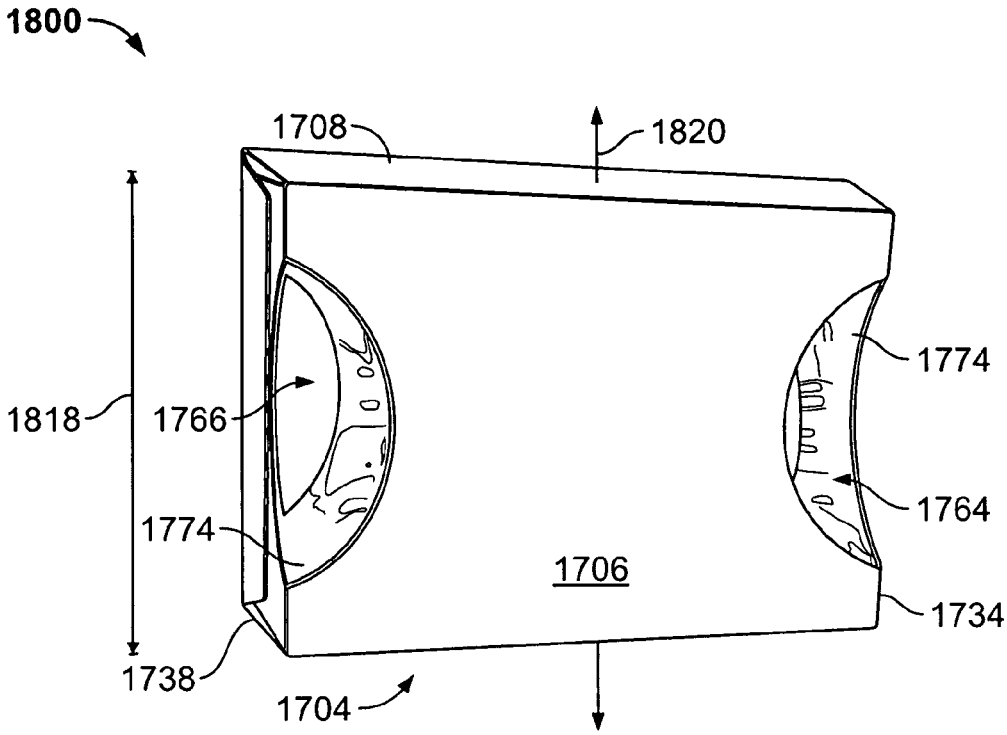
FIG. 40 is a perspective view of the carton formed from the blank shown in FIG. 39.
Figure 41:
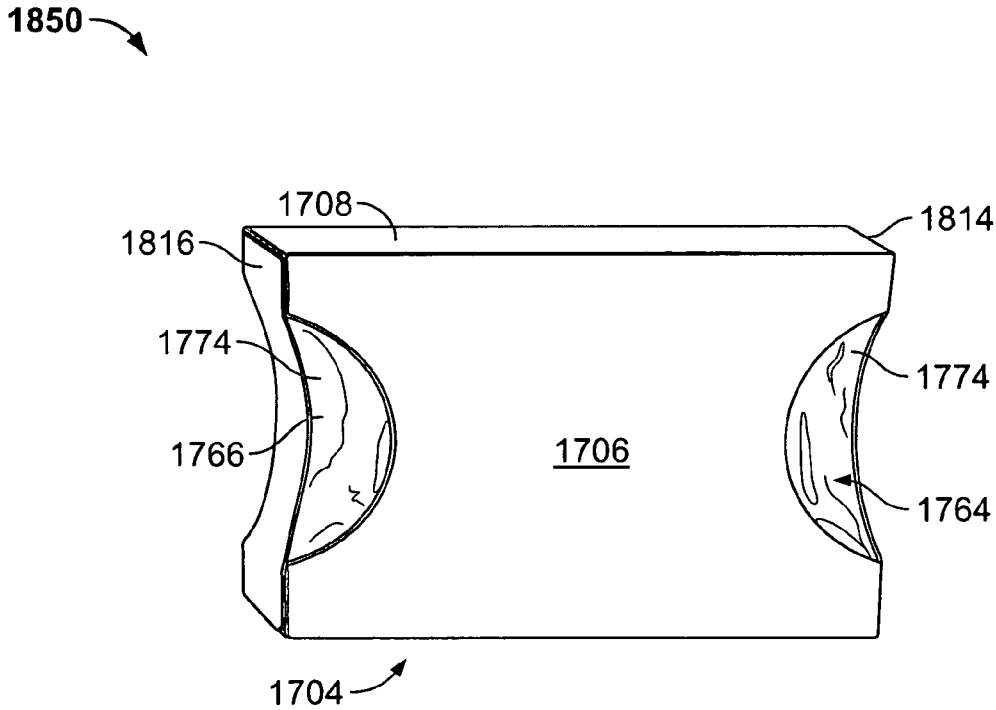
FIG. 41 is a perspective view of a packaging assembly including the carton shown in FIG. 40.

FIGS. 39-41 show a packaging assembly according to one embodiment. Specifically, FIG. 39 is a top plan view of a blank of sheet material 1700. FIG. 40 is a perspective view a carton 1800 formed from blank 1700 shown in FIG. 39. FIG. 41 is a perspective view of a packaging assembly 1850 including carton 1800 shown in FIG. 40.

Referring to FIG. 39, in one embodiment, blank 1700 has an interior surface 1701 and an opposing exterior surface. Blank 1700 includes a succession of four side panels 1702, 1704, 1706 and 1708 that are connected together by a plurality of preformed, generally parallel, fold lines 1710, 1712 and 1714, respectively. Side panels 1702, 1704, 1706 and 1708 extend from an adjacent side panel along respective fold lines 1710, 1712 and 1714. A side panel flap 1716 extends from side panel 1702 along an end fold line 1718 to secure side panel flap 1716 to side panel 1708 to form carton 1800. In an alternative embodiment, a side panel flap (not shown) extends from side panel 1708 along an end fold line (not shown) formed along an edge 1720 to secure the side panel flap to side panel 1702 to form carton 1800.

Each side panel 1702, 1704, 1706 and 1708 extends a height measured between a bottom end 1722 and a top end 1724. As shown in FIG. 39, a top support panel 1726 extends from side panel 1702 at top end 1724 along a fold line 1728. A bottom support panel 1730 extends from side panel 1702 at bottom end 1722 along a fold line 1732. Additionally, a top support panel 1734 extends from side panel 1706 at top end 1724 along a fold line 1736 and a bottom support panel 1738 extends from side panel 1706 at bottom end 1722 along a fold line 1740. Top support panel 1726 is connected to top support panel 1734 to form a top 1814 of carton 1800. Bottom support panel 1730 is connected to bottom support panel 1738 to form a bottom 1816 of carton 1800. It is apparent to those skilled in the art and guided by the teachings herein provided that top support panels 1726, 1734 and/or bottom support panels 1730, 1738 can be connected using any suitable connection mechanism. For example, in one embodiment, adhesive is applied to top support panels 1726, 1734 and/or bottom support panels 1730, 1738.

In one embodiment, a top panel 1742 is connected to side panel 1704 along a fold line 1744 and a top panel 1746 is connected to side panel 1708 along a fold line 1748 to provide additional support to top 1814 of carton 1800. Further, a bottom panel 1750 is connected to side panel 1704 along a fold line 1752 and a bottom panel 1754 is connected to side panel 1708 along a fold line 1756 to provide additional support to the bottom of carton 1800.

As shown in FIG. 39, at least a portion of side panel 1702, 1704, 1706 and/or 1708, at least a portion of top support panels 1726 and/or 1734, and/or at least a portion of bottom support panels 1730 and/or 1738, is movable between an initially biased first position and a second position. In one embodiment, side panels 1702 and 1706, top support panels 1726 and 1734 and bottom support panels 1730 and 1738 are movable. In this embodiment, movable side panel 1702 partially defines a first void 1760 along fold line 1728 and partially defines a second void 1762 along fold line 1732. Movable top support panel 1726, connected to movable side panel 1702 along fold line 1728, defines a remaining portion of first void 1760 and movable bottom support panel 1730, connected to movable side panel 1702 along fold line 1732, defines a remaining portion of second void 1762. Movable side panel 1706 partially defines a third void 1764 along fold line 1736 and partially defines a fourth void 1766 along fold line 1740. Movable top support panel 1734, connected to movable side panel 1706 along fold line 1736, defines a remaining portion of third void 1764 and movable bottom support panel 1738, connected to movable side panel 1704 along fold line 1740, defines a remaining portion of fourth void 1766.

A first heat-shrink patch 1770 is coupled to interior surface 1701 of blank 1700 to cover void 1760 and void 1762. In a particular embodiment, heat-shrink patch 1770 is coupled to movable side panel 1702, movable top support panel 1726 and movable bottom support panel 1730 at least along a boundary line or area, generally shown by phantom line 1772, which substantially surrounds and/or defines voids 1760 and 1762. Heat-shrink patch 1770 is coupled to interior surface 1701 at movable top support panel 1726 and movable bottom support panel 1730 using any suitable coupling process, such as by applying an adhesive material or an adhesive layer to interior surface 1701 and/or a portion of heat-shrink patch 1770, and applying a suitable pressure to couple heat-shrink patch 1770 to interior surface 1701.

A second heat-shrink patch 1774 is coupled to interior surface 1701 of blank 1700 to cover void 1764 and void 1766. In a particular embodiment, heat-shrink patch 1774 is coupled to movable side panel 1706, movable top support panel 1734 and movable bottom support panel 1738 at least along a boundary line or area, generally shown by phantom line 1776, which substantially surrounds and/or defines voids 1764 and 1766. Heat-shrink patch 1774 is coupled to interior surface 1701 at movable side panel 1706, movable top support panel 1734 and movable bottom support panel 1738 using any suitable coupling process, such as by applying an adhesive material or an adhesive layer to interior surface 1701 and/or a portion of heat-shrink patch 1770, and applying a suitable pressure to couple heat-shrink patch 1770 to interior surface 1701.

As shown in FIG. 40, carton 1800 is formed from blank 1700 by folding blank 1700 about fold lines 1710, 1712, 1714, 1718, 1728, 1732, 1736, 1740, 1744, 1748, 1752 and 1756. In one embodiment, an adhesive may be applied to portions of blank 1700 to secure carton 1800 together. Top support panel 1726 is connected to top support panel 1734 to form top 1814 of carton 1800. Bottom support panel 1730 is connected to bottom support panel 1738 to form bottom 1816 of carton 1800. Carton 1800 extends a height 1818 measured between top 1814 and bottom 1816 of carton 1800 along a central longitudinal axis 1820 extending through carton 1800. As shown in FIG. 40, in a first or pre-shrunk configuration, carton 1800 includes side panels 1702, 1704, 1706 and 1708 in a pre-shrunk, first position. In one embodiment, the structure of carton 1800 biases side panels 1702, 1704, 1706 and 1708 in first position. Once carton 1800 has been formed, and either before, simultaneously with, or after a product is placed within carton 1800, heat-shrink patches 1770 and 1774 are heat-shrunk to form packaging assembly 1850, as shown in FIG. 41.

Carton 1800 formed from blank 1700 is subjected to a suitable heating process, as described above, to melt heat-shrink patches 1770 and 1774 causing heat-shrink patches 1770 and 1774 to shrink without adversely affecting the coupling of heat-shrink patches 1770 and 1774 to interior surface 1701. As heat-shrink patch 1770 melts and shrinks, movable side panel 1702, movable top support panel 1726 and movable bottom support panel 1730 are moved or urged together to at least partially close corresponding voids 1760 and 1762. Similarly, as heat-shrink patch 1774 melts and shrinks, movable side panel 1706, movable top support panel 1734 and movable bottom support panel 1738 are moved or urged together to at least partially close corresponding voids 1764 and 1766. After the heating process, heat-shrink patches 1770 and 1774 cool and remain in the shrunk configuration to hold or retain carton 1800 in a substantially fixed second position.

In this embodiment, with heat-shrink patches 1770 and 1774 in the shrunk position, heat-shrink patch 1770 retains movable side panel 1702, movable top support panel 1726 and movable bottom support panel 1730 in the second position, and heat-shrink patch 1774 retains movable side panel 1706, movable top support panel 1734 and movable bottom support panel 1738 in the second position. As shown in FIG. 41, at least a portion of movable side panels 1702 and/or 1706, at least a portion of movable top support panel 1726 and/or 1734, and/or at least a portion of movable bottom support panels 1730 and/or 1738 have an arcuate or curved surface in the second position.

Referring further to FIGS. 40 and 41, at least a portion of side panel 1702, 1704, 1706 and 1708 is movable between a first position, as shown in FIG. 40, and a second position, as shown in FIG. 41. Accordingly, movement between the first position and the second position varies or changes a cross-sectional area of carton 1800 defined between sides 1802, 1804, 1806 and 1808 along height 1818 of carton 1800. In a particular embodiment, each movable side panel 1702, 1704, 1706 and/or 1708 is biased in the first position, as shown in FIG. 40. In this embodiment, movable side panels 1702, 1704, 1706 and/or 1708 are biased in the first position using any suitable mechanism, such as a structure of carton 1800 biasing movable side panels 1702, 1704, 1706 and/or 1708.

Figure 42:
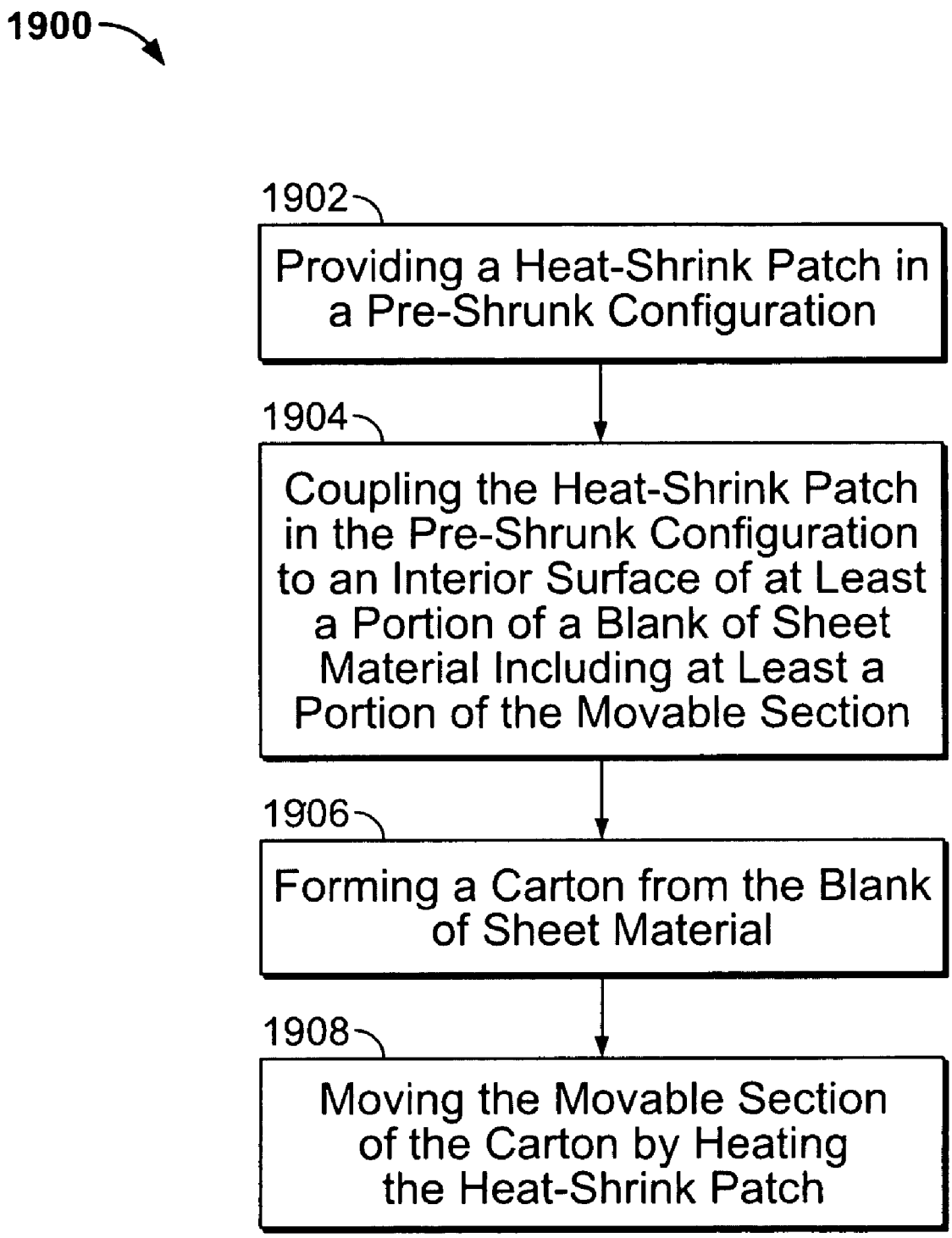
FIG. 42 is a flowchart illustrating a method for applying a heat-shrink patch to a carton for forming a shape of the carton.

As shown in FIG. 42, in one embodiment, a method 1900 for applying a heat-shrink patch to a carton for forming a shape of the carton is applied to any suitable carton including, without limitation, the cartons described above. It is apparent to those skilled in the art and guided by the teachings herein provided that method 1900 is suitable for applying a heat-shrink patch to any suitable carton that includes a top panel, a bottom panel, at least one side panel extending between the top panel and the bottom panel and at least one movable section that is movable between a first position and a second position for forming a shape of the carton. Method 1900 includes the steps of providing 1902 a heat-shrink patch in a pre-shrunk configuration, coupling 1904 the heat-shrink patch in the pre-shrunk configuration to at least a portion of an interior surface of a blank of sheet material including at least a portion of the movable section, forming 1906 the carton from the blank of sheet material and moving 1908 the movable section from the first position to the second position to form the shape of the carton. The shape of the carton is formed by heating the heat-shrink patch to shrink the heat-shrink patch to a shrunk configuration. In one embodiment, the method includes filling the carton with contents before moving the movable section. In an alternative embodiment, the carton is filled with contents after moving the movable section.

In an alternative embodiment, a preformed heat-shrink film tube is coupled to at least a portion of the interior surface of the blank of sheet material, in addition to or as an alternative to the heat-shrink patch. In this embodiment, the heat-shrink film tube is coupled to the interior surface using any suitable coupling mechanism, such as an adhesive, heat and/or sonic welding. In a particular embodiment, moist or wet products and/or products requiring a high barrier protection are loaded into the heat-shrink film tube. The heat-shrink film tube and/or the carton are sealed to contain the products within the heat-shrink film tube. The carton is subjected to a suitable heating process, for example by directing or focusing heat at a portion of the heat-shrink film tube covering the voids formed in the carton. The movable sections of the carton move to at least partially close the voids during the controlled heating process to shape the carton, as desired. In this embodiment, the heat-shrink film tube provides a sealed, liquid-tight moisture barrier carton. In another alternative embodiment, a heat-shrink film laminate material is coupled to at least a portion of the interior surface of the blank of sheet material. The heat-shrink film laminate covers the voids formed in the blank of sheet material and is exposed to an exterior of the carton through the voids. The carton is subjected to a suitable heating process, for example by directing or focusing heat at the portion of the heat-shrink film laminate covering the voids formed in the carton, to shape the carton, as desired. The movable sections of the carton move to at least partially close the voids during the controlled heating process. In this embodiment, the heat-shrink film laminate provides an additional barrier protection to the carton.

In one embodiment, the method includes filling the carton with contents before moving the movable section. In an alternative embodiment, the carton is filled with contents after moving the movable section. Depending upon the product type and/or configuration, the carton is formed and shaped prior to filling the carton with product, e.g., while the carton is empty. Alternatively, the carton is formed, the product is loaded into the carton and the carton is sealed, prior to shaping the carton. In this embodiment, the loaded packaging assembly is subjected to a controlled heating process in which the heat-shrink patch is shrunk to shape the carton.

In one embodiment, providing step 1902 further includes providing a heat-shrink patch in a pre-shrunk configuration having a marking thereon including graphics for the carton. The marking may include graphics for the carton or graphics to coordinate with additional graphics printed on the carton. In one embodiment, the markings are applied using an opaque ink. Alternatively, the markings may be applied using a translucent ink such that the markings coordinate with the additional graphics printed on the carton. The heat-shrink patch includes polyethylene, polypropylene, polyvinyl chloride, polyester, polyester glycol, nylon and/or oriented polystyrene. In alternative embodiments, the heat-shrink patch includes any suitable material or combination of materials known to those skilled in the art and guided by the teachings herein provided.

In one embodiment, coupling step 1904 further includes applying an adhesive in a registered pattern to at least a portion of the interior surface of the blank of sheet material including at least a portion of the movable section. The heat-shrink patch is cut to correspond to the registered pattern and adhered to the interior surface of the blank within the registered pattern. In one embodiment, the adhesive is applied such that the adhesive extends about a void at least partially defined by the movable section to substantially surround the void. With the adhesive substantially surrounding the void, the heat-shrink patch is adhered to the interior surface to cover the void and provide a seal preventing air and or contaminants from entering the carton through the void. In alternative embodiments, coupling step 1904 includes employing any suitable coupling mechanism including, without limitation, a heating method and or a sonic welding method, with or without the application of an adhesive.

In one embodiment, a first movable section and a second movable section are coupled together along a fold line and define the void along a portion of the fold line. Adhesive is applied in a registered pattern to the interior surface of the blank of sheet material including at least a portion of the first movable section and at least a portion of the second movable section. For example, the adhesive is applied within a boundary area that substantially surrounds and/or defines the void. The heat-shrink patch is cut to correspond to the registered pattern. The heat-shrink patch is adhered to the interior surface of the blank including at least a portion of the first movable section and at least a portion of the second movable section within the registered pattern to cover the void. In this embodiment, during the moving step the first movable section is moved or urged towards the second movable section to at least partially close the void defined along the fold line.

In an alternative embodiment, a second heat-shrink patch is coupled to the second movable section of the carton. The second movable section is moved from a first position to a second position to form a shape of the carton by heating the second heat-shrink patch to a shrunk configuration. In a particular alternative embodiment, the second heat-shrink patch is adhered to the interior surface of the blank to cover a second void at least partially defined by the second movable section. In addition to the use of different shrink film materials and/or controlled temperature applications, a controlled and/or specifically directed heat, time and/or temperature application to at least one area of the carton, such as to at least one panel or movable section, is utilized in particular embodiments to achieve a lesser or greater degree of shaping in the selected area or areas, as desired.

In one embodiment, moving step 1908 includes heating the heat-shrink patch to shrink the heat-shrink patch to a shrunk configuration and move or urge the moveable section to the second position to form the shape of the carton. The movable section may include at least one panel and/or at least one section of at least one panel. In this embodiment, the cross-sectional area of the carton is changed when the moveable section is moved from the first position to the second position. After the heating process, the heat-shrink patch is cooled to remain in the shrunk configuration to hold or retain the carton in a substantially fixed second position. In one embodiment, with the heat-shrink patch in the shrunk position, heat-shrink patch retains the movable panel or at least a movable section of the panel in the second position.

In one embodiment, heat is focused at the heat-shrink patch to shrink the heat-shrink patch to a shrunk configuration and move the movable section to the second position to form the shape of the carton. In a particular embodiment, heat is applied to selected portions of the heat-shrink patch at different intensities to differentially shrink the heat-shrink patch. Additionally, or alternatively, an intensity and/or temperature of the heat can be varied to create differential shrinkage of the heat-shrink patch. In one embodiment, a plurality of different heating temperatures can be applied to at least a portion of the heat-shrink patch for controlling a degree of shrinkage of the heat-shrink patch. For example, heat is applied to a first portion of the heat-shrink patch (or to a first heat-shrink patch) at a first temperature and heat is applied to a second portion of the heat-shrink patch (or to a second heat-shrink patch) at a second temperature different from the first temperature.

In an alternative embodiment, moving step 1908 includes providing a plurality of heat-shrink patches in a pre-shrunk configuration having different shrink orientations and percentages. The moveable section is moved from the first position to the second position by heating the heat-shrink patches to shrink the heat-shrink patches. Upon heating the different heat-shrink patches, each heat-shrink patch shrinks to a different degree allowing the heat-shrink patches to form a shape of the carton.

In another embodiment, the movable section of the carton is moved by applying at least one heat-shrink patch to the blank and heating the at least one heat-shrink patch at different temperatures to control the degree of shrinkage. As such, the heat-shrink patch forms the shape of the carton. It is further possible to control the degree of heat-shrink patch shrinkage by combining any of the hereinabove described methods. As such, the degree of heat-shrink patch shrinkage can be controlled by any combination of using a specific heat-shrink patch film type, controlling the temperature of heating and/or targeting or focusing the heat applied to the heat-shrink patch. Any or a combination of these methods will facilitate moving the movable section of the carton from a first position to a second position to form a shape of the carton. This shape may further include a cut-out in the carton to allow visibility of the product within the carton. In one embodiment, the moveable section includes at least a portion of a cut-out formed in the carton which allows for the movement of the carton. By heating the different heat-shrink patches, the moveable section can be moved such that the cut-out is closed by the panels of the carton or the cut-out is only partially closed to allow the product included within the carton to be visible to a consumer.

In one embodiment, a packaging assembly is formed that includes a carton having a shape. The carton includes a top panel, a bottom panel, at least one side panel extending between the top panel and the bottom panel and a movable section that is movable between a first position and a second position. A blank of sheet material is provided. The blank includes a first movable section coupled to a second movable section at a fold line. The first movable section and the second movable section define a void positioned on the fold line. An adhesive is applied in a registered pattern to an interior surface of the blank to substantially surround the void. The heat-shrink patch is coupled in a pre-shrunk configuration to the first movable section and the second movable section within the registered pattern to cover the void. The first movable section is moved or urged towards the second movable section to at least partially close the void to form the shape of the carton. Heat is applied to at least a portion of the heat-shrink patch to shrink the heat-shrink patch to a shrunk configuration. In one embodiment, heat is applied at a plurality of temperatures across a dimension of the heat-shrink patch, e.g., along a length and/or a width of the heat-shrink patch.

The methods described hereinabove is performed by a system or machine configured to carry out the steps shown in FIG. 42. In one embodiment, the system includes a carton having a top panel, a bottom panel, at least one side panel and at least one moveable section configured to move from a first position to a second position. The system further includes a coupling device configured to couple the heat-shrink patch in the pre-shrunk configuration to an interior surface of a blank of sheet material. In one embodiment, the coupling device is configured to apply an adhesive in a registered pattern to at least a portion of the movable section and adhere the heat-shrink patch to the interior surface of the carton within the registered pattern. A forming device is configured to form the carton from the blank of sheet material.

A heating device is configured to heat at least a portion of the heat-shrink patch to shrink the heat-shrink patch to a shrunk configuration to move the movable section from the first position to the second position to form the shape of the carton. The heat-shrinkable film is movable from an initial, first or pre-shrunk configuration to a second or shrunk configuration having a shorter width and/or shorter length than in the pre-shrunk configuration. In one embodiment, the heating device is configured to shrink the heat-shrink patch to the shrunk configuration to move the movable section to at least partially close a void at least partially defined by the movable section. The heat-shrink film is shrinkable to move from the pre-shrunk configuration to the shrunk configuration to move or urge the moveable section of the carton to the second position. In a particular embodiment, as the heat-shrinkable film shrinks, such as by applying suitable heat, at least one void defined at least partially by or within the moveable section at least partially closes to move or urge adjacent movable sections together. After the heating process, the heat-shrink patch cools and remains in the shrunk configuration to hold or retain the carton in a substantially fixed second position. In one embodiment, with the heat-shrink patch in the shrunk position, heat-shrink patch retains the movable panel or at least a movable section of the panel in the second position.

The packaging assembly of the present invention including the heat-shrink patch at least partially seals the carton to protect a product contained within the carton from tampering and to generally seal the edges, corners and/or joints of the carton for containing the product within the carton, as well as protecting the product from contamination. The heat-shrink patch can be used, for example, to replace bags or liners sometimes used within a container for sealing a product. Further, the heat-shrink patch maintains a shape of the carton for example, to facilitate displaying, stacking and or arranging the carton or a plurality of cartons, and/or maintaining a shape that facilitates other functionality such as carrying the carton.

The heat-shrink patch facilitates forming of the carton, and more specifically moving the moveable sections of the carton from an initially biased first position to a second position having an arcuate or curved surface to form the packaging assembly. Cartons having shapes that are more complex than conventional rectangular cartons may be difficult and therefore costly to manufacture. As the heat-shrink patch is heated and shrinks the heat-shrink patch moves, draws or urges the movable sections to the second position to form a shape of the packaging assembly. The heat-shrink patch holds the moved sections in the second position. By moving and holding the movable sections in second position, the heat-shrink patch forms a shape of the packaging assembly, and more specifically the carton, that may be otherwise difficult and costly to form.

While the invention has been described in terms of various specific embodiments, those skilled in the art will recognize that the invention can be practiced with modification within the spirit and scope of the claims.

What is claimed is:

1. A method for applying a heat-shrink patch to a carton for forming a shape of the carton, the carton including a top panel, a bottom panel, at least one side panel extending between the top panel and the bottom panel and a movable section that is movable between a first position and a second position, said method comprising:

providing a heat-shrink patch in a pre-shrunk configuration;

coupling the heat-shrink patch in the pre-shrunk configuration to at least a portion of an interior surface of a blank of sheet material including at least a portion of the movable section;

forming the carton from the blank of sheet material wherein the heat-shrink patch in the pre-shrunk configuration is coupled to an interior surface of the formed carton; and moving the movable section from the first position to the second position to form the shape of the carton by heating the heat-shrink patch to shrink the heat-shrink patch to a shrunk configuration.

2. A method in accordance with claim 1 wherein coupling the heat-shrink patch further comprises:

applying an adhesive in a registered pattern to at least a portion of the movable section;

cutting the heat-shrink patch to correspond to the registered pattern; and adhering the heat-shrink patch to the interior surface within the registered pattern.

3. A method in accordance with claim 2 wherein applying an adhesive in a registered pattern further comprises applying the adhesive to substantially surround a void at least partially defined by the movable section.

4. A method in accordance with claim 2 wherein adhering the heat-shrink patch to the interior surface further comprises adhering the heat-shrink patch to at least a portion of the movable section.

5. A method in accordance with claim 1 further comprising filling the carton with contents before moving the movable section.

6. A method in accordance with claim 1 further comprising filling the carton with contents after moving the movable section.

7. A method in accordance with claim 1 wherein moving the movable section further comprises focusing heat at the heat-shrink patch.

8. A method in accordance with claim 1 wherein moving the movable section further comprises applying heat to portions of the heat-shrink patch at different intensities to differentially shrink the heat-shrink patch.

9. A method in accordance with claim 1 wherein moving the movable section further comprises varying an intensity of heat applied to the movable section.

10. A method in accordance with claim 1 wherein the carton comprises a first movable section connected to a second movable section, and moving the movable section further comprises drawing the first movable section towards the second movable section to at least partially close a void defined between the first movable section and the second movable section.

11. A method in accordance with claim 1 wherein providing a heat-shrink patch in a pre-shrunk configuration further comprises providing a heat-shrink patch comprising at least one of polyethylene, polypropylene, polyvinyl chloride, polyester, polyester glycol, nylon and/or oriented polystyrene.

12. A method in accordance with claim 1 wherein moving the movable section further comprises:

providing a plurality of heat-shrink patches in a pre-shrunk configuration having different shrink orientations and percentages;

coupling each heat-shrink patch to a corresponding movable section of a plurality of movable sections;

moving each movable section from the first position to the second position to form the shape of the carton by heating each heat-shrink patch to shrink each heat-shrink patch.

13. A method in accordance with claim 1 wherein moving the movable section further comprises applying a plurality of different heating temperatures to at least a portion of the heat-shrink patch for controlling a degree of shrinkage of the heat-shrink patch.

14. A method in accordance with claim 1 further comprising:

controlling a degree of shrinkage of the heat-shrink patch by at least one of using a specific type of film material, controlling a temperature of the heating, and focusing the heating on the heat-shrink patch; and moving the movable section from the first position to the second position to form the shape that includes at least one cut-out in the carton such that a product included within the carton is visible.

15. A method in accordance with claim 1 wherein said moving the movable section further comprises changing a cross-sectional area of at least a portion of the carton.

16. A method in accordance with claim 1 wherein the carton comprises a first movable section and a second movable section, the method further comprising:

coupling a second heat-shrink patch to a second movable section of the carton; and moving the second movable section from a first position to a second position to form a shape of the carton by heating the second heat-shrink patch to shrink the second heat-shrink patch to a shrunk configuration.

17. A method in accordance with claim 16 moving the second movable section further comprises moving the first movable section towards the second movable section to close a void defined along a fold line coupling the first movable section to the second movable section.

18. A method for forming a packaging assembly including a carton having a shape, the carton including a top panel, a bottom panel, at least one side panel extending between the top panel and the bottom panel and a movable section that is movable between a first position and a second position, said method comprising:

providing a blank sheet of material having a first movable section coupled to a second movable section at a fold line, the first movable section and the second movable section defining a void positioned on the fold line;

applying an adhesive in a registered pattern to an interior surface of the blank and substantially surrounding the void;

coupling the heat-shrink patch in a pre-shrunk configuration to each of the first movable section and the second movable section within the registered pattern to cover the void;

forming the carton from the blank wherein the heat-shrink patch in the pre-shrunk configuration is coupled to an interior surface of the formed carton; and moving the first movable section towards the second movable section to at least partially close the void to form the shape of the carton by applying heat to the heat-shrink patch to shrink the heat-shrink patch to a shrunk configuration.

19. A method in accordance with claim 18 wherein heat is applied to at least a portion of the heat-shrink patch.

20. A method in accordance with claim 18 wherein heat is applied to a first portion of the heat-shrink patch at a first temperature and heat is applied to a second portion of the heat-shrink patch at a second temperature different from the first temperature.

21. A method in accordance with claim 18 wherein heat is applied at a plurality of temperatures across a dimension of the heat-shrink patch.

22. A system for applying a heat-shrink patch to a carton for forming a shape of the carton, said system comprising:

a blank of sheet material comprising a top panel, a bottom panel, at least one side panel extending between the top panel and the bottom panel and a movable section tat is movable between a first position and a second position;

a coupling device configured to couple the heat-shrink patch in the pre-shrunk configuration to an interior surface of a blank of sheet material;

a forming device configured to form the carton from the blank of sheet material wherein the heat-shrink catch in the pre-shrunk configuration is coupled to an interior surface of the formed carton; and a heating device configured to heat at least a portion of the heat-shrink patch to shrink the heat-shrink patch to a shrunk configuration to move the movable section from the first position to the second position to form the shape of the carton.

23. A system in accordance with claim 22 wherein the coupling device is further configured to apply an adhesive in a registered pattern to at least a portion of the movable section and adhere the heat-shrink patch to the interior surface of the blank within the registered pattern.

24. A system in accordance with claim 22 wherein the heating device is further configured to shrink the heat-shrink patch to the shrunk configuration to move the movable section to at least partially close a void at least partially defined by the movable section.

* * * * *